US009518443B2

(12) United States Patent
Tunget

(10) Patent No.: US 9,518,443 B2
(45) Date of Patent: Dec. 13, 2016

(54) CABLE COMPATIBLE RIG-LESS OPERABLE ANNULI ENGAGABLE SYSTEM FOR USING AND ABANDONING A SUBTERRANEAN WELL

(76) Inventor: Bruce A. Tunget, Westhill (GB)

( * ) Notice: Subject to any disclaimer, the term of this patent is extended or adjusted under 35 U.S.C. 154(b) by 228 days.

(21) Appl. No.: 14/131,168

(22) PCT Filed: Jul. 5, 2012

(86) PCT No.: PCT/US2012/000315
§ 371 (c)(1),
(2), (4) Date: Jun. 20, 2014

(87) PCT Pub. No.: WO2013/006208
PCT Pub. Date: Jan. 10, 2013

(65) Prior Publication Data

US 2014/0311741 A1 Oct. 23, 2014

(30) Foreign Application Priority Data

Jul. 5, 2011 (GB) ..... 1111482.4

(51) Int. Cl.

| | |
|---|---|
| ***E21B 33/13*** | (2006.01) |
| ***E21B 23/14*** | (2006.01) |
| ***E21B 29/00*** | (2006.01) |
| ***E21B 29/06*** | (2006.01) |
| ***E21B 41/00*** | (2006.01) |

(52) U.S. Cl.
CPC ..... *E21B 33/13* (2013.01); *E21B 23/14* (2013.01); *E21B 29/005* (2013.01); *E21B 29/06* (2013.01); *E21B 41/00* (2013.01)

(58) Field of Classification Search
CPC ..... E21B 29/00; E21B 29/06; E21B 29/005; E21B 23/14; E21B 33/13; E21B 41/00; E21B 43/00; E21B 4/02; E21B 7/061
See application file for complete search history.

(56) References Cited

U.S. PATENT DOCUMENTS

| | | | | |
|---|---|---|---|---|
| 5,785,133 | A * | 7/1998 | Murray | E21B 7/061 166/117.5 |
| 6,474,415 | B1 | 11/2002 | Ohmer | |
| 2009/0266544 | A1 * | 10/2009 | Redlinger | E21B 4/02 166/298 |
| 2009/0308605 | A1 | 12/2009 | McAfee et al. | |
| 2010/0126729 | A1 | 5/2010 | Tunget | |
| 2011/0000668 | A1 | 1/2011 | Tunget | |

* cited by examiner

*Primary Examiner* — Yong-suk (Philip) Ro

(57) ABSTRACT

Methods and systems for providing or enabling cap rock restoration of at least a portion of a producible zone of a subterranean well include placing and supporting at least one cement equivalent well barrier member within an operable usable space. This cement equivalent well barrier is formed by at least one cable operable and rig-less string operable, annulus engagable member, comprising cable and rig-less string conveyable components that are conveyed through an innermost passageway and downward from a wellhead. Energy, conductible through said rig-less string or through movable fluid of a circulatable fluid column, is used to operate or access at least one annulus from said innermost passageway and displace at least one portion of a wall of at least one conduit about said innermost passageway, to provide at least one cement equivalent well barrier.

48 Claims, 21 Drawing Sheets

Fig. 1
Prior Art
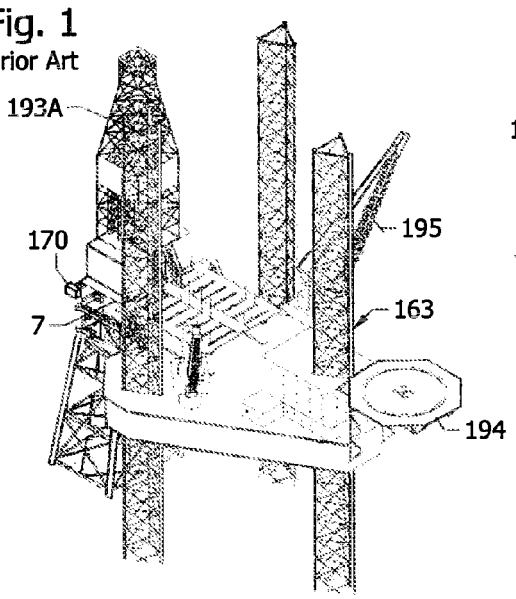
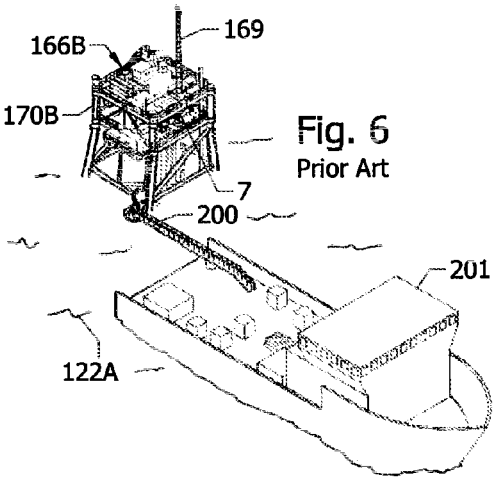
Fig. 6
Prior Art
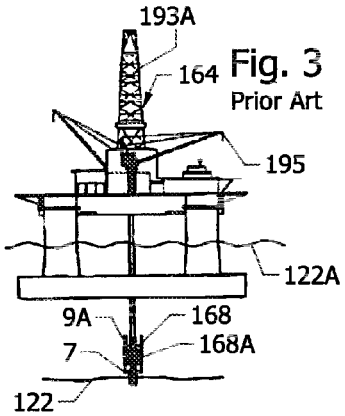
Fig. 3
Prior Art
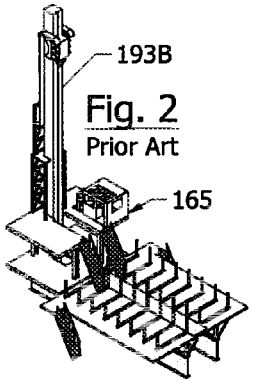
Fig. 2
Prior Art
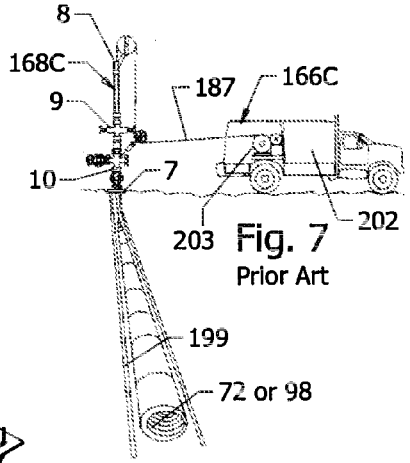
Fig. 7
Prior Art
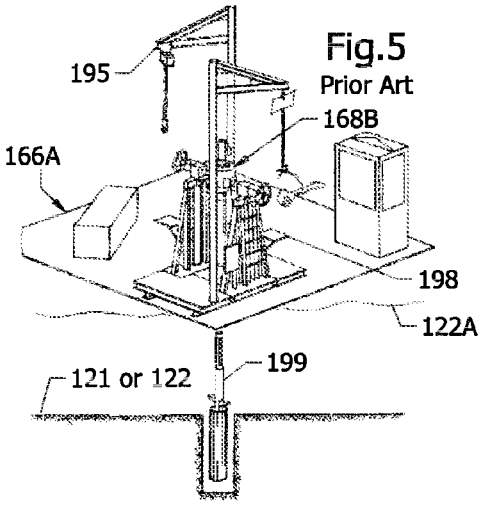
Fig.5
Prior Art
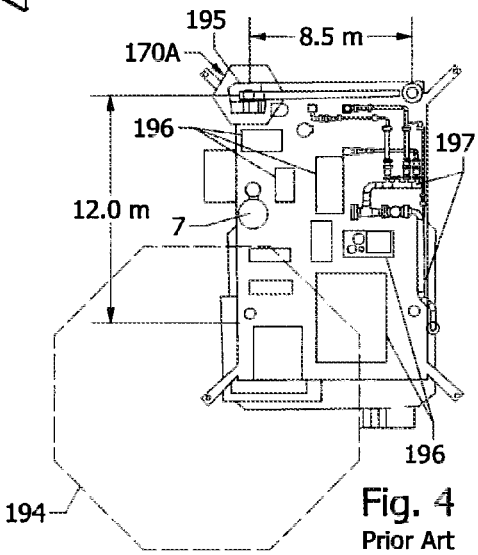
Fig. 4
Prior Art Fig.25
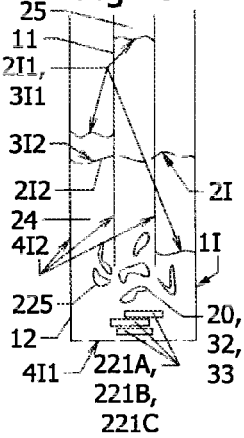
Fig.24
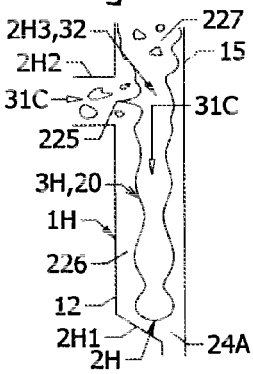
Fig.23
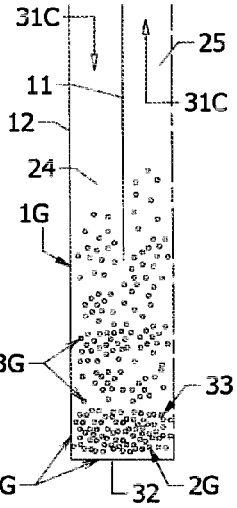
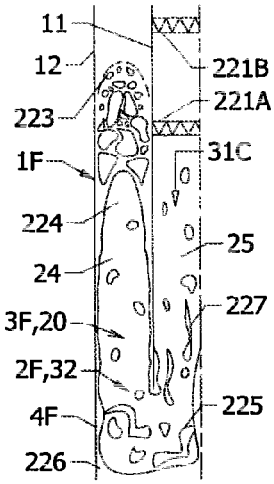
Fig.22
Fig.20
Prior Art
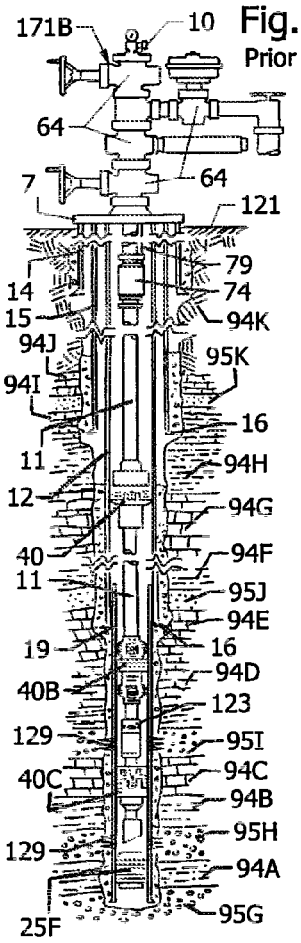
Fig. 21
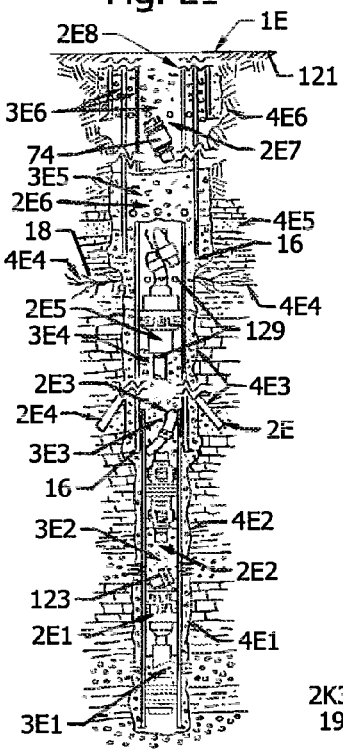
Fig.26
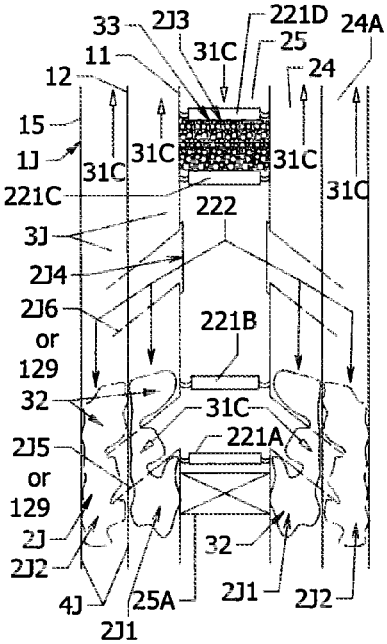
Fig. 26A
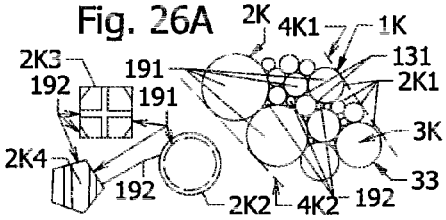

1L
122A
31C1
2L1
31C2
7
121
or
122
24B
36W
15
24A
24
25
12
11
3L4
3L2
4L3
31C2
31C1
18
36W
4L2
2L3
2L
3L3
2L2
40
31C1
16
3L1
4L1
95E
4M
187
31C3
1M
2ME
2M
129U
40
24
187A
12
129L
25
11
20

4M
1M
31C2
2ME
24
2MP
129U
40
12
2MS
20
2M
129L

31C1
4M
1M
25
129U
2MP
40
24
2MS
129L
2M
3M 1N
15
16
11A
17
12
20
4N2
40
11
2N1
3N1
2N
4N1
129
95F 1N
16
11
11A
4N2
129U
40
129L
2N2
3N2
95F 1N
24A
2N8
24
16
25
11
31C
2N3
3N3
4N3
2N5
4N2
2N4
40

1N
15
4N3
2N6
16
2N7
17
3N4
4N3
4N2
2N

Prior
Art

Fig.50
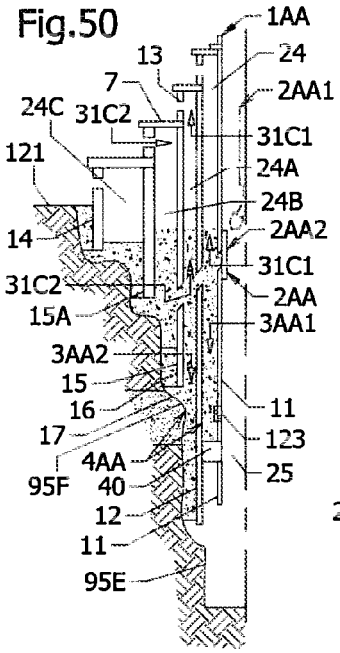
Fig.51
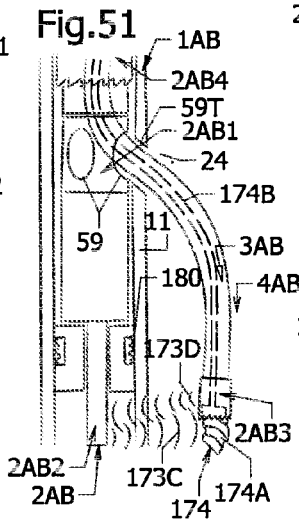
Fig.52
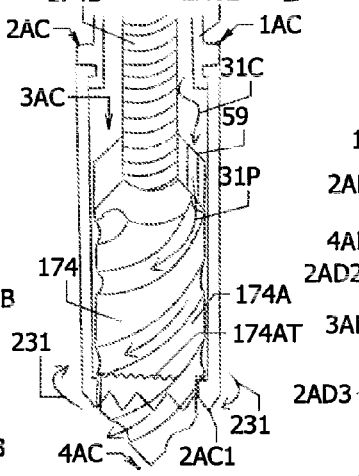
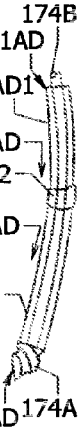
Fig.53
Fig.54
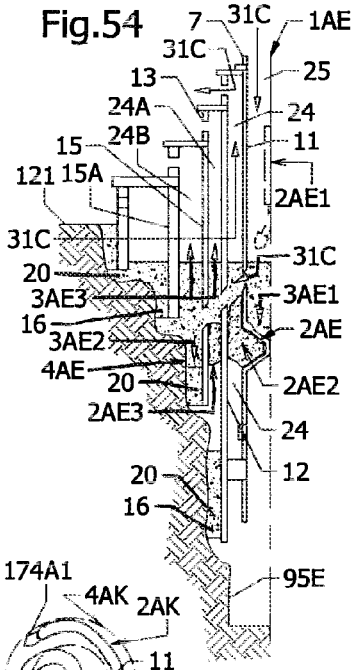
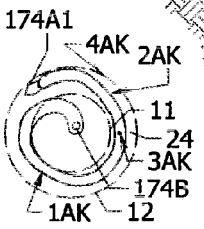
Fig.60
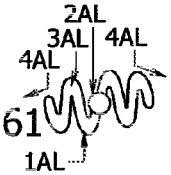
Fig.61
Fig.59
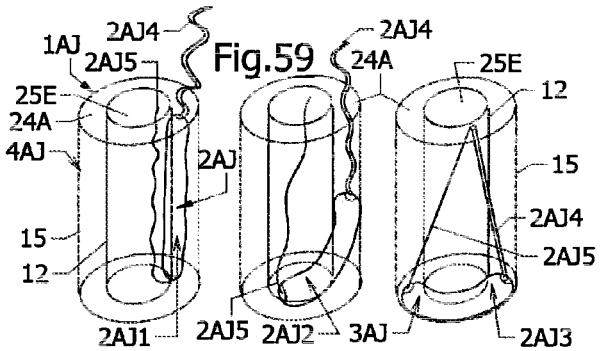
Fig. 55
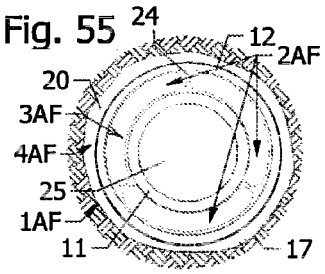
Fig.57
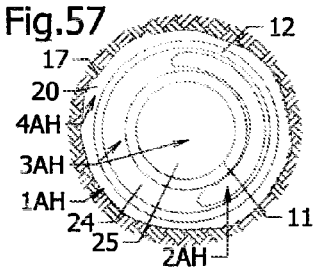
Fig.56
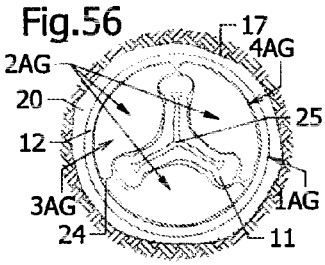
Fig.58
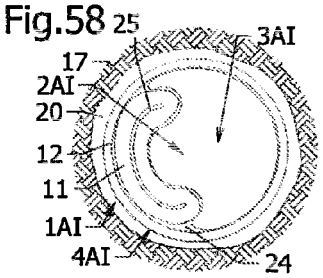

Section A-A

B
B
1BE
177
2BE
45E
31C
66U1
59U1
177
25BE
1BE
179
66U2
31CP2
3BE
180
40
178
4BE
179
12
11
129U
179P
129L
31CP1
180
178
66L2
25BE
177
66L1
177LP

Section B-B

177UP
177
C
D
177
66L1
177LP
180

Detail C
45E
177UP
66U1
177
31CR
59U1
31CR
179
59U2
31CR
66U2
180
31CP2
178
25BE
31CR
129U
11
40

Detail D
31CF
177
178
179
180
177
31CF
178
31CP1
31CF
180
11
129L
31CF
66L2
31CF

59U1
177UP
177
177LP

59U1
180U
179
180L

31CP2
179P
180R
31CP2
178
179P
31CP1
180R
31CP1

181
180
1BF
185
2BF
182
2BF3
184
31C
11U
12
2BF2
25E
3BF
4BF
2BF1
11L
187
2BF
181
2BF3
180
185
182
183
184
144

187
2BF4
186
183
184
144

31C
187
2BG6
186
66P
2BG
144
184
1BG
2BGJ
11U
31C
2BG4
2BGJ
4BGX
4BG
3BG
2BG5
25E
2BG3
2BG2
11L
12
2BG1

187
181
2BG6
2BG
180
185
2BG
182
184
183
186
66P
144

187
2BG7
2BG6
184
183
186
66P
144

E
E
1BH
2BH
187
1BH
2BH
2BH1
182
F
183
11U
12
184
144
134
4BH
3BH

Section E-E

Detail F
2BH
2BH1
1BH
31C
189
144U
182
188
186
183A
66
144L
66P
183
189
184

Detail F
2BH2
1BH
31C
2BH
182
144U
66
188
183A
186
144L
183
66P
189
144
184
2BH

Detail F
2BH3
1BH
31C
2BH
182
183A
144U
66
31C
186
188
144L
183
189
184
66P

Fig.108
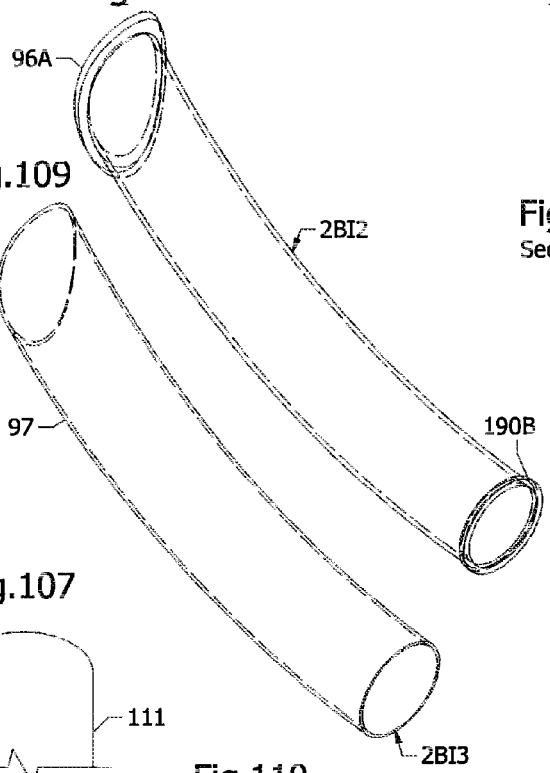
Fig.109
Fig.107
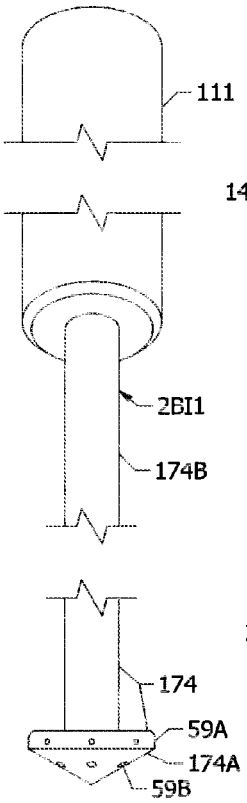
Fig.110
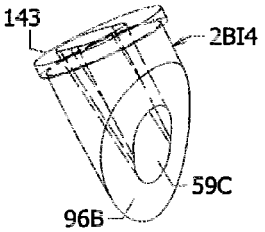
Fig.111
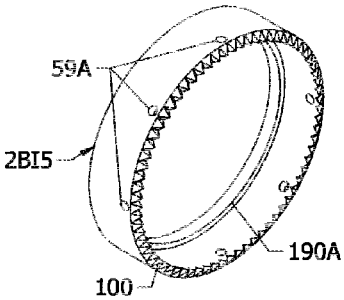
Fig.105
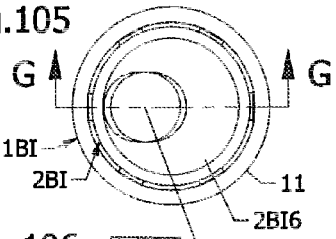
Fig. 106
Section G-G
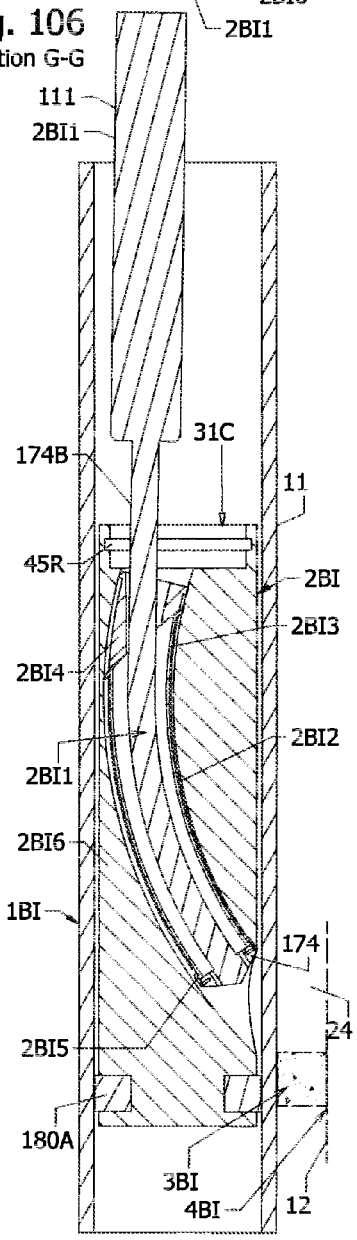

Section H-H

Detail K

Detail L

Detail J

Fig.117
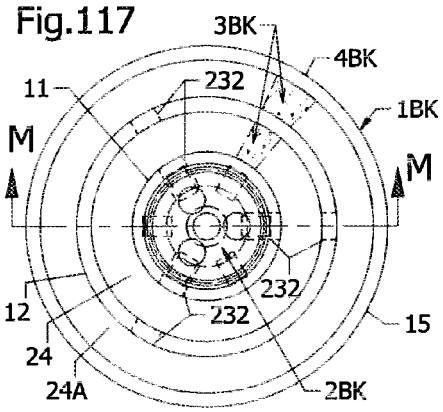
Fig.121
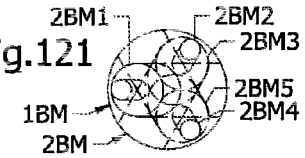
Fig.119
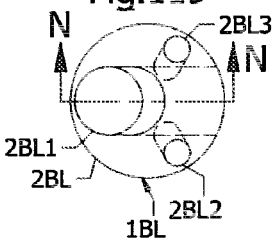
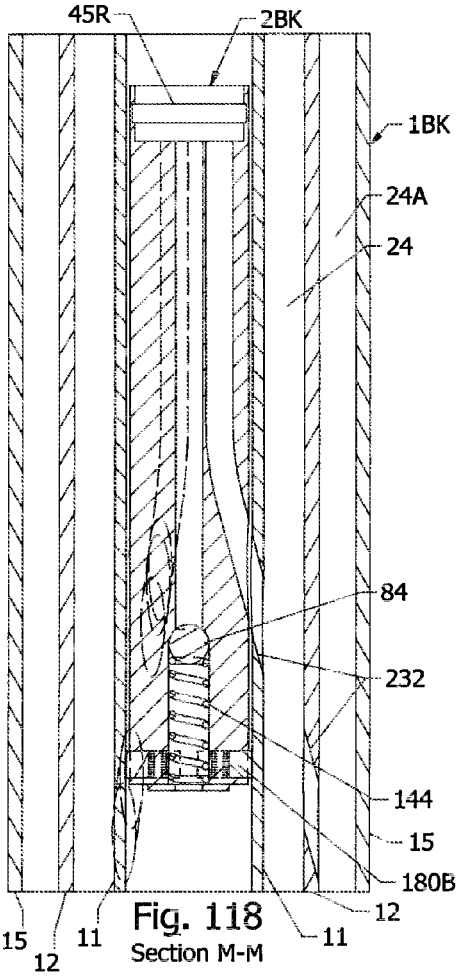
Fig. 118
Section M-M
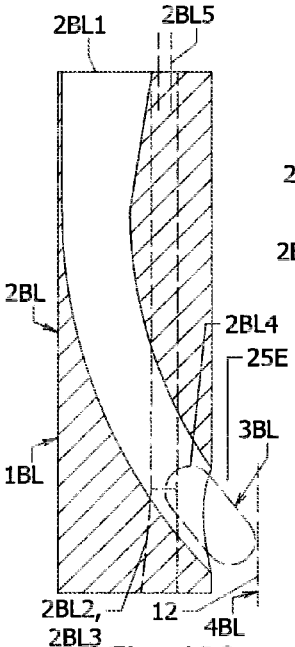
Fig. 120
Section N-N
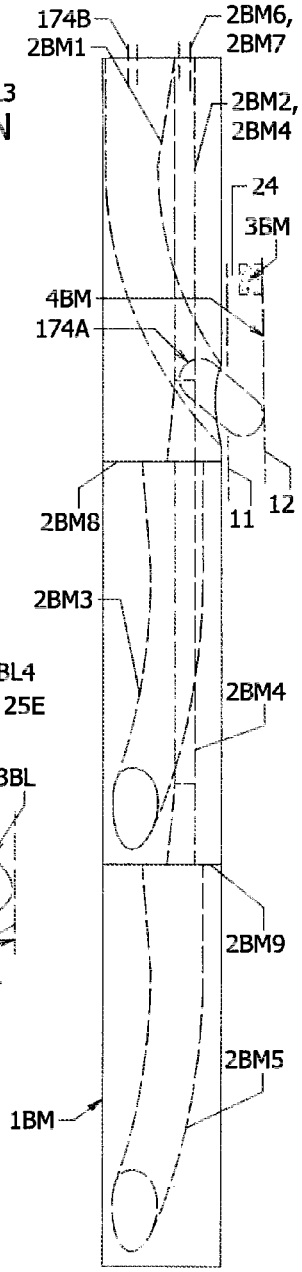
Fig.122

72U
31C
59
2BO5
2BO4
2BO
1BO
2BO2
2BO3
72L
2BO1
3BO
4BO

72U
P
Q
108
109
1BN
2BN
R
72L

Detail P
31C
2BN2
2BN1
2BN
2BQ

Detail Q
108
109
2BN

Detail R
2BN
2BQ
1BN
4BN
12
3BN
25E
11
72L
31C
2BP
1BP
187
25
31C
24
235
12
11U
234
233

31C
233
25
2BP5
2BP6
2BP4
1BP
239
236
24
2BP3
11U
2BP2
4BP
31C
3BP
25E
233
237
2BP1
2BP
238

Section S-S

Detail T

Section U-U

Section U-U

Section U-U

Section U-U

Section V-V

CABLE COMPATIBLE RIG-LESS OPERABLE ANNULI ENGAGABLE SYSTEM FOR USING AND ABANDONING A SUBTERRANEAN WELL

CROSS-REFERENCE TO RELATED APPLICATIONS

The present application claims priority to patent cooperation treaty (PCT) application having PCT Application Number PCT/US2012/000315, entitled "Cable Compatible Rig-less Operable Annuli Engagable System For Using And Abandoning A Subterranean Well," filed Jul. 5, 2012, which claims priority to the United Kingdom patent application having Patent Application Number GB 1111482.4, entitled "Cable Compatible Rig-Less Operable Annuli Engagable System For Using and Abandoning a Subterranean Well" filed 5 Jul. 2011 and published under GB2484166A on the 4th of April 2012, the entirety of which is incorporated by reference.

FIELD

The present invention relates, generally, to cable conveyable and rig-less operable systems and methods that can be usable to install well barrier element isolations for delaying or performing subterranean well abandonment operations, on at least a portion of a substantially water or substantially hydrocarbon well.

BACKGROUND

Constructing a subterranean well for producing substantially water, e.g. from solution mined or water cut hydrocarbon wells, or for producing substantially hydrocarbons, requires capital investment with an expectation of a return on capital repaid over the life of the well, followed by the permanent abandonment of all or part of the well to delay further cost, once storage or producing zones have reached the end of their economic life or the well's structural integrity becomes an issue. For the hydrocarbon extraction industry, the producing life of a well is, typically, designed for 5 to 20 years of production. However, conventional practice is primarily to extend well life as long as possible, even after exceeding its original design life, and, despite any marginal economic losses incurred, to push the cost of final abandonment into the future. For the underground storage industry, wells may be designed for a 50 year life span, but over time storage wells may also encounter integrity issues that require intervention, maintenance or abandonment.

Embodiments of the present invention are usable to delay abandonment by placing well barrier element members to intervene in or maintain a well's structural integrity to allow additional marginal production or storage operations until final cessation of production or storage operations. Embodiments are further usable to permanently abandon all or part of produced subterranean or underground storage wells.

As the cost of placing acceptable abandonment barriers to permanently isolate subterranean pressurized liquids and gases comprises an investment without a return on capital, the financially minded are continually seeking to reduce the net present cost of abandonment by either delaying it through marginal production enhancement or by minimising expenses associated with abandoning the lower portion of a well, sometimes referred to as suspension until final abandonment of a well.

Embodiments of the present invention are usable with rig-less intervention operations to minimize the cost of marginal production enhancement and the abandonment of a portion of a well to suspend the well until a final abandonment campaign is used to further minimize costs, potentially using rig-less embodiments.

The present invention relates, generally, to rig-less systems and methods usable to install well barrier element isolations to delay or perform subterranean well abandonment operations on at least a portion of a substantially water or substantially hydrocarbon well. This allows and/or provides for the production or storage from a different portion of the well until the well has reached the end of its life and is ready for final rig-less abandonment, by using the installed conduits that are engaged to the wellhead, to place apparatuses or settable fluid mixtures at selected depths to isolate at least a portion of the well using rig-less operable annulus engagable members and methods of the present invention.

Various embodiments of the present invention may include the use of, or be usable with, other inventions of the present inventor, including the inventions disclosed in the United Kingdom Patent GB2471760B, entitled "Apparatus And Methods For Sealing Subterranean Borehole And Performing Other Cable Downhole Rotary Operations" published 1 Feb. 2012; U.S. patent application Ser. No. 12/803,775, entitled "Through Tubing Cable Rotary System" filed on Jul. 6, 2010 and published under US2011/0000668 A1 on Jan. 6, 2011; PCT Patent Application Serial Number GB2010/051108, entitled "Apparatus And Methods For Sealing Subterranean Borehole And Performing Other Cable Downhole Rotary Operations" filed Jul. 5, 2010 and published under WO2011/004183A2 on Jan. 31, 2011; and PCT Patent Application Serial Number PCT/US2011/000377, entitled "Manifold String For Selectively Controlling Flowing Fluid Streams Of Varying Velocities In Wells From A Single Main Bore" filed Mar. 1, 2011 and published under WO2011/119198 A1 on Sep. 29, 2011, all of which are incorporated herein in their entirety by reference.

The present invention significantly improves upon prior art with methods and apparatus embodiments for forming and using four (4) dimensional geologic time well barrier elements necessary for the practice of cap rock restoration, wherein the provision of a operable space for logging the cement bonding of a three (3) dimensional space prior to placing and supporting at least one cement equivalent barrier member within said operable space, using at least one annulus engagable member to access at least one annulus from an innermost passageway, by displacing at least one portion of a wall of at least one conduit surrounding the innermost passageway to provide said operable space, bridge across said operable space, and place said at least one cement equivalent well barrier member through said operable space to form at least one geologic time-frame space, which can be usable to fluidly isolate at least one portion of a subterranean well without removing installed conduits and associated debris from below one or more subterranean depths, to provide or enable cap rock restoration above a producible zone.

For example, Patent GB2471760B of the present inventor is usable to form a four (4) dimensional space when the elements of a geologic time frame space happen to be present, for example, when an immovable production packer does not block an annular passageway. The present invention provides significant improvements by providing the elements of a geologic time frame in instances where said elements may otherwise be unachievable without the use of a drilling rig. The present invention's methods and apparatuses are usable to, for example, place and/or jar cement equivalent sealing material about the annulus blockage, such as a production packer, to increase the probability of successfully forming a geologic fourth dimensional space at the specific depth defined by the cap rock, which previously contained a producible zone before it was penetrated by the well. Consequently, the spectrum of wells available for rig-less abandonment increases significantly by enabling or providing for the re-sealing of said cap rock at said specific depth according to conventional industry practices for sealing a well over the fourth dimension of geologic time.

Similarly, the present invention provides significant improvements upon prior art, for example WO2004/016901 A1 entitled "Well Abandonment Apparatus," which is silent to industry cap rock replacement practice and lower cost rig-less cable conveyable practices, and teaches the use of higher cost drillpipe and coiled tubing conveyance and circulation methods, using electrical and hydraulic umbilical lines for power and control. In contrast, the present invention can use the circulatable fluid column, within the plurality of passageways formed by in-place tubing and casing, to operate an annulus engagable member and form and/or use a four (4) dimensional operable space, which can be consistent with the practice of cap rock restoration at the geologic dictated depth necessary for providing or enabling said cap rock restoration over a geologic time frame.

The present invention provides a rig-less well annuli access and abandonment system of methods and members usable to solve the complex set of problems that have forced industry to use expensive, over-specified, drilling rigs and/or deployed pipe circulation to meet minimum published well suspension, sidetracking and abandonment best practice and standards. Conventional rig-less technology generally uses, for example (e.g.), perforating guns, abrasive cutters and severing explosives to crudely engage annuli or complex and relatively large and still expensive rig-less coiled tubing or pipe handling arrangements unsuitable for instances constrained by minimum space and infrastructure, such as normally unmanned minimum remote onshore wells and offshore facilities.

The present invention provides cable compatible embodiments, usable with slick line and braided coiled wire strings to provide selectively controllable access to all well annuli to: i) adequately clean the annuli to provide a wettable surface for proper bonding of cement and other suitable permanent well barrier elements, ii) provide logging access to confirm the presence of primary cement behind well casings, iii) provide stand-off between well conduits to ensure that conduits are embedded in cement and/or have cement inside and outside of the metal conduits to prevent corrosion, iv) remove potential leak paths such as control lines and cables from annuli, and vi) place well barrier elements across from strong impermeable formations to meet published industry best practices for permanent abandonment, where no comprehensive conventional rig-less abandonment system is available for minimum facilities with limited space and resources, e.g. power, and larger facilities where the cost of numerous complex system rig-ups and rig-downs over a plurality of wells is cost prohibitive.

The methods and systems of the present invention are usable in various combinations to provide, in whole, a rig-less well suspension, side-tracking and abandonment system to meet industry best practices described in various publications, including NORSOK D-010 revision 3, August 2004, which define the requirements of conventional well barrier elements used to form a plurality of pressure bearing envelops that resist subterranean pressurized liquids and gasses.

The methods and apparatus of the present invention differ from the conventional hydrocarbon and storage industry practices and apparatuses, which are designed for a significant life cycle, because the present embodiments are usable with a more economic means of placing a permanent well barrier element. For example, where a conventional tubing patch is designed to repair breached tubing for a significant period of production, various embodiments of the present invention are usable to provide temporary and/or partial fluid pressure circulating capabilities to place a permanent cement plug, because the extra expenditure to repair the breached tubing is unnecessary, given that the well is being abandoned. Furthermore, the present invention is usable to increase the number of wells, where lower cost rig-less slickline operations are usable to place permanent well barrier elements, like cement, as opposed to the conventional practice of using an extremely expensive and over specified drilling rig to perform work on an asset that has no further value.

The present invention can be usable with rigs or conventional rig-less arrangements, such as those described in U.S. Pat. No. 7,921,918B2, published the 12th of April 2011, incorporated herein in its entirety by reference to provide reference to a rig-less conduit handling system. However, the present invention can be further usable to minimize the required operational footprint and resources, because the systems and apparatus of the present invention may be used with, but do not require, pipe handling arrangements and are operable with tension of a coiled wireline or coiled tubing string and pumping arrangements, or optionally, with electric line, through the wellhead using the well's circulatable fluid column.

Various methods and fluid and apparatus member embodiments of the present invention's rig-less suspension, sidetracking and abandonment systems can be combinable with conventional rig-less operable methods and apparatuses when placing well barrier elements and forming branching passageways, from the innermost passageway, to be used for accessing annuli and producible zones of a well and/or forming new well barrier elements, which can be rig-lessly placeable with jointed conduits, coiled strings and/or a well's circulatable fluid column.

Pumpable members of the systems of the present invention represent significant improvement over the teachings of EP0933414A1, published 4 Aug. 1999, and GB2429725A, published 7 Mar. 2007 which describe swellable gravel packs; US 200310144374A1, published 31 Jul. 2003, and EP1614669A1, published 29 Jun. 2005, which describe organophillic clay and cement mixtures; all of which are included herein in their entirety by reference. Where conventional practice focuses on water production isolation, with swellable and reservoir isolation with clay and cement, the present invention provides methods for mixing gradated hard particles that can be combinable with swellable particles and clay based cement to form an annuli bridging matrix or pseudo packer within well annuli, forming well barriers and/or supporting placement of a permanent barrier, e.g., neat cement. The present invention further improves conventional or existing practices for rig-less abandonment by incorporating reagent mixing methods from the drilling industry, commonly referred to as gunk, usable to temporarily seal leaks downhole. The present invention's combination of gradated hard and swellable particles mixed with organophillic clay, oils and cement provide a means for isolating well annuli during rig-less operations and providing permanent barriers within selected portions of a well.

Other existing methods and systems, for example, EP0933414A1 and GB2429725A describe swellable particle packs used in water shut-off and gravel packs, while US 2003/0144374A1 and EP1614669A1 describe an organophillic clay cement mixture usable for sealing producible hydrocarbon formations, historically comparable to drilling practitioner's use of "gunk" for closing fractured formations during drilling operations. Conventional packing methods are silent as to the present embodiments comprising hard gradated particles mixed with gradated swellable particles and clay mixtures to form a fluid deployable hard pressure bearing matrix or pseudo packer within an annulus, as specified within the present invention. Thus, the present invention provides significant improvement and benefit to rig-less intervention and abandonment practitioners, with the use of rheological controllable fluid members comprising, for example, hard size specific particles mixed with size specific gradated, swellable, particle packing mixes, wherein the pore spaces are filled with a clay-based gunk or clay-based cement to form a pressure-bearing matrix. The pressure bearing capacity of rheological controllable fluids of the present invention are further increasable with hydraulic packing methods and members, usable with intermixable gelatinous gunk or cement pumpable gradated swellable particle mixes, to form stress and pressure bearing matrices with the swellable particles, and harder intermediate gradations of particle sizes mixed with the low gravity solids and particle sizes of a clay-based gunk or cement to seal the pores spaces between the packed particles and a wall of a well, e.g. a conduit, permeable conduit and/or strata wall, such that a pseudo packer may be formed in annuli of a well for well abandonment, suspension and side tracking purposes. This pseudo packer is compatible with the setting nature of cement or oil-based gunk to provide support for sealing materials, forming an indefinite pressure bearing bridging of, e.g., cement across the walls and circumference of well annuli during the rig-less abandonment and/or temporary suspension of subterranean wells. Additionally, the present invention represents a significant improvement over conventional clay cement mixes, with method embodiments for segregating deployment of reagents of chemically reactive fluid mixes to control mixing and chemical gelling, at the point where a well barrier element is needed, wherein further chemical reaction of swellable material to, e.g., hydrocarbons or water is also possible at said point.

Boring and expandable conduit placement of the present invention represents significant improvement over such teachings as those disclosed in U.S. Patent Application 2005/0252688, published Nov. 17, 2005, and U.S. Patent Application 2004/0069487A1, published 15 Apr. 2004, which describe micro bore drilling and logging; and WO 2009/152532A1, published 17 Dec. 2009, which describes drilling a hole in a conduit and placing a sealable material within an annulus. The present invention improves upon such conventional practice by providing a plurality of sizes and placement means through which well barrier elements and logging tools may be placed to confirm primary cementation behind casing to meet published minimum industry requirements, whereas similar conventional coiled wire string compatible methods or apparatuses are not available for the economic abandonment of a well.

Axial screw and/or tractor embodiments of the present invention provide more robust combinable pipe destruction and conveyance means for shredding and milling of well conduits, which do not require computer control as described in the teachings of U.S. Pat. No. 6,868,906B1, published 22 Mar. 2005. With regard to complex computer systems, Greenfield hydrocarbon production has significant value, and the associated economics of using computer controlled systems is significant during construction of a well; however, abandoned wells have no future value with well conduits of no further use after deconstruction of a well, generally termed as abandonment. Hence, the economics of abandonment are significantly different and require different tooling. The present invention provides significant improvements in the field of low cost rig-less intervention by providing a system of methods and apparatus to meet the lower cost needs of rig-less abandonment, which can be usable for suspension and side-tracking of marginal producible zones of a well that may not have warranted completion during initial well construction and/or do not warrant the use of a drilling rig or expensive computer operated systems, but are usable to provide marginal revenue to offset the cost of delaying final abandonment.

U.S. Patent Application 2005/0252688 describes methods for single micro-bores through strata immediately adjacent to cemented casings to place expandable sand screens for a producible formation. However, this reference is silent to, and is unsuitable for, simultaneously placing a plurality of bores and/or selectively accessing said bores with subsequent tools, such as conventional logging tools. Further, this conventional method does not teach the placing of integral passageways through annuli, as described by the present invention. While U.S. Patent Application 2004/0069487 A1 describes methods for providing strata measurements and fluid traces within a micro bore, it does not teach the provision of sufficient diameter, angular offset or selective bore hole re-entry. Further, the invention taught in WO2009/152532A1 is usable to make holes or cuts within an innermost conduit to access a single annulus and place a well barrier element settable material in the annulus; however, this reference does not teach, nor is it usable to, access a plurality of annuli and/or placement of measurement devices needed for cap rock restoration using well barrier element members, such as settable sealing materials. Also, WO2009/152532A1 does not teach the provision of a conduit for production or storage from a different part of the well to delay final abandonment with marginal production. Conversely, the present invention teaches a plurality of bores and expandable conduits that are not restricted to micro-boreholes and are usable for fluid communication, placement of conventional logging apparatuses and other devices, prior to placing cement according the published industry guidelines. Thus, the present invention provides significant improvements over conventional technology by allowing for more and larger bore holes and conduit sizes through the innermost bore of a well. This then allows well operators to selectively guide, for example, electric motors and higher torque coiled string fluid motors to selectively place larger boring bits and selectively access a plurality of larger bit-carried-expandable-conduits, usable with higher flow rates, to fluidly communicate through annuli, which are isolatable from the carried expandable conduit passageway to, e.g., access producible zones, place devices, well barrier elements and/or rheological controllable fluid members.

The low torque centrifugally deployed disposable coiled cable string compatible milling embodiments of the present invention represent significant improvement over the existing technology, such as those of U.S. Pat. No. 5,101,895A1, published 7 Apr. 1997, and WO2009/152532A1, published 17 Dec. 2009. The present invention provides a significant improvement for rig-less, low-cost milling with balanced ball joint mills deployable with centrifugal forces of rotation and arranges so as to reduce torque and be disposable downhole if the mill becomes stuck during use.

One of the primary objectives of rig-less abandonment of any portion of a well is its destruction at the lowest possible cost, wherein the present invention is comprised of low cost, simple and robust methods and members that can be more akin to using a sledge hammer than using the conventional computer controlled teachings of U.S. Pat. No. 6,868,906 B1, involving complex computer controlled tractor conveyance of drilling assemblies for well services and deployable on wireline or umbilicals, only. The operational benefits of the present invention are numerous and significant, needing only fluid circulation, an electricity supply and/or line tension for operation, versus complex operations requiring computer control, wherein the simple operations of the present invention are generally easier to support and less expensive. Additionally, if an assembly becomes stuck downhole, the value of retrieving the complex closed loop system operated apparatuses and tractors are significant, given the construction cost of complex apparatuses, thus limiting their utility for risk of loss within operations like abandonment where the well is a liability without future value. Methods and members of the present invention are rig-lessly operable, with cable tension and the pressures of a circulated fluid column to drive a fluid motor or an electrical conductor to operate an electrical motor and/or disposable tractor, using the low cost disposable motor's reactive torque to drive the pushing or pulling of various disposable rotating or non-rotating apparatuses to penetrate walls within a well that is incapable of providing future return on investment. The hazards of destructing said well, e.g. the violent jarring, milling, shredding and tractor cutting wheel destruction of steel conduits, by crushing, cutting and rotating equipment suspended from a non-rotatable cable, represents a significant risk of becoming stuck downhole and/or breaking the cable. The present invention provides significant benefit over more complex systems, e.g. U.S. Pat. No. 6,868,906B1, U.S. Patent Application 2005/0252688, U.S. Patent Application 2004/0069487A1 and WO2009/152532A1, because it requires a less complex system designed for operating under the high tension load of, e.g., a capstan cable pulling unit, wherein members may be disposed of downhole, if necessary, to avoid the more costly operation of more complex systems, with an intrinsic re-usable value justifying said complex system's retrieval.

Additionally, conventional devices, such as those described in WO 2009/152532 A1, are generally unsuited for use with cable operations because erratic rotation of its unbalanced milling arm will occur when the conduits being milled shift, thus placing unacceptable tensional loads on a high-torque downhole motor, potentially causing damage or sticking and slipping issues for its milling assembly, which are generally unsuitable for cable operations where low torque and balanced rotation are required to prevent fouling of the cable. While U.S. Pat. No. 5,101,895A1 provides a balanced cutting and/or milling blade arrangement, the milling blades are driven by supplied torque and constrained within a rigid deployment arrangement that does not automatically adjust to balance rotation, limit torque and prevent vibration, that is unacceptable for a cable deployed milling tool. Conversely, rotary cable tool milling embodiments of the present invention comprise balanced deployment mills that intrinsically adjust to conduit eccentricity with ball joints and rotating cutting structures, which are suitable for lower torque motors on coiled string applications to prevent erratic rotation with the centrifugal forces of rotation adjusting deployment of the mills if conduits shift.

The present invention provides significant improvements over the teachings of U.S. Pat. No. 5,957,195, published 28 Sep. 1999 describing an expandable tubing patch usable to repair a leak in production tubing. The present invention provides a swellable, expandable mesh-membrane fluid conduit that can be usable to place cement and/or rheological controllable fluid members in any annulus and/or to choke fluid communication between the innermost passageway and one or more of the annuli. Thus, the present invention provides a significant improvement over conventional expanded tubing patches in the field of rig-less abandonment, due to the high probability that the condition of the tubing that caused the first breach is the result of age, corrosion and/or wear that will lead to further breaches or tubing collapse, which cannot be repaired with a single patch. In contrast, the present invention can include the ability for burst or collapse prevention as well as an ability to repair the tubing, due to the permeability of the mesh, which can provide pressure relief to prevent burst or collapse of the tubing, while placing and allowing a cement to harden, and whereby the mesh can allow removal of free water associated with cement setting, unlike a solid conventional tubing patch. Furthermore, an expanded mesh conduit can be placed through annuli of a well, and is usable to urge heavier viscous fluids, e.g. cement, through or about the mesh conduit, wherein the pore spaces of the mesh can provide a natural pressure relief system, which may allow limited leakage to prevent burst or collapse of a fluid conduit when fluids of differing densities exist inside and outside the conduit, unlike conventional expandable solid tubing technology. Additionally, the present invention represents a significant improvement over conventional expandable sand screens that are designed for preventing sand production, by introducing swellable sleeves or gradated packable and swellable particles to an expandable mesh screen conduit, which provide the benefits of pressure relief to prevent conduit collapse while urging a majority of fluids communicated through the conduit to a selected location.

Various method and apparatus embodiments of the present invention's system of members are usable to form an enlarged passageway, including the milling and shredding of well conduits and equipment and/or compression or compaction of installed well conduits and equipment to, e.g., further form or enlarge passageways for placement of a permanent well barrier element. Other various embodiments comprise small drilling and casing assemblies, usable to place small diameter boreholes and/or expandable casings, expandable seals or swellable materials within bores and annuli of a well, to form pressure bearing passageways usable to place, e.g., logging equipment to determine any necessary remedial action within a bore or annuli of a well. The present invention is therefore usable for marginal production enhancement or underground storage well integrity repairs to provide further revenue and to reduce overall net present cost of well abandonment by delaying it, wherein the present invention is also usable for final abandonment of the subterranean portions of a well.

Well abandonment represents actions taken to ensure the permanent isolation of subterranean pressurized fluids from surface and/or other lower pressured exposed permeable zones, e.g. water tables, for various portions of a well where re-entry is not required, and wherein the portions, being selectively used and/or abandoned, require permanent fluid isolation, at depths specified by pressures within the strata, and the pressure bearing ability of the overlying strata to isolate lower strata fluid pressures from the surface or other upper permeable zones. Subterranean pressurized permeable zones comprising strata formations accessed by a well having a possibility of fluid movement when a pressure differential exists, generally, must be isolated to prevent pollution of other subterranean horizons, such as water tables, or surface and ocean environments.

Various embodiments of the present invention are usable within a pressure controlled working envelope, using coiled strings, lubricators, grease heads or other conventional pressure control equipment, engaged to the upper end of a wellhead and valve tree to intervene within the passageways and annuli of a subterranean well extending downward from the wellhead to permanently isolate subterranean pressurized fluids accessed by the passageways without the risk and cost of placing dense kill weight fluids in the well and breaking through surface pressure barriers, thus exposing personnel and the environment to a higher potential for uncontrolled fluid flow if the dense fluid column killing subterranean pressures is lost.

Performing well intervention and abandonment operations within a pressure contained environment is required for rig-less operations in a subsea environment where risers and lubricators must be engaged to the upper end of a subsea valve tree to remove plugs, for accessing the innermost well bore. However, access to annuli within a subsea well is limited, with most wells opening the innermost annulus to the production stream during initial thermal expansion after which subsea annuli are closed. Many subsea configurations also provide fluid access to the innermost annulus through a manifold placed on the subsea valve tree, which may also be engaged with the supporting conduit pipelines, such as a methanol line. The present invention is usable from a boat and lubricator arrangements, within a pressure controlled environment, e.g. a subsea lubricator and BOP, to rig-lessly access and abandon a well without a he need for a riser from mudline to or above sea-level.

Permanent abandonment, generally, is considered to be the placement of a series of permanent barriers, often referred to as plugging and abandoning, in all or part of a well with the intention of never using or re-entering the abandoned portion. Permanent well barriers are, generally, considered well barrier envelopes comprising a series of well barrier elements that individually or in combination create an encompassing seal, which has the permanent or eternal characteristic of isolating deeper subterranean pressures from polluting shallower formations, e.g. ground water permeable zones, and/or above ground or ocean environments. Various publications, including *Oil and Gas UK Issue 9, January* 2009 *Guidelines for Suspension and Abandonment of Wells*, define conventional best practice for permanent abandonment of a well and the associated acceptable well barrier elements used to form a plurality of pressure bearing envelops, resisting subterranean pressurized liquids and gasses over geologic time.

Presently, there are no existing comprehensive systems for abandoning wells, other than the use of an over-specified and expensive drilling rig. The present invention provides an important and significant solution by specifying methods and apparatuses to rig-lessly suspend, sidetrack and abandon onshore and offshore, surface and subsea, substantially hydrocarbon and substantially water wells, which also complies with the published conventional best practices for placement of industry acceptable permanent abandonment well barrier elements.

The cost of permanent abandonment can be expressed as a function of the time span required and the quantity and type of equipment needed to place permanent barriers to contain subterranean fluid pressures for an indefinite period of time. The cost of abandonment is generally higher when using a drilling specification rig, capable of constructing a well, with large capacity hoisting, pumping and conduit handling systems requiring a significant amount of supporting equipment and personnel to operate. Conversely, the cost of abandonment is generally significantly lower when operating what are generally termed as "rig-less" systems, with significantly less support equipment and personnel operating lower capacity hoisting, pumping and conduit handling systems.

Embodiments of the present invention are generally usable to meet published industry minimum requirements and best practices for placement of permanent barriers using rig-less intervention and abandonment methods.

Drilling specification rigs are, generally, used to deconstruct a well by cutting and hoisting large and/or long strings of conduits from a well and potentially mill casings to place unobstructed cement plugs within the bores from which the conduits were removed. Conventional hazards exist, particularly when equipment within a well must be removed to place acceptable eternal barriers, wherein the equipment may be coated with low specific activity (LSA) scale or normally occurring radioactive material (NORM) deposits, which accumulated over the well's productive life. The rig-less abandonment embodiments of the present invention are usable to protect the environment and personnel from these hazards, which, if achievable in existing practices, would add additional costs and/or reduce the efficiency of the abandonment practice. The rig-less abandonment embodiments of the present invention provide acceptable methods and systems usable to leave the contaminated well equipment within the strata.

Embodiments of the present invention are usable with installed well apparatuses to avoid the need for completion equipment removal and exposure of personnel and the environment to various hazardous materials, which may have accumulated on the equipment over time.

In instances where insufficient cement exists behind casing and production equipment has been removed, a drilling rig may be conventionally required to mill the casing, so as to place a cement plug across the unobstructed strata bore. The resources and associated costs required for casing milling operations may often be equivalent to the original conventional cost of constructing the well.

Various embodiments of the present invention are usable to access annuli so as to measure the presence of cement behind casing, or the lack thereof, while other various embodiments are usable to shred production conduits and mill casing to provide an unobstructed space for placement of cement across a bore.

Operating a drilling rig requires a significant amount of space surrounding the wellhead of the well being constructed or deconstructed for the placement and operation of large capacity hoisting, pumping and conduit handling systems, regardless of whether the work occurs onshore or offshore. Drilling rigs are, generally, the primary controllable expensive driving return on capital and offshore drilling specification rigs are, generally, significantly more expensive than onshore drilling rigs, because they comprise living habitats capable of supporting a significant number of people, often exceeding a hundred persons, within a potentially hazardous environment. While the requirements for coiled tubing well operations are significantly less than those for a drilling rig, they are considerably greater than those of a wireline operation comprising electric line or slickline intervention.

The present invention is usable to provide smaller rig-less operational footprints, similar to electric line and slickline operations, usable, e.g. on small normally unmanned platforms, with methods and apparatus requiring a minimum of resources and associated space to perform necessary suspension, side-tracking and, ultimately, abandonment operations.

Large hoisting capacity rigs usable for the removal of downhole equipment are not generally required, provided that annuli can be accessed and permanent isolations can be placed within annuli. Generally, rig-less abandonment operations use through tubing or through conduit operations to minimise equipment and personnel requirements, using the installed completion and casing strings to circulate cement, and, ultimately, leave equipment downhole.

Providing annulus control and permanent isolation barriers with rig-less operations is challenging with no universally accepted conventional rig-less means of both verifying and placing permanent barriers within annuli, as required by the published industry best practices, because of the many potential leak paths that exist when completion equipment is left within a well, wherein conventional logging can only occur after the completion equipment has been removed. For example, leaving cables and control lines downhole within a cement barrier can represent a significant leak path because capillary or frictional forces may prevent viscous cement from entering the small diameter of a control line or sheath of a cable. Additionally, while records of originally installed primary cementation may exist, over time the primary cementation bond may have failed from the pressures and thermal cycling of the casings during production, and a leak path may exist between casings and the strata rendering properly placed conventional rig-less abandonments ineffective.

Additionally, when well completion tubulars or conduits and completion equipment are left downhole during through conventional tubing rig-less well abandonment, leak paths may form around the installed apparatuses if they are not offset from other equipment so as to be embedded in, e.g., cement, including verification of the position and placement of the permanent barriers inside bores and annuli of a well to determine if further remedial action is required.

Various embodiments of the present invention are usable to compress severed well equipment within a surrounding bore to remove obstructions and potential leak paths while providing space for logging behind casing, to determine whether an acceptable cement bond exists.

The main characteristics that a permanent barrier must have to prevent flow of pressured fluids through the barrier are: i) long term isolation integrity that ii) bonds to completion equipment and iii) does not deteriorate over time or iv) shrink, thus allowing flow around the barrier, which must be of a v) ductile or non-brittle nature to accommodate mechanical loads and changes in the pressure and temperature regime, wherein the ductile or non-brittle material must also vi) resist ingress of downhole fluids and/or gases, such as hydrocarbon gas, CO2 and H2S into or through its mass. While cement is currently the primary oil and gas industry material used for permanent well barriers, other suitable materials may also be usable, provided they meet these necessary conventional requirements.

Embodiments of the present invention are usable with cement and other suitable rig-lessly deployable permanent abandonment materials, with various embodiments usable to clean bores and annuli of hazardous or benign debris that could potentially interfere with the placement of permanent impermeable barriers, e.g. cement, to further provide wettable surfaces for cement bonding, wherein portions of the well may be opened to dispose of hazardous material, such as LSA scale, during abandonment.

The most prevalent permanent barrier for well abandonment is a cement column of a depth sufficient to ensure good quality and bonding of the cement to completion equipment. The surface of the completion equipment must be both wettable and accessible during cement slurry placement. If equipment, such as completion equipment or casing, is left within the strata bore, the cement must also be placed on both sides, embedding the equipment or casing in bonded cement, since over time the metal equipment may corrode if poor cement bonding or the lack of cement bonding exposes corrodible equipment to subterranean fluids, subsequently providing a leak path. Cemented casing is not considered a permanent barrier to lateral flow, into or out of the wellbore, unless the inner and outer diameters of the casing and contained conduits are sealed with good quality cement, which is bonded to the casing. It is noted that fluids may migrate through poor quality cement or axially along the casing's inner or outer surface through micro annuli if poor bonding exists, to eventually corrode the casing when an incomplete localised cement sheath is present in the internal bore or annulus.

Various other embodiments of the present invention are usable to provide both space and offset of eccentric conduits to allow cleaning of downhole completion equipment and casings, both fluidly and mechanically, to provide cleaner spaces and wettable surfaces and to provide sufficient good quality cement bonding, thus preventing axial or lateral pressurized fluid flow.

Because the lifespan of an installed permanent well barrier can be measured in geologic time, i.e. over millions of years, and as nature abhors a vacuum, well barriers must also be designed to resist the re-pressurization of a depleted reservoir as it seeks to return to its original state over time. In many subsurface reservoirs, this requires placing barriers at specific depths to replace the original cap rock holding the pressurized subterranean fluids, before it was penetrated by a well. The lack of foresight in the original well design is often a primary reason for using drilling specification rigs to abandon wells, because completion equipment, e.g. production packers, are incorrectly placed for conventional rig-less abandonment and/or marginal production enhancement when such packers either fail to isolate or prevent access to isolated marginal producible formations.

Other embodiments of the present invention are usable to access all surrounding annuli, replacing and/or bypassing production packer isolation of an annulus, while still other embodiments are usable to access isolated marginal producible formations or access injectable strata formations for disposal of hazardous materials, during suspension and/or side-tracking of a well and placement of annuli isolations and to access conduits to delay or perform final abandonment of a well, to potentially reduce the net present cost of abandonment.

Preventing exposure of the environment and personnel to hazardous materials, e.g., hydrocarbons from marginal producible formations, brines, H2S occurring naturally or as a result of water injection, and/or LSA scale or NORM, with a reasonable probability of success both during well operations and for the indefinite period thereafter, requires redundancy, i.e. a plurality of tested barriers that can be verified.

The integrity of a well is generally measured both during operations and abandonment, by the existence of at least two verified barriers.

Various embodiments of the present invention are usable to provide supported annuli cement placement for a plurality of annuli barriers that are verifiable with the conventional methods of logging and tagging, but which are unavailable to conventional rig-less applications due to their inability to selectively access annuli or conduct pressure testing through the annuli access passageways, wherein the present invention is usable to access all annuli to abandon all or part of a subterranean well.

Well operators face a series of challenges at each stage of a well's lifecycle as they seek to balance the need to maximise economic recovery and reduce the net present value of an abandonment liability to meet their obligations for safe and environmentally sensitive operations and abandonment. When wells lose structural integrity, which may be defined as an apparent present or probable future loss of pressure or fluid bearing capacity and/or general inoperability, all or portions of a well may be shut-in for maintenance or suspension until final abandonment or may require immediate plugging and abandonment, potentially leaving reserves within the strata that cannot justify the cost of intervention or a new well.

Some of the more frequently reported structural integrity problems are a lack of centralization leading to conduit erosion from thermal cycled movement, corrosion within the well conduit system; e.g., from biological organisms or H2S forming leaks through or destroying conduits or equipment and/or valve failures associated with subsurface safety valves, gas lift valves, annuli valves and other such equipment. Other common issues include unexplained annulus pressure, connector failures, scale, wear of casings from drilling operations, wellhead growth or shrinkage and Xmas or valve tree malfunctions or leaks at surface or subsea. Such issues comprise areas where operators are able to, or chose to, test and there are others (such as the internals of a conductor) which they cannot, or do not test, and which may represent a serious risk to economic viability and the environment. Problems within various portions of a well, in particular the annuli, cannot be conventionally accessed without significant intervention or breaking of well barriers, e.g., with a drilling rig, and thus, are a significant cost and safety risk to operators that are unsuitable for conventional rig-less operations mitigation.

A primary advantage of using drilling specification rigs for well intervention is the removal of conduits and access to annuli during well intervention and abandonment, wherein the ability to access and determine the condition of the annuli casing and primary cement behind the production conduit or tubing is used to make key decisions regarding the future production and/or abandonment. If well casings are corroded or lack an outer cement sheath, remedial action, e.g., casing milling, may be undertaken to provide a permanent barrier. Conversely, the problem may be exacerbated by conventional rig-less well abandonment when blind decisions are made without cement logging access to annuli and attempts to place cement fail, thereby placing another barrier over potentially serious and worsening well integrity issues, which can represent a significant future challenge, both technically and economically, even for a drilling rig.

Various embodiments of the present invention are usable to gather information that conventional rig-less operations cannot, by providing access and/or space for both measurement devices and sealing materials. Once such information is gathered, still other embodiments are usable to rig-lessly place barriers, and/or mill or shred conduits and casings to expose and bridge across hard impermeable strata or cap rock formations for placement of permanent barriers without imbedded equipment to ensure structural integrity.

In general, age is believed to be the primary cause of structural well integrity problems. The combination of erosion, corrosion and general fatigue failures associated with prolonged field life, particularly within wells exceeding their design lives, together with the poor design, installation and integrity assurance and maintenance standards, associated with the aging well stock, is generally responsible for increased frequency of problems over time. These problems can be further exacerbated by, e.g., increasing levels of water cut, production stimulation, and gas lift later in field life.

However, the prevalent conventional consensus is that although age is undoubtedly a significant issue, if it is managed correctly, it should not be a cause of structural integrity problems that may cause premature cessation of production. Additionally, fully depleting producing zones through further production prior to abandonment provides an environment of subterranean pressure depletion that is better suited for placing permanent barriers, by lowering the propensity of lighter fluids to enter, e.g., cement during placement.

A need exists for delaying abandonment with low cost rig-less operations for placement of well barrier elements to increase the return on invested capital, for both substantially hydrocarbon and substantially water wells, through rig-less side-tracking, for marginal production enhancement, suspending and/or abandoning portions of a well, to re-establish or prolong well structural integrity for aging production and storage well assets; and thus, prevent pollution of subterranean horizons, such as water tables or surface and ocean environments.

A need exists for small operating foot-print rig-less well barrier element placement operations that can be usable to control cost and/or perform operations in a limited space, e.g. electric line or slickline operations, on normally unmanned platforms, from boats over subsea wells or in environmentally sensitive area, e.g. permafrost areas, where a hostile environment and environmental impact are concerns. A related need also exists for working within a closed pressure controlled envelope to prevent exposing both operating personnel and the environment to the risk of losing control of subterranean pressures, particularly if a well intervention kill weight fluid column is lost to, e.g., subterranean fractures.

A need exists for avoiding the high cost of drilling rigs with a rig-less system capable of suspending, side-tracking and/or abandoning onshore and offshore, surface and subsea, substantially hydrocarbon and substantially water wells using and/or complying with the published conventional best practices for placement of industry acceptable permanent abandonment well barrier elements.

A need exists for preventing risks and removing the cost of protecting personnel and the environment from well equipment contaminated with radioactive materials and scale by rig-lessly placing abandonment barriers and leaving equipment downhole. A further need exists to rig-lessly side-track or fracture portions of a well to dispose of hazardous materials resulting from circulation of the wells fluid column during suspension, sidetracking and abandonment operations.

A need exists for rig-lessly accessing annuli to measure whether acceptable sealing cementation exists behind casing and to rig-lessly mill the casing and place cement if acceptable cementation does not exist. A further need exists to verify the placement of well barrier elements during rig-less operation to ensure the successful settable material bonding and sealing of a well's passageways has occurred or whether further remedial work is required.

A need exists for rig-lessly accessing annuli presently inaccessible with minimal foot-print conventional slickline rig-less operations, including bypassing annulus blockages, created, e.g., by production packers, during placement of permanent well barrier elements within selected portions of a well across from cap rock and other impermeable formations needed to isolate subterranean pressures over geologic time.

A need exists for a plurality of permanent well barriers that are verifiable through selectively accessed annuli passageways with rig-less operations usable with conventional logging tools to maintain the structural integrity of a well prior to final abandonment, which also provide access for placing permanent barriers to ensure structural integrity of the strata bore hole thereafter.

A need exists for marginal production enhancement usable to offset operating costs until final abandonment occurs, including rig-lessly providing well integrity while waiting until an abandonment campaign across a plurality of wells can be used to further reduce costs.

A need exists to reduce the abandonment liability for operators while meeting their obligations of structural well integrity for safe and environmentally sensitive well operations, suspension and abandonment in an economic manner that is consistent with providing more capital for exploration of new reserves to meet our world's growing demand for hydrocarbons by minimising the cost of operations, suspension and abandonment with lower cost rig-less suspension, side-tracking and abandonment technologies.

Finally, verifiable rig-less well abandonments are needed to facilitate a market where the reduction of well abandonment liability allows larger operating overhead companies to sell marginal well assets to smaller lower overhead operating companies, i.e. by lowering the risk of a residual abandonment liability, to prevent marginal recoverable reserves from being left within the strata because higher operating overhead requirements made such recoverable reserves uneconomic.

Various aspects of the present invention address these needs.

SUMMARY

The present invention relates, generally, to cable conveyable and rig-less operable systems and methods that can be usable to install well barrier element isolations for delaying or performing subterranean well abandonment operations, on at least a portion of a substantially water or substantially hydrocarbon well.

The embodiments of the present invention include rig-less operable annulus engagable members and systems, comprising fluids and apparatuses, to selectively form new and/or to block existing well passageways for placement of logging measurement devices and well barrier elements to, in use, access at least a portion of a subterranean well's producible zones and annuli, prior to abandoning all of the well's plurality of passageways, without using a drilling rig. Rig-less method and system embodiments eliminate the need to remove installed conduits, thus allowing installed well equipment, and any associated scale or naturally occurring radioactive material, to be left in place while also meeting published industry best practices for confirming primary well barrier element integrity through logging with centralized concentric conduits and removal of potential leak paths for placement of cements, polymers, size graded particles, or any other suitable material that can be usable within the supported annular spaces to form permanent well barrier elements and indefinite abandoned well integrity.

The present invention provides systems for annular access, that can be usable with rheological controllable fluid members, logging tool members, expandable members, swellable members, placeable conduit members, motorized members, boring members, tractor members, conduit shredding members, milling members and/or rig-less members, which can include cable conveyable and rig-less string operable annulus engagable members that are usable to form or place well barrier elements for isolating at least a portion of a well. The present invention is usable to access annuli and producible zones of a well to perform or delay final well abandonment by providing further marginal well production enhancement and/or extending the longevity by rig-lessly placing additional underground well barrier elements. Furthermore, the present invention is usable for final rig-less well abandonment on wells where annuli are conventionally inaccessible, thus saving the cost of using a drilling specification rig.

The present invention provides a lower cost rig-less means of accessing annuli and selectively placing pressure bearing conduits and well barrier elements at required subterranean depths between annuli when intervening in, maintaining, and/or abandoning portions of a well to isolate portions affected by erosion and corrosion, which, in turn, can extend the well life to fully deplete a reservoir and to further reduce the risk associated with well barrier element placement and the pollution liability from an improperly abandoned well.

The level of maintenance, intervention and workover operations necessary for well maintenance is restricted by the substantial conventional costs involved. The limited production levels of aging assets often cannot justify the conventional practice of using higher cost drilling rigs and conventional rig-less technology is generally incapable of accessing various passageways or all annuli within the well.

Therefore, well operators generally place an emphasis on removing troublesome assets from their portfolio and seek to prevent future problems using improved designs, rather than attempting to remedy a poorly designed well, which in turn precipitates a greater focus on asset disposal, well design, installation and/or integrity assurance. Passing the problem on to others with the sale of a well does not, however, solve the issue of abandoning existing and aging wells from a liability viewpoint.

When intervention is required, risk adverse major oil and gas companies generally prefer asset disposal and replacement rather than remediation, favouring sale of aging well assets to smaller companies with lower overheads and higher risk tolerances. Smaller companies, requiring a lower profit margin to cover marginal cost, are generally eager to acquire such marginal assets, but may in the future be unable to afford well abandonment, thus putting the liability back to the original owner and preventing sale or creating a false economy for the seller. Low cost reliable rig-less placements of well barrier elements to delay or perform abandonment is critical to major and small companies, if aging assets are to be bought and sold and/or to avoid such false economies. Thus, the rig-less methods and members of the present invention, usable to place and verify well barrier elements for reliable abandonment, are important to all companies operating, selling and/or buying aging wells.

Therefore, the structural integrity of producing and abandoning wells is critical because the liability of well abandonment cannot be passed on if a well ultimately leaks pollutants to surface, water tables or ocean environments, because most governments hold all previous owners of a well liable for its abandonment and environmental impacts associated with subsequent pollution. Hence the sale of a well liability does not necessarily end the risk when the asset is sold or abandoned unless the final abandonment provides permanent structural integrity.

Embodiments of the present invention are usable with rig-less well intervention and maintenance to extend the life of a well by placing well barrier elements to isolate or abandon a portion of a well then operating another, until no further economic production exists or well integrity prevents further extraction or storage operations, after which the well may be completely and permanently abandoned for an indefinite time using the present invention capability to rig-lessly selectively access annuli for both placement and verification of well barriers.

The preferred embodiments of the present invention provide methods (1A-1BU) and systems comprising rig-less operable members (2A-2BU and 3A-3BU), which further comprise apparatus (2A-2BU) for accessing and placing well barrier elements (3A-3BU) to provide (220) or enable (211-219) cap rock restoration of at least a portion (4A-4BU) of a producible zone of a subterranean well.

Embodiments of the present invention are usable for placing and supporting at least one cement equivalent well barrier member (3A-3BU, 20, 216) within an operable usable space, formed by at least one cable operable and rig-less string operable, annulus engagable member (2A-2BU), comprising components that can be cable and rig-less string conveyable through an innermost passageway (25, 25E, 25AE), which can be surrounded by at least one annulus of a plurality of annuli formed by installed conduits (11, 12, 14, 15, 15A, 19), extending downward from a wellhead (7) within subterranean strata (17) for forming a plurality of passageways (24, 24A, 24B, 24C, 25, 25E, 25AE) in fluid communication with said producible zones through cap rock.

Embodiments of the present invention are operable using energy conductible through the movable fluids of a well's circulatable fluid column (31C) or a deployment string's electrical conductors and/or the deployment string's tension to operate at least one annulus engagable member for accessing at least one annulus from the innermost passageway, to displace at least one portion of a wall of at least one conduit about said innermost passageway, to provide an operable space, bridge across said operable space, and place said at least one cement equivalent well barrier member through said operable space, adjacent to said cap rock, for forming at least one geologic time-frame space that can be usable to fluidly isolate said at least one portion of said subterranean well, without removing said installed conduits and associated debris from below one or more subterranean depths (218) of associated capping rock to provide or enable said cap rock restoration above said producible zone.

Various embodiments are usable to rig-lessly abandon and/or suspend a portion of the well, then side-track to one or more new producible zones.

Various other embodiments are usable to provide a permanent fluid isolation and cap rock restoration by using an operable space to measure or provide (214) cement-like (216) bonding (213) across a sufficient axial length (219) of conduits, which can be embedded in (215), or filled within and embedded in (217), cementation, with stand-off (211) between conduits, and support (212) of said cementation at said subterranean depth (218), adjacent to impermeable strata capping rock, prior to performing said placing of said at least one cement equivalent well barrier member through said operable geologic time-frame space for enabling said cap rock restoration above said producible zone.

Still other embodiments can be usable to provide an abrasive, explosive, or cutting component for accessing of at least one annulus from the innermost passageway, or displacing of at least one portion of the wall of a conduit to provide an operable space.

Various embodiments can be usable to provide a motorized member (2B1, 2AN, 2AM2, 2BN, 2BO, 2BP) comprising at least one downhole motor that is suspendable from a cable and operable with the energy from said rig-less string or said circulatable fluid column to drive at least one rotatable cutting component or a mechanical linkage component.

Various related embodiments can provide an axially tractor operable member (2AW3, 2BN, 2BP3-2BP4, 2BQ) comprising said mechanical linkage or at least one cutting component that can be engagable to the wall of the conduit to axially move through the innermost passageway for displacing another well barrier member or said wall.

Various other related embodiments may provide a conduit shredding member (2E2, 2AW2, 2BP2, 2BR), which can comprise one or more peripheral cutting edge components. The one or more peripheral cutting edge components can comprise wheels, blades, or combinations thereof, and the conduit shredding member can be deployable axially and radially outward from the innermost passageway, with a solid or kelly pass-through cam to shred and displace said wall.

Still other related embodiments can provide an annulus milling member (2E6, 2AV3. 2AW1, 2AY1, 2BP1, 2BT1-2BT3) comprising one or more rotatable peripheral cutting edge components, wherein the one or more rotatable peripheral cutting edge components can comprise wheels, blades, or combinations thereof, usable for axially, rotatably, and circumferentially penetrating and cutting the wall of the conduit.

Various embodiments can also provide a guiding member (2C1, 2D3, 2E4, 2N6, 2Y1, 2Y2, 2Z1, 2AB3-2AB4, 2AC, 2AM2, 2AO1, 2AP, 2AQ1, 2AQ2, 2AT1, 2BI2-2BI3, 2BJ, 2BI6, 2BK, 2BL, 2BM) comprising a selectively orientable guiding whipstock (2Y2, 2AB1, 2AQ1, 2BI6, 2BK, 2BL, 2BM, 47), a conduit (2D2, 2AE3, 2AF, 2AK, 2AL, 2AO3, 2AS2, 2AT3, 2AV2, 2AV5, 2BI3, 2AB3, 2AC1, 2BI5), an annulus bridge (2X3, 2AH, 2AJ1-2AJ3, 2AU1, 2AY2, 2AZ, 2BB, 2BC, 2BD, 2BM2), or combinations thereof, that can be engagable and orientable within said innermost passageway, to urge a passage of another well barrier member or said movable fluids through said wall using an alignable bore selector between said innermost passageway and at least one penetration in said wall.

Other related embodiments may provide at least one portion of a selectively orientable guiding whipstock or a guiding conduit that can be rotatably orientable and selectable with said bore selector, between a plurality of penetrations in the wall of the conduit, from within said innermost passageway.

Various other related embodiments may provide a fluid communication conduit component that can be placeable within said operable space, through said innermost passageway or through said guiding member, with said movable fluid pressure against a wall of said fluid communication conduit component.

Still other related embodiments may involve the wall of the guiding conduit comprising a rigid material, a mechanically expandable material, a chemically expandable material, or a rigid and expandable material, that is sealable against said wall of said installed conduit.

Other related embodiments can further comprise providing a motorized annulus boring access member (2B3, 2C1, 2E4, 2L3, 2Y3, 2Z1, 2Z2, 2AA1, 2AB1, 2AC, 2AD, 2AE1, 2AN, 2AM2, 2AQ2, 2AS1, 2AV4 and 2BI1) comprising at least one rotatable cutting component having a flexible shaft and boring bit for penetrating and displacing a portion of said wall of said installed conduit.

Various related embodiments may comprise providing a motorized borable mechanical linkage component for displacing at least one portion of the wall of the conduit to provide a stand-off displacement or to prevent further displacing of at least one portion of the wall of the installed conduit, from another portion.

Still other related embodiments may comprise providing said fluid communication conduit borable mechanical linkage component within the operable space to bridge across, or through, at least two passageways of the plurality of passageways to access the operable space.

Still other various related embodiments may further comprise providing a fluid communication mesh wall conduit component with at least one portion of said wall of said fluid communication conduit comprising permeable pore spaces sized for packing and unpacking of particles or compositions that are usable to selectively prevent or provide fluid communication through said pore spaces using a flow orientation of said circulatable fluid column, said pore space sizing, or said particles or compositions.

Other related embodiments may provide a straddle member (2B4, 2C2, 2D1, 2E1, 2E5, 2L2, 2M, 2N2, 2R2) with said fluid communication conduit component for bridging across at least two perforations in said wall of said conduit to segregate flow between said at least two perforations and another passageway of said plurality of passageways to fluidly connect an annulus above and below a blockage in the annulus to fluidly communicate around the annular blockage.

Various other related embodiments of the straddle member may comprise a slideable piston for displacing or impacting movable fluids or another well barrier member within said plurality of passageways, using pressure from the circulatable fluid column, wherein the slideable piston can form a valve for opening and closing at least one penetration in the wall of the conduit to selectively and fluidly bypass a portion of the circulatable fluid column in one circulation orientation, through said at least one penetration, or to fluidly communicate through a longer portion of the circulatable fluid column in the opposite circulation orientation.

Various embodiments can provide a mechanically or fluidly placeable pressure bearing packer member (2F-2K, 2N5, 2S2, 2T1, 2B7, 2D4, 2E7, 2N4, 2O2, 2P, 2Q, 2R1, 2S1, 2T3, 2U, 2V1-2V2, 2W2, 2X2, 2AE2, 2AG, 2AI, 2AK, 2AL, 2BF1, 2BF3, 2BI4) that can be expandable within said operable space and can be axially fixable or movable within at least one of said plurality of passageways to provide: the displacing of at least one portion of the wall of the conduit to provide an operable space, the bridging across the operable space, or the placing of at least one cement equivalent well barrier member through the operable space to fluidly isolate the at least one portion of a subterranean well.

Other related embodiments of a fluidly placeable pressure bearing packer member can comprise a mechanical packer with cylindrical, bag or umbrella components.

Other embodiments of a fluidly placeable pressure bearing packer member of the present invention can comprise a gelatinous packer with particles or rheological fluid components fluidly placeable and gelatinously fixable within at least one of said plurality of passageways.

Still other related embodiments can comprise gradated particles with intermediate pore spaces that can be fillable by a chemical reagent mix for forming the gelatinous packer.

The embodiments of the present invention can include a packable gradated particle slurry that can have a chemical reagent mix comprise: a first fluid mix of organophillic clay of 5% to 60% by weight of composition mixed with a hydratable gelling agent that is sufficient to suspend the clay with weighting material and alkaline source components, placed within 15% to 60% water by weight of composition, wherein the first fluid can be mixable and chemically reactable with at least a second fluid, which can comprise 15% to 60% water by weight of composition, and can be mixed with at least one of: i) a hydraulic cement of 15% to 75% by weight of composition, or ii) an oil based mud comprising 15% to 60% oil by weight of composition mixed with weighting materials of 15% to 75% by weight of composition. Although the above referenced embodiments include particular ranges of percentages by weight of composition materials, composing the packable gradated particle slurry, (i.e., chemical reagent mix, organophillic clay, water, hydraulic cement, oil based mud, and weighting materials), other combinations of ranges of percentages by weight of composition are possible for such materials.

Various other related embodiments may comprise axially compressing adjacent well components, within axially adjacent operable spaces, with a fluidly placeable pressure bearing packer member for forming or enlarging the operable space. In an embodiment, an axial piston component can be usable for axially displacing at least a portion of a wall of a conduit, the movable fluids, or combinations thereof, by axially compressing the axially adjacent components, within the axially adjacent space, to form or enlarge the operable space.

Still other embodiments can comprise laterally compressing well components within radially adjacent operable spaces, with a fluidly placeable pressure bearing packer member, for forming the operable space for the placing of the at least one cement equivalent well barrier member through the operable space to fluidly isolate at least one portion of the subterranean well. In an embodiment, a lateral piston component can be used for laterally compressing well components, within radially adjacent operable spaces, with a packer member e.g., fluidly placeable pressure bearing packer member, for forming the operable space for the placing of the well barrier member to fluidly isolate the at least one portion of the subterranean well, without removing the plurality of installed conduits and associated debris from below one or more subterranean depths (218) and to provide or enable the cap rock restoration above the producible zone.

Other embodiments of the present invention may provide a jarring member (2E3, 2S3, 2T2, 2U2, 2V1, 2W1, 2X5, 2BF3, 2BG6, 2BH1-2BH3), which can comprise a latchable and releasable piston, sealable within said innermost passageway and fireable with energy released from compressing said circulatable fluid column, to travel along a dance pole or a re-latching rod and to deliver an explosive hydraulic jarring pulse, a mechanical impact, or combinations thereof, to objects below said releasable piston.

Finally, various other embodiments of the present invention provide explosives or an abrasive particle severing member (2B6, 2E8, 2AV7) to remove the wellhead and engaged conduits above the point of severance to complete the abandoning of a well.

BRIEF DESCRIPTION OF THE DRAWINGS

Preferred embodiments of the invention are described below by way of example only with reference to the accompanying drawings, in which:

FIGS. 1 to 3 depict prior art diagrams of different types of drillings rig operations and FIG. 4 shows a prior art normally unmanned offshore platform.

FIGS. 5 to 7 illustrate different types of prior art rig-less operations.

FIG. 20 illustrates a prior art well configuration prior to abandonment.

FIG. 21 depicts the same well after abandonment using various embodiments of the present invention.

FIGS. 22 to 26 depict various rheology controllable and annuli placeable fluid member embodiments of the present invention. FIG. 26A illustrates a hard and swellable material mixture, deployable using the fluid members of FIGS. 22 to 26.

FIGS. 31 to 34 depict various annular piston member embodiments usable within the systems and methods of the present invention.

FIG. 34 shows a conduit pinning member embodiment usable within the systems and methods of the present invention.

FIGS. 35 to 41 show various annular piston member embodiments while

FIGS. 47 to 53 and FIGS. 62 to 66 depict various motorized annulus access embodiments, while FIGS. 54 to 61 illustrate various annulus piston embodiments, usable within the system and method embodiments of the present invention.

FIGS. 72 to 74 illustrate various milling embodiments, while

FIGS. 105 to 116 show various motorized annular access embodiments, of the present invention.

FIGS. 117 to 122 illustrate various annular access guidance embodiments of the present invention.

Figure 8:
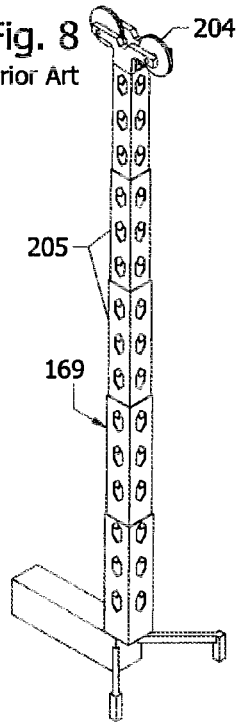
Fig. 8 Prior Art
FIGS. 8 to 9 illustrate prior art equipment usable to perform rig-less operations.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

FIG. 1, is an isometric view of a prior art jack-up mobile offshore drilling unit (163) with a crane (195), helideck (194) and large scale derrick (193A) over a normally unmanned platform (170), usable to, e.g., support the day-to-day needs of a hundred people while drilling a well kilometers into the subterranean strata. A wellhead (7) would be situated on the normally unmanned platform (170), immediately under the derrick (193A) that has been cantilevered over the platform, once the rig is jacked up. While constructing a well and conducting drilling operations offshore or onshore requires a significant level of resources and associated cost, the abandonment of the same well can require significantly less resources if installed conduits are left within the strata, but because conventional rig-less methods for meeting various published industry standards for a majority of wells are not suitable, drilling rigs are often used to abandon wells despite their cost.

FIG. 2 depicts an isometric view of prior art modular Drilling Rig Derrick, Rig Floor and Pipe Rack arrangement (165) without supporting equipment, such as mud pits, pumps, compressors and power generation, with a large hoisting capacity mast (193B) of comparable lifting capacity to a derrick (193A of FIG. 1) usable offshore or onshore. FIG. 2 shows another example of a drilling capable rig, generally over specified for well abandonment, which is difficult to move, erect and operate, thus it is costly despite a significantly smaller foot print compared to the full-sized drilling rigs (e.g. 163 of FIGS. 1 and 164 of FIG. 3).

FIG. 3 is an elevation view of prior art Semi-submersible floating Mobile Offshore Drilling Unit (164), with a crane (195) and full size derrick (193A) floating at sea level (122A) over pressure control equipment (168), comprising a subsea blow out preventer (9A) engaged to a subsea tree and wellhead (7) at the sea bed (122). Subsea well operations, including abandonment, must account for the hazards and hydrostatic pressure of the ocean fluid column between the seabed (122) and sea level (122A). Rig-less subsea operations are possible with pressure control equipment (168A) significantly smaller than a drilling rig's subsea equipment (168), but similar to surface equipment (168C and 168D of FIGS. 7 and 9, respectively) that is adapted for use and deployment subsea, engaged to a subsea tree and wellhead (7), wherein lubricators and wireline are deployed from a boat (201 of FIG. 6) and engaged to the subsea tree and wellhead (7). For rig-less abandonment operations, well barrier elements would be rig-lessly placed through the lubricator (8 of FIGS. 7 and 9) on the boat, then lowered and engaged to the subsea tree to perform abandonment operations. Thereafter, the wellhead (7) would be severed and recovered to the boat, once the ocean floor (122) was isolated from subterranean pressure sources using permanent well barrier elements, e.g. cement.

FIG. 4, a plan view of a prior art normally unmanned offshore platform (170A), optionally with a helideck (194), shown with dashed lines, for personnel access and a crane (195) for lifting equipment off of a boat (201 of FIG. 6), illustrates the relatively small dimensions of the underlying platform jacket of 8.5 meters by 12 meters. Once various operational production apparatuses (196) and production manifolds and pipework (197) are placed on the platform, leaving little room for well intervention and abandonment equipment, hence drilling rigs, despite being over-specified for various required operations as described in FIG. 1, are sometimes required to provide the necessary space for personnel and equipment. Limited space on such facilities may also prevent the use of rig-less arrangements, such as that described in FIG. 5, wherein only the lower space requirements of rig-less operations described in FIGS. 6, 8 and 9 may be possible.

FIG. 5 depicts an isometric view of a prior art rig-less arrangement (166A), published in U.S. Pat. No. 7,921,918B2, with a jib crane (195), pressure control (168B), comprising, e.g., a packing element, and work string (199) or pipe handling (198) equipment. FIG. 5 illustrates a rig-less arrangement designed for operating below ground level (121) or below sea level (122A) and mud line (122). While embodiments of the present invention are usable with drilling rigs (163, 164 and 165 of FIGS. 1, 3 and 2, respectively) and this rig-less arrangement (166A), the present invention can be usable with rig-less arrangements (166B and 166C of FIGS. 6 and 7, respectively) that are placeable and operable in space-limited environments, wherein this arrangement (166A) may not be viable.

FIG. 6, an isometric view of a prior art rig-less arrangement (166B) and offshore access system (200) from a boat (201) floating on the ocean surface (122A), illustrates a normally unmanned platform (170B) with a mast (169) for deploying wellhead (7) engaged pressure control equipment (168D of FIG. 9) and cable tool operations, which can be usable with the methods and apparatuses of the present invention.

FIG. 7 is an elevation view of an onshore prior art rig-less arrangement (166C) usable with the present invention to lower the cost and space requirements of abandonment. It depicts a truck (202) with a wireline winch (203) deploying a coiled string (187), comprised of, e.g., coiled wire or coiled tubing, passing through various sheaves and entering a lubricator (8) engaged to blow out preventers (9), and further engaged to a valve tree (10) and wellhead (7). A work string (199) is deployed with rotary (72) and/or snap (98) connections at its lower end, which can be usable with methods and apparatuses of the present invention.

Figure 9:
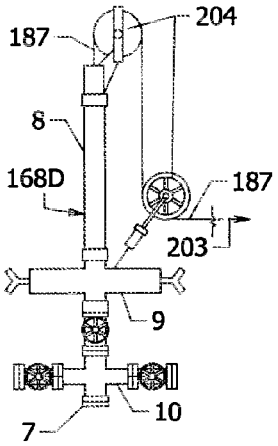
Fig. 9 Prior Art

FIGS. 8 and 9, isometric and elevation views of a prior art mobile wireline mast (169) wireline blow out preventers (BOPs) and lubricator arrangement (168D), respectively, illustrate telescoping mast sections (205) above a base with sheaves (204) at the upper end, for cables, from which a winch is usable to hoist pressure control equipment (168D) for engagement with a wellhead (7). The mast (169) serves a similar function to a derrick (193A of FIGS. 1 and 3, and 193B of FIG. 2), albeit with a significantly reduced lifting capacity suited primarily for lifting pressure control equipment and hoisting a lubricator (8), disconnected and reconnected to a blowout preventer (9) and valve tree (10), so as to engage apparatuses to a coiled string (187) threaded through the lubricator and operated with a winch (203). The pressure in a well is controlled, during intervention or abandonment, by closing the valve tree (10) and BOPs (9) when the lubricator is disconnected for placement and removal of apparatuses from within, after which the lubricator is reconnected and the valve tree and BOPs are opened for deployment on the coiled string (187), sealed at a stuffing box located at the upper end of the lubricator (8), whereby the apparatus may be deployed through the pressure controlled envelope of a well, through the wellhead (7) and plurality of installed conduits engaged to and extending downward from the wellhead.

Figure 10:
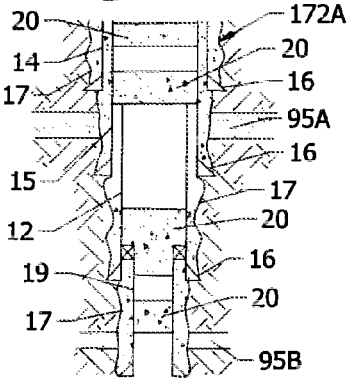
Fig.10 Prior Art
FIG. 10 shows a typical prior art drilling rig well abandonment for comparison to the rig-less abandonment issues and published conventional minimum industry requirements shown in FIGS. 11-15.

FIG. 10, a diagrammatic elevation cross section view through the well and subterranean strata of a prior art Drilling Rig Permanent Well Abandonment (172A), depicts the production tubing removed from the conductor (14), intermediate (15), production (12) and liner (19) well casings, that are shown cemented to the various diameter strata bores (17), between the lower casing shoes (16) and various subterranean depths, within which cement (20) plugs are placed across the well bore to isolate hydrocarbon (95B) and water (95A) producible zones or formation layers within the strata, wherein a portion of the production casing (12) is cut and removed for placement of two of the plugs. As the gauge or diameter of the original strata bore (17) varies between and over casing sections, the top of cement behind casing and above a casing shoe (16) is often unknown, if during construction a casing bond log was not performed and circulating pressures were used to estimate the top of cement. Additionally, due to testing, thermal cycling, and overburden stresses and pressures within a well during its operating life cycle, the cement bond behind the casing may have been lost even if it was initially present, thus providing a leak path for subterranean pressurized fluids. Various milling, compressing and shredding methods of the present invention are usable to emulate this removal of the innermost conduits by cutting and compressing them for placement of well barrier elements above their compressed remains.

As later described in FIGS. 14 and 15, conduits may be left within a well during abandonment, provided a permanent barrier element, e.g., cement, is placed across the entire strata bore (17). In many cases, the subterranean depths and/or existence of a cement bond behind the various casings is unknown, and a drilling rig must be used to first remove the production tubing to access the production annulus in order to perform cement bond logging. Conversely, various methods and apparatuses of the present invention are usable to access these annuli in rig-less operations so that logging may occur to determine the extent of cement bonding behind installed conduits, thus removing the need for a drilling rig.

Figure 11:
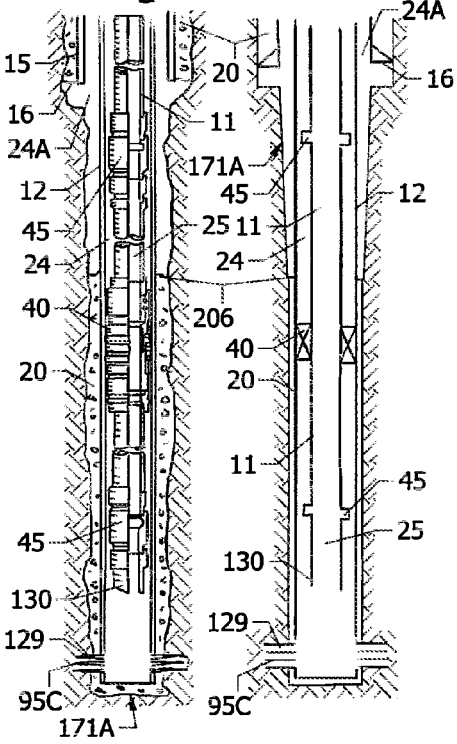
Fig.11 Prior Art
Figure 12:
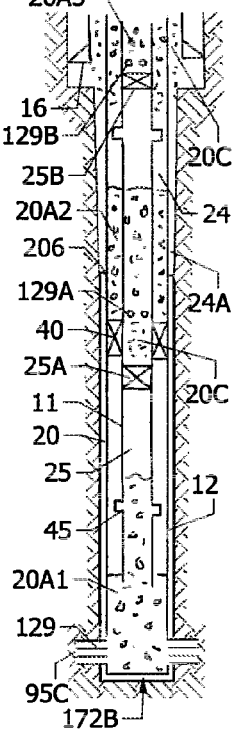
Fig.12 Prior Art

Referring now to FIGS. 11 and 12, a diagrammatic elevation subterranean strata sliced view of before (171A) and after (172B) conventional rig-less permanent abandonment, respectively, wherein the left portion of FIG. 11 shows a half slice through the subterranean strata and well casings, with a quarter section of the completion removed, and the right side is a simplified diagrammatical depiction of the left side, illustrating intermediate casing (15) cemented (20) to a casing shoe (16) with the production casing (12) cemented (20) and penetrated (129), by perforating guns, to expose a producible zone (95C). The production conduit or tubing (11), with nipple profiles or receptacles (45) above and below a production packer (40) engaged to the casing (12), has a wireline entry guide (130) at its lower end. During conventional abandonment, cement is bullheaded through the perforations, as shown in FIG. 12, until the forces of injection were too high, and the cement locked up, leaving cement (20A1) within the tubing (11). Conventional rig-less abandonment operations, using installed conduits (11) for placement of cement (20A1-20A3) within the innermost passageway (25), production annulus (24) and intermediate casing annulus (24A), suffer from an inability to effectively circulate or support placed cement, wherein cement contamination (20C) may occur. As shown in FIG. 12, a plug (25A) was then placed in the tubing (11), below the packer (40), and penetrations (129A) were made to place cement (20A2) in the innermost bore (25) and production annulus (24). A second plug (25B) was set using coiled string deployment, then the tubing (11) and production (12) conduits were penetrated (129B) to allow cement (20A3) to be placed in the innermost passageway (25), production annulus (24) and intermediate annulus (24A).

As logging of the cement bonds behind the casings (12, 15) is generally not conventionally possible, without removal of the tubing, neither the integrity of the cement behind casing nor the top of the cement (206) could be confirmed, as required by various published industry standards. While the bullheading of cement to the producible zone (95C) may have been effectively placed, lighter hydrocarbons may subsequently gravitate upwards and cause channels within the cement (20A1), thus preventing it from being considered a permanent barrier. Cement below the packer (40) and above the plug (25A) is likely to have been contaminated (20C), albeit such small volumes are unlikely to have caused pressure bearing integrity issues, but placement of cement (20A2) above the top of the cement (206) and behind the production casing (12) does not constitute an industry acceptable permanent barrier, because the annuli (24A) are unsupported at that point (206). Also, cement (20A3) placed through penetrations (129) may not have entered the intermediate casing annulus (24A) and/or the volumes of fluid below the unsupported cement (20A3) may be sufficient to cause contamination of the cement (20C) as it falls through a lighter fluid.

The inability to confirm the existence of cement in the locations necessary to form a permanent barrier capable of isolating subterranean pressures from the above ground, ocean environments and/or subterranean water tables for an indefinite period of time is a serious issue to which conventional rig-less abandonment often does not have answers. Even when conventional coiled tubing is used to form a circulation pathway for better placement of cement during prior art rig-less abandonment operations, in conventional practice there is no means for rig-lessly placing logging tools to confirm the existence of a cement bond nor are there any cable compatible prior art conduit milling solutions, which are capable of removing conduits and poor quality cement to expose the subterranean strata, so as to place good quality cement. Embodiments of the present invention are usable to address the issues of logging, cementing and milling of conduits in a pressure controlled environment using coiled string operations in an economic manner currently unavailable to practitioners.

Figure 13:
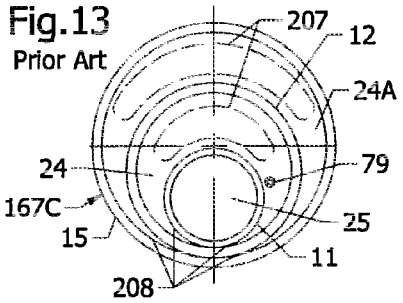
Fig.13 Prior Art

FIG. 13, a plan view of a prior art concept of fluid flow within an eccentric offset conduits arrangement (167C), illustrates, e.g., a production tubing conduit (11) within a production casing conduit (12) within an intermediate casing conduit (15), with a control line (79) within the production annulus (24), wherein the tubing (11) and production casing (12) are eccentric to the centre of the intermediate casing (15). If eccentric conduits are not separated when, e.g., penetrating the conduits and circulating down the innermost production passageway (25) and returning through either the production conduit annulus (24) or intermediate conduit annulus (24A), a channel (207) of higher velocity flow will occur through the lowest fluid friction areas that will reduce flow, to a near zero flow rate, through the higher friction areas (208) where conduits touch or are closely spaced. Because rig-less abandonment generally uses installed conduits to circulate a permanent well barrier, e.g. cement, into a well, the effect of zero flow in high frictional areas (208) may prevent cleaning of conduits to create a wettable surface and/or placement and bonding of a fluidly circulatable and settable permanent well barrier element, e.g. cement, which may result in a leak path over time, even if the arrangement holds pressure from above initially, as lighter fluids and/or subterranean pressures find their way to the surface, by eroding contaminated or poorly bonded barriers. Other serious leak path issues for rig-less abandonment are control lines (79) and cables in conventionally inaccessible annuli that may not fill with cement due to, e.g., capillary frictional resistance. As conventional rig-less approaches are not capable of addressing either the eccentricity of conduits or the presence of control lines, drilling rigs are often used to abandon wells.

Figure 14:
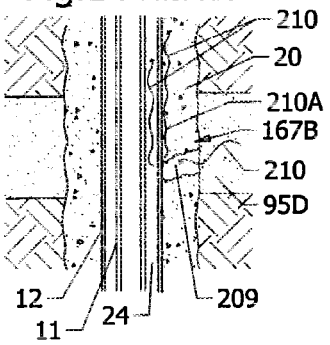
Fig.14 Prior Art

FIG. 14, a diagrammatic elevation view of the prior art concept of Degradation of a Well Barrier (167B), illustrates poor bonding resulting in a micro annulus (210A) between cement and a conduit or missing (209) cement (20), providing a potential leak path for fluids (210) of a producible zone (95D), which may corrode the casing conduit (12) over time. Alternatively, the fluids can make their way to the production annulus (24) or travel upwards in the unfilled inner bore, or between the casing (12) and cement (20) if a poor cement bond exists, where the fluids may escape to pollute a surface or ocean environment, potentially causing hazardous conditions for inhabitants. For this reason, conduits and other apparatuses, e.g. mechanical packers and plugs, are not considered permanent barriers, as they will corrode over time. Additionally surfaces of conduits and equipment must be clean and wettable to provide a good bond, thus preventing corrosion, and providing a permanent well barrier element that retains its pressure bearing capacity indefinitely.

Figure 15:
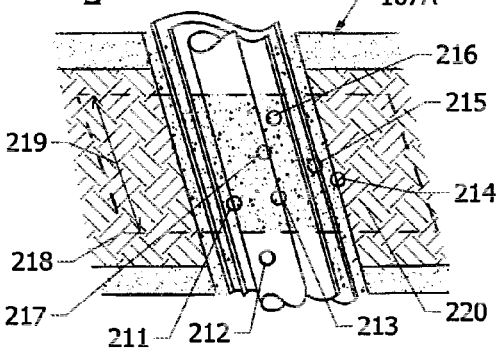
Fig.15 Prior Art

FIG. 15 is a diagrammatic elevation view of conventional published industry acceptable minimum rig-less abandonment requirements (167A), showing a paraphrased representation of the *Oil and Gas UK Issue 9, January* 2009 *Guidelines for Suspension and Abandonment of Wells*, FIG. 1 entitled 'Permanent Barrier schematic "Restoring the Cap Rock"' used within the publication to describe "minimum industry best practices."

Published industry best practice for rig-less placement of a permanent barrier specifies a minimum height of good cement (219), of at least 100 feet, that must be placed at a depth (218) determined by formation impermeability and strength with primary cementation behind casing in place. Pipe circumferential stand-off (211) is required to prevent the channelling (207 of FIG. 13) of high fluid frictional areas (208 of FIG. 13) resulting in poor cleaning, bonding and/or missing cement (209 of FIG. 14). Axial downward cement support (212) is required to prevent cement movement, slumping and gas migration while setting, and with clean water wet surfaces to provide a good bond (213), thus preventing poor bonding and micro annuli (210A of FIG. 14) and leak paths (210 of FIG. 14). Once these minimum requirements are met, the published references generally conclude that a rig-less operation will provide "well barrier elements," of a permanent sealing abandonment plug (216), with the innermost conduits sealed with cement in cement (217) and the casing and tubing embedded in cement (215). Provided that both the existence and sealing bond of primary cementation (214), adjacent to a formation that is impermeable and of adequate strength, are present, the resulting cement will contain future pressures (220). While "cement" is specified, the Oil and Gas UK Guidelines also provided for alternative permanent well barrier elements, provided that they provide an equivalent function to cement.

Meeting industry rig-less abandonment best practice therefore requires logging of the primary well cementation behind casing to ensure its presence and bond, followed by cleaning of well conduits to ensure they have wettable surfaces for cement bonding and embedding tubing and casings within cement, by providing offset where necessary over a sufficient portion of the well opposite an impermeable and strong formation that is capable of replacing the cap rock.

Unfortunately, while current practice emphases the need to design for future abandonment of a well, this was not always the case and few existing wells were designed with rig-less abandonment in mind. For example, production packers may be placed where future abandonment plugs should be placed and the primary cementation may never have been logged. As a result, conventional rig-less abandonment practices are generally unsuited for meeting industry well abandonment best practices, resulting in the use of over specified drilling rigs.

However, the present invention is usable to rig-lessly abandon all of, or a portion of, a subterranean well's annuli and producible zones while meeting published industry best practices, such as those described in the referenced Oil and Gas UK Guidelines and NORSOK standards. Meeting industry best practices for abandoning wells requires accessing the annuli of a well in a rig-less manner to perform logging of primary cementation, then remedying any poor primary cementation and placing good cement plugs and/or other suitable permanent abandonment seals within a well.

Referring now to FIGS. 16 to 19, 21 to 46 and 48 to 74 depicting various diagrammatic cross sectional slices through a well's components and subterranean strata, the Figures illustrate methods and system or member embodiments for operating on wells and accessing producible zones and annuli through a wellhead (7), that is shown engaged to a plurality of conduits comprising: conductor casings (14), intermediate casings (15), a secondary intermediate casing (15A) and production casing (12), cemented (20) at their lower ends for forming casing shoes (16) within various diameter subterranean strata bores (17), with an innermost conduit (11) or production tubing (11) engaged to the wellhead, within the production casing (12), and secured at its lower end with a production packer (40). A liner (19) and liner top packer (40A) may also be present in various well configurations, with the liner or casings penetrated (129) by perforating gun members or embodiments to allow production (34P) from a conduit lined producible zone (95F). Any embodiment is usable with a well head (7), placeable at the mudline (122), if below sea level (122A), or at ground level (121) with production (34P) occurring through the production tubing (11) from an open hole producible zone (95E). Production (34P) is controllable with a valve tree (10, 10A) using surface valves (64) and/or with a subsurface safety valve (74) and control line (79) engaged to the tubing (11), with clamps below the wellhead (7).

A circulatable fluid column (31C) may be circulated axially downward or upward through the tubing (11) returning or entering, respectively, e.g., through the annulus between the production casing (12) and tubing (11), using a sliding side door (123), and lower end of the tubing and/or penetrations in the tubing (11), to take fluid circulated returns or to pump a circulatable fluid via an annulus opening (13), annulus opening valve (13A), and/or valve tree (10). Circulation of the circulatable fluid column (31C) in any of the annuli may also occur through openings between annuli passageways entering and exiting wellhead annuli openings (13). The circulatable fluid column (31C) may be stagnate, circulated through passageways, or injected into a permeable reservoir (95E, 95F) or fractures (18) in the strata, if the pressure exerted by the fluid column is sufficient. The circulatable fluid column (31C) is usable to place well element barriers, e.g. cement or gradated particle mixtures, or to clean well components to provide a wettable surface (213 of FIG. 15) and/or place rheology controllable and annuli placeable fluid members during rig-less abandonment operations.

Conventional logging generally occurs within the innermost passageway (25) and is unable to determine the state of primary cementation about the casings (12, 14, and 15A) because logging tools within the production conduit (11) cannot contact the casings. Various embodiments of the present invention, e.g. annular piston and annulus boring access members, are usable to access annuli for placement of logging tool members to confirm primary cementation adjacent to conduits (214 of FIG. 15). Signals may, e.g., be broadcast from the logging tool with reflected signals collected by a different portion of the logging tool, or signals may be passed between the wellhead, surface or subsea location and the downhole transmitter or receiver. Using logging tool method embodiments of the present invention, measurement signals can be engaged with the circumference of the conduit walls to provide sonic, acoustic or various other forms of signal measuring, e.g., the response time of signals passing through bonded (216 of FIG. 15), and unbonded (209 of FIG. 13, 210A of FIG. 14) conduit cementation to measure the degree of bonding and/or cementation present. The process may be visualized as ringing or pinging a glass and measuring the sound or vibration received to determine if the glass is free standing, within a liquid or tightly cemented in place.

Dependent on the result of the logging measurements, various other members of the present invention system of members are usable to place temporary or permanent well barrier elements within the well at the appropriate subterranean depths (218-219) to meet industry best practices (211-220 of FIG. 15) to avoid potential future leak paths (210 of FIG. 14, 208 of FIG. 13) and/or simulate a rig abandonment (172A of FIG. 10) by placing cement plugs (20 of FIG. 10) across casings (12, 15 and 19 of FIG. 10). Additionally, all embodiments are cable string compatible and are thus usable with either the rig-less arrangement of FIG. 5 or the minimalistic pressure controlled arrangements of FIGS. 6 to 10, to meet published best practices (211-220 of FIG. 15) for permanently abandoning a subterranean well in a rig-less manner.

Various methods and members, e.g., rheology controllable and annuli placeable fluids and swellable expandable mesh membrane members, are usable to temporarily restore sufficient fluid pressure integrity by bridging across fluid leaks to use the circulatable fluid column (31C) to provide sufficient cement (219 of FIG. 15), at suitable permanent barrier depths (218 of FIG. 15), to contain future pressures (220 of FIG. 15), with annular separating members usable to provide circumferential stand-off (211 of FIG. 15) for cleanable water wettable surfaces that enable good bonding (213 of FIG. 15) during circulation of the fluid column (31C) and embedding of conduits in cement (215 and 217 of FIG. 15), so as to provide a sealing permanent abandonment plug (216 of FIG. 15) according to published industry guidelines.

Various methods and members, e.g., axially slideable annular blockage bypass, annulus guiding, annulus boring access and boring bit engagable conduit members are usable to embed casing (12, 14, 15, 15A, 19) and tubing (11) in cement (215 of FIG. 15), with the tubing and casings being filled and surrounded for providing cement in cement (217 of FIG. 15) conduits, using a bypassing arrangement around blockages in an annular space, e.g. a production packer, and by boring into annuli to create a logging space and fluid circulation path, which can be usable with logging tool members and the circulatable fluid column in bores and annuli of the well, at selected depths (218 of FIG. 15), to provide sufficient cement (219 of FIG. 215) that is adjacent to a primary cement barrier, bonded between the outer casings (12, 14, 15 and 15A) and an impermeable formation of sufficient strength, to contain future pressures (220 of FIG. 20). Thus, a sealing permanent well barrier element (216 of FIG. 15) can be provided according to published industry guidelines.

Other various methods and members, e.g., annular piston, jarring, circumferential shredding and milling, and axial movable screw or tractor members, are usable to simulate a rig abandonment (172A of FIG. 10) by compressing, milling and/or shredding of conduits, within casings (12, 15 and 19 of FIG. 10), to remove the conduits within a barrier's height (219 of FIG. 15) at the necessary barrier depth (218 of FIG. 15) and across from a strong impermeable formation (220 of FIG. 15). Accordingly, this provides permanent abandonment cement plugs (216 of FIG. 15) across casings (12, 15 and 19 of FIG. 10), pursuant to published industry guidelines.

Still other various methods and members, e.g., rheology controllable and annuli placeable fluids, and annular piston members, can be usable as, or for, supporting well barrier elements, e.g. cement, to avoid settable barrier movement, slumping and/or gas migration, while setting (212 of FIG. 15) to provide a good bond and to ensure sufficient cement (219 of FIG. 15) at a depth (218 of FIG. 15) adjacent to an impermeable strong formation (220 of FIG. 15), to provide permanent abandonment cement plugs (216 of FIG. 15) according to published industry guidelines.

Additionally, while FIGS. 16 to 19, 21 to 46 and 48 to 74 illustrate various cable (187) compatible string tension and/or electric cable and fluid column (31C) operable members, said members are also usable with coiled tubing and/or jointed conduit strings, in various other configurations of conventional rig and rig-less operable arrangements, wherein circumferential cutting members and rotary cable tools of the present inventor and described within the referenced applications are also usable as members.

Figure 75:
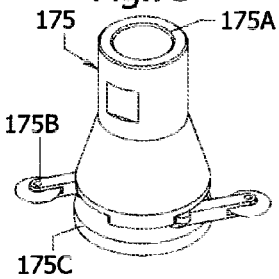
FIGS. 75 to 79 depict apparatuses usable in various embodiments of the present invention.

FIG. 75, an isometric view of rotary cable tool conduit cutter (175) is, e.g., usable as a cutting member of the present invention, and illustrates a cutting arm assembly (175B) extended by the combination of rotation of the rotary connector (175A) and frictional resistance of the drag block (175C), wherein the member is deployable through the innermost conduit and usable to cut through various casing strings, with its low torque roller cutter. This is similar in nature to a plumber's pipe cutter that can be deployed from the inside out, rather than the outside in. Various apparatuses of the present inventor, as described in GB1011290.2, including a boring bit (174), and/or conventional cutting devices are usable with a conventional motor and/or cable compatible motor assemblies of the present inventor, and are usable as members within method embodiments of the present invention.

Figures 123, 124, 125, 126, 127, 128, 129:
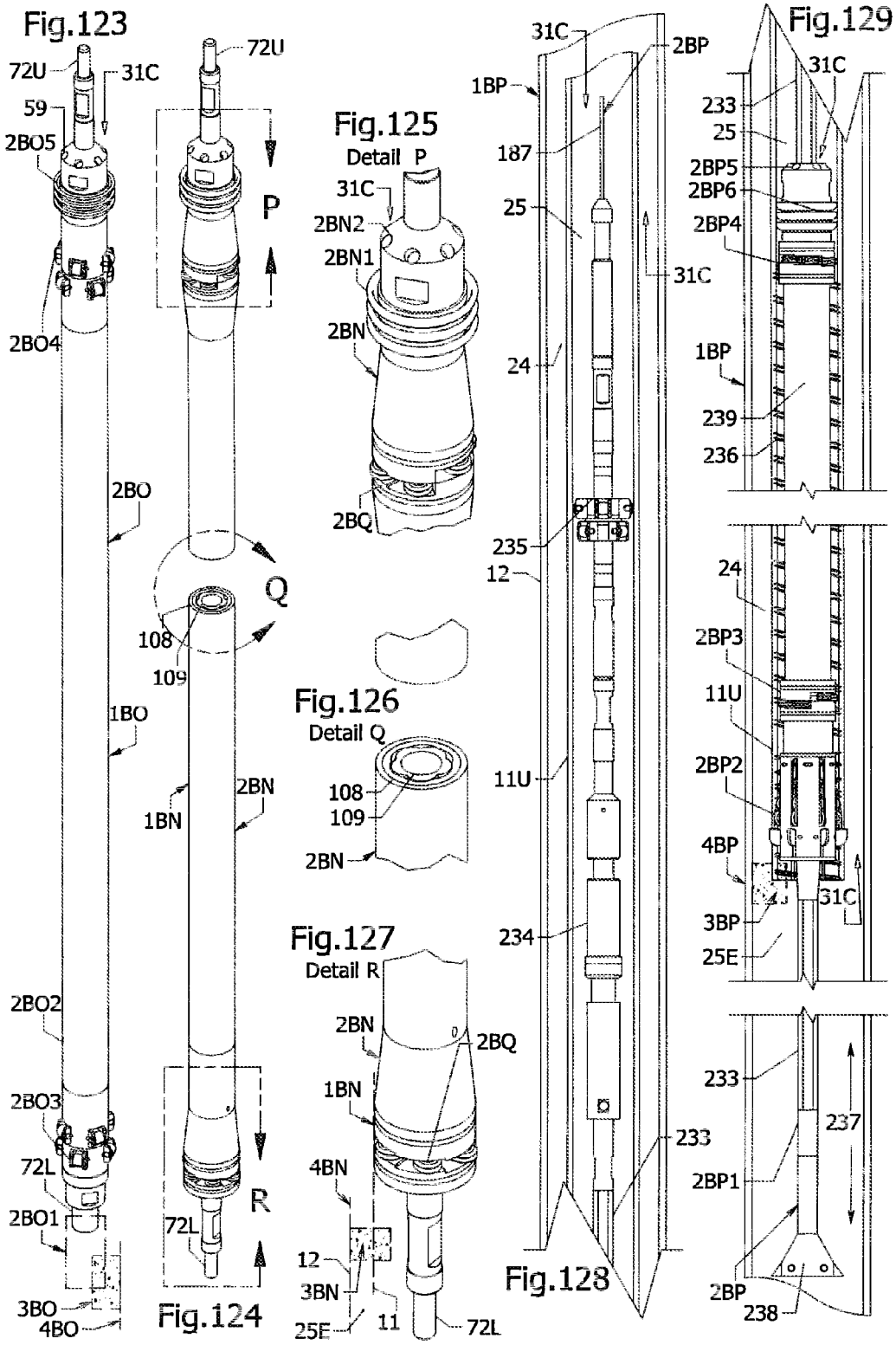
FIGS. 123 to 147 depict various motorized annular access embodiments of the present invention.

Referring now to FIG. 123, an isometric view of a method (1BO) embodiment of a motorized member (2BO) is depicted, compatible with cable operations and usable within various embodiments of the present invention. The Figure depicts an upper rotary connector (72U) that can be engagable with a cable (187 of FIG. 9) and deployable through pressure control equipment and the innermost conduit passageway for operating various conventional and invented devices (2BO1), which can be used to access annuli and producible zones for placing the partially shown well barrier elements (3BO) to abandon a portion (4BO) of a well. The motor member (2BO) is comprised of a lower rotary connector (72L), engagable with members (2BO1) of the present invention and rotated by a fluid motor assembly (2BO2), that is held by upper (2BO4) and lower (2BO3) anti-rotation devices. The fluid motor is operated by pumping the circulatable fluid column (31C), diverted by seals (2BO5) engaging the innermost conduit's circumference, into orifices (59) that can be usable to operate the motor (2BO2) and lower member (2BO1) within method embodiments of the present invention, wherein the member is an example of a usable motor for the following method embodiments.

FIGS. 16, 17, 18, 19 and 20-21, describe methods and members usable to access and/or abandon an entire well, which are interchangeable with other associated methods and members described throughout the remainder of the specification, and which demonstrate that the adaptable system of methods and member sets, of the present invention, are usable to address the variability of the subterranean strata and design characteristics of substantially hydrocarbon and substantially water wells, when accessing, using and/or abandoning at least a portion of a subterranean well's producible zones and annuli.

Figure 16:
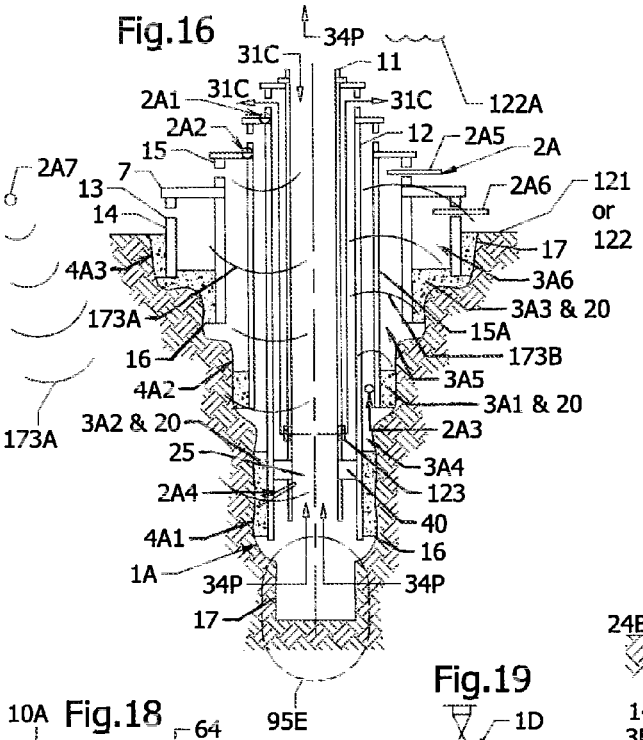
FIGS. 16 to 19 depict various embodiments of the present invention for using and/or abandoning substantially hydrocarbon or substantially water wells.

FIG. 16, an elevation cross section view of a logging tool member method (1A) embodiment usable with a member set (2A) comprising conventional logging tool signal (2A1-2A3) and receiver (2A4-2A6) members within a plurality of passageways below a wellhead (7), shows signals deployed axially upward (173A) or downward (173B), e.g., through wires or acoustically through the walls of the conduits and/or through fluid pulses within the fluids in the annuli, to measure the installed well barrier elements (3A1-3A3) and to determine the requirement for new well barrier elements (3A4-3A6) within portions (4A1-4A3) of the well axially below the wellhead (7). Signal transmitters (2A1-2A3 and 2A7) and/or receivers (2A4-2A6) are engagable with conduits, or annulus fluids, through embodiment penetrations (2A3, 2A4) or through annulus wellhead openings (13). A signal may be sent from the wellhead (2) or from and an external transmitter (2A7), which can function in a similar manner to a VSP logging tool used to calibrate seismic data, but also can be usable to see the existence of primary cementation adjacent to the strata bore (17). Various embodiments of the present invention can be usable to place logging tool member transmitters or receivers within a well, e.g., the annulus piston method (1S of FIG. 41) can be usable to expose the production casing (12 of FIG. 41) for logging of primary cementation (20 of FIG. 41) behind it; or, e.g., a annulus boring access member can be usable to place logging tool members within any annuli.

Figure 17:
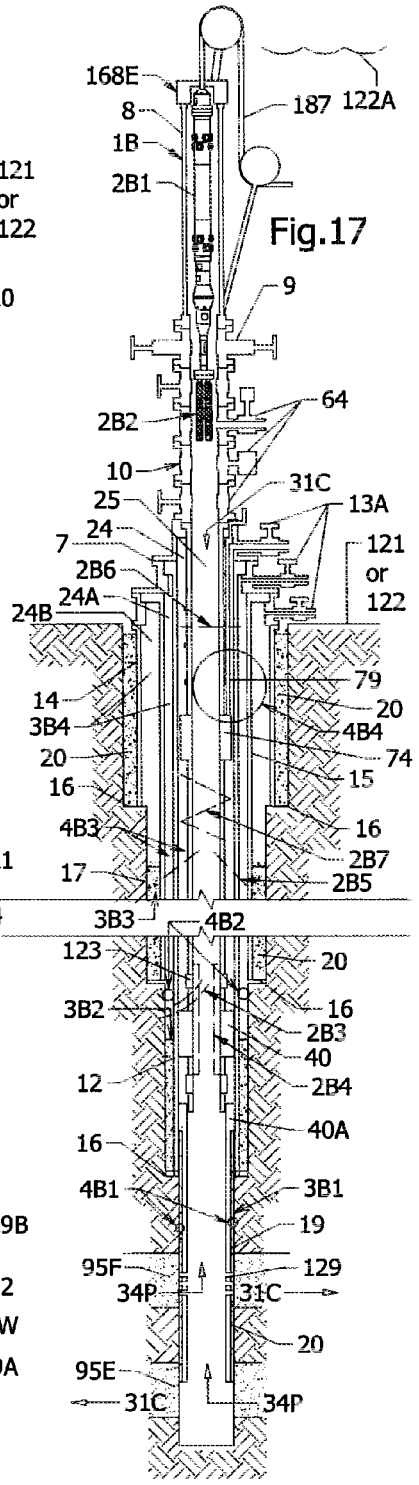

FIG. 17, is an elevation cross section view with break lines representing removed portions of the subterranean well and strata, which depicts embodiments of a method (1B) that can be usable with a set (2B) of motorized annulus access (2B1, e.g. 2BO2 of FIG. 123), circumferential shredding and milling (2B2, 2B5, e.g. 2BP1-2BP4 of FIG. 129), annulus boring access (2B3, e.g. 2BU of FIG. 147), axially slideable annular blockage bypass (2B4, e.g. 2M of FIGS. 28-30), abrasive particle cutting (2B6, e.g. 2AV7 of FIG. 72) and an annular piston (2B7, e.g. 2T3 of FIG. 42) members, deployable within a pressure controlled rig-less well environment (168E). The Figure depicts the members (2B1, 2B2) within the lubricator (8) that is engaged to the BOPs (9) and a valve tree (10) engaged to the wellhead (7), deployable axially downward within the well using a coiled string (187). Conventionally, cement may be bull-headed into the perforating gun penetrated, producible zone (95F) and open hole (95E) reservoirs, by injecting fluid of the circulatable fluid column (31C) into the penetrations (129) of the liner (19) and open hole (95E), to abandon a portion (4B1) of the well for preventing further production (34P). Alternatively, an axially slideable annular blockage bypass member (2B3) can be usable to bullhead cement with a significantly reduced risk of losing injection with the tubing full of cement, wherein logging through the innermost bore (25) can determine sufficient primary cement (3B1, 20) exists behind the liner (19) for isolating the reservoirs prior to said bullheading, while the annulus boring member (2B3) is usable to access the annulus (24A) and determine whether the well barrier element (3B2) is sufficient to provide permanent well integrity for the portion (4B2) of the well.

The method (1B) is usable to rig-lessly abandon all or a portion of a well through a pressure controlled (8, 9, 10) coiled string (187) arrangement, onshore below ground level (121) or offshore below mudline (122) and beneath the ocean's surface (122A) on, e.g., a subsea wellhead (7 of FIG. 3) or offshore platform (170A and 170B of FIGS. 4 and 6), without resorting to conventional methods requiring a drilling rig (163-165 of FIGS. 1-3). An axial slideable annulus (24) production packer (40) bypass member (2B4) can be usable to access the annuli (24, 24A) through the bore, made by the previous member (2B3) and potentially the sliding sleeve (123), to place cement above the well barrier element (3B2) within the annuli, across the intermediate casing (15) cemented (20) shoe (16) and strata bore (17), to abandon the portion (4B2) by using the circulatable fluid column (31C), circulated through the innermost bore (25), annuli (24, 24A) and wellhead (7) outlets (13A). Abandonment of the upper section may be performed using a milling and shredding member (2B2) that can be engaged with the motorized member (2B1) or other milling and/or shredding members (2B5) to remove the conduits (11, 12) to place a permanent well barrier element across the strata bore (17) for sealing a portion (4B3) of the well across the existing well barrier element (3B3) and casing (15), with logging of the primary barrier (3B3) occurring once the milling is completed and the intermediate casing (15) exposed, prior to placement of the barriers.

An upper well portion (4B4) can comprise well components that can be more difficult to mill, such as, e.g., a subsurface safety valve (74) with associated control line (79) and control line clamps, within the production annulus (24), which may be used and/or abandoned by first cutting the production tubing (2B6) with, e.g., a coiled string rotary cutter (175 of FIG. 75). Then, a piston (e.g. 4U of FIG. 43) can be used to compress (2B7) or crush the well components for placement of a well barrier element (3B4) across the conductor (14) primary cement (20) and casing shoe (16), within the annuli (24A, 24B) and through perforating gun penetrations or a boring bit engagable conduit, e.g. 2BI2 and 2BI3 of FIGS. 112-116. Thereafter, pressure control (7, 8, 9, 10) is no longer needed and the wellhead and upper end casing can be cut and removed from the well by, e.g., conventional abrasive cutting (2B6) of remaining conduits (14, 15), thus completing the rig-less abandonment.

Figure 18:
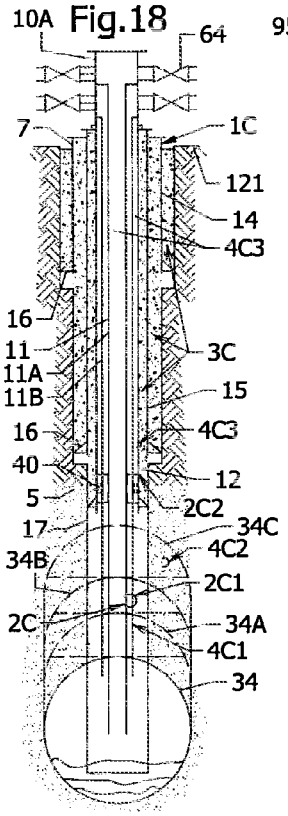

FIG. 18 depicts an elevation cross section view, which shows embodiments of a method (1C) usable with a member set (2C) comprising boring bit engagable conduit (2C1) and axially slideable annular blockage bypass (2C2) members, which can be further usable for rig-less operations on a conventional solution mining subterranean well. The Figure illustrates the use of a sealable boring bit engagable conduit (2C1), e.g. (2BI2-2BI3) of FIGS. 108-109, to bridge across the annulus between inner (11A) and outer (11B) leaching strings, thus abandoning a portion (4C1) of the outer leaching string, and allowing fresh water to be applied to solution mining of a salt deposit (4) below the top of the salt (5) deposit to expand (34A, 34B) the brine producible cavern (34) without using a drilling rig to first remove the inner leaching string (11A). Then, the outer leaching string (11B) can be adjusted and subsequently the inner leaching string can be replaced. After completing solution mining to form the storage product producible cavern (34C), the leaching strings (11A, 11B) can be removed and a production casing (11) can be engaged to the final cemented production casing (12) with a packer (40), with a valve tree (10A) and surface valves (64, also shown in FIG. 17) installed at the upper end of the well, that can be used for storage operations. Thereafter, a portion (4C2) of the storage producible cavern (34C) can be used and/or abandoned in a rig-less operation, by installing an axially slideable annular blockage bypass (2C2), to flow around the packer (40) and to circulate the cavern full of abandonment materials, e.g. solids debris, with the remaining portion (4C3) within the primary barriers (3C), rig-lessly abandoned by circulating in a well barrier element, such as cement, using the bypass (2C2), after which the wellhead (7) can be removed with abrasive cutting or other rig-less operations.

Figure 19:
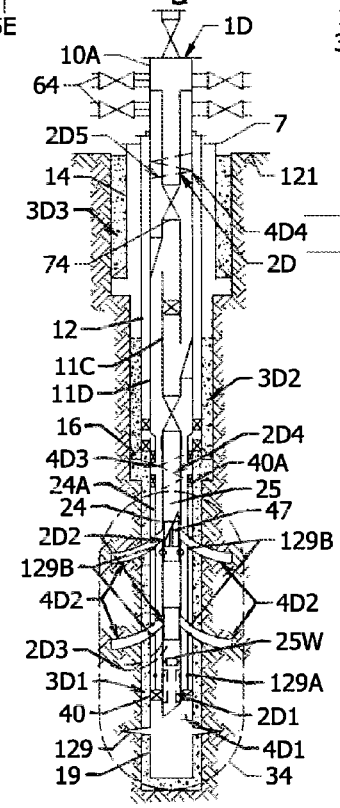

Referring now to FIG. 19, an elevation view of subterranean slice through a well and strata is depicted, showing embodiments of a method (1D) usable with a set (2D) of axially slideable annular blockage bypass (2D1), expandable circumferential engagable (2D2), boring bit engagable conduit (2D3) and annular piston (2D4, 2D5) members, that can be usable for rig-less operations on a manifold string well of the present inventor, with a dual (11C, 11D) producing string arrangement, which can be usable for underbalanced side-tracking operations through pressure control equipment (168D) with, e.g., coiled tubing (187), to, e.g., control pressures and avoid killing the well with heavy fluids and to reduce skin damage within producible formation zones.

Figure 67:
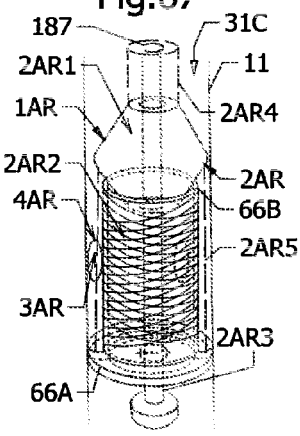

In FIG. 19, lower end penetrations (129A) and lateral passageway penetrations (129B) were placed using a bore selector, after which expandable circumferential engagable (2D2) members were placed across the lateral penetrations, e.g. 2AR2 of FIG. 67. Then, an axially slideable annular blockage bypass (2D1) member, e.g. (1BE) of FIGS. 85 to 93, can be placeable to abandon the lower portions (4D1) of the penetrated (129) liner (19), bypassing with the lower production packer (40) to circulate cement and to displace cement with a wiper plug (25W), through the inner bore (25) and annuli (24, 24A), to abandon the previous side track portions (4D2) of the well's primary barrier (3D1), thus suspending final abandonment for a further side-track. A boring bit engagable conduit (2D3) using, e.g., a flexible shaft and bit (2Y3 of FIG. 48) engagable with a fluid conduit (2BI2 and 2BI3 of FIGS. 108 and 109) can be then usable to access a different formation in the producible zone for production (34) above the cemented lower section and below the wiper plug (25W), through the existing production conduit (11C) subsurface safety valves (74), valve tree (10A) and production valves (64) engaged to the wellhead (7).

Figures 27, 28, 29, 30, 31, 32, 33, 34:
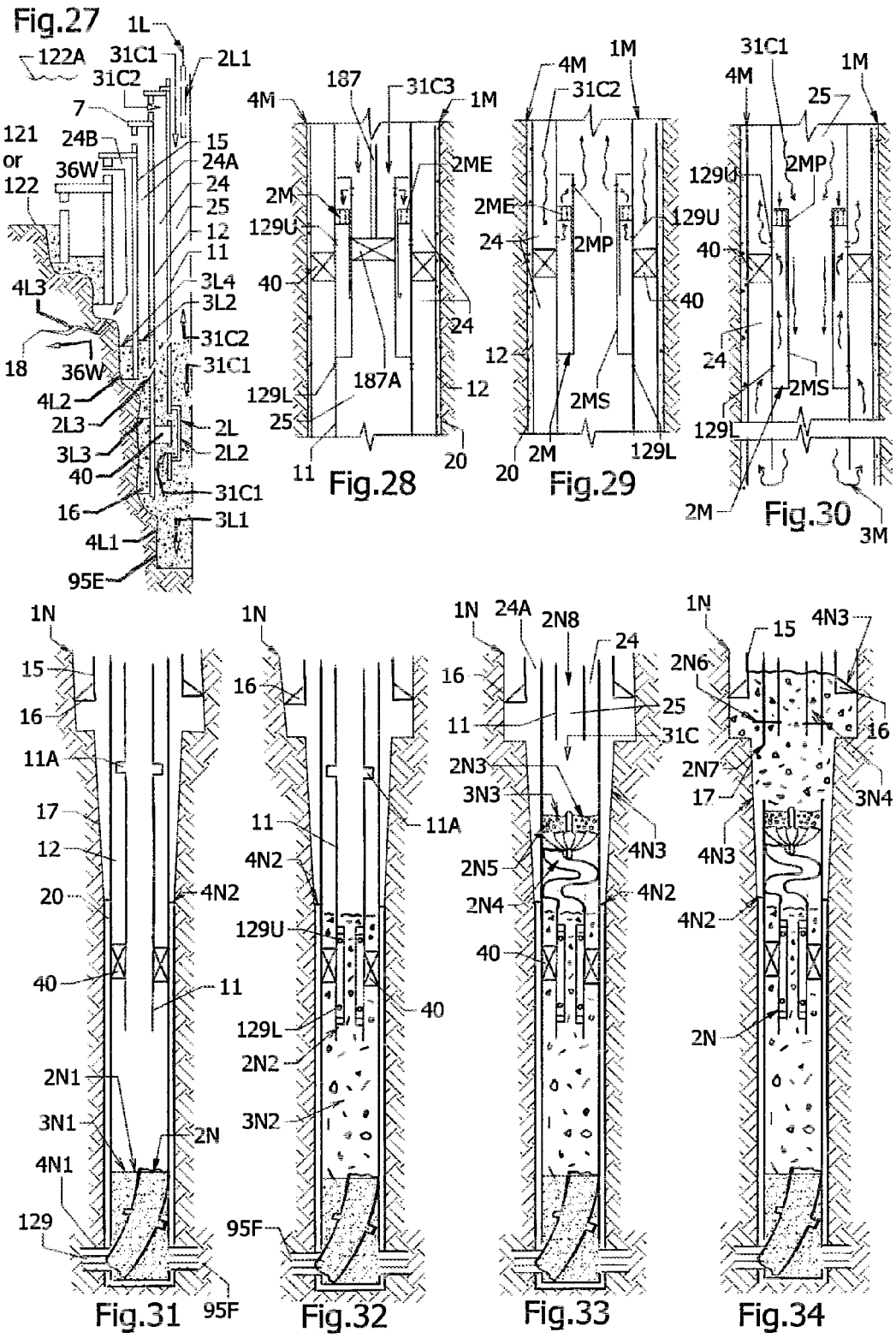
FIGS. 27 to 34 illustrate various axially slideable annular blockage bypass member embodiments usable within the systems and methods of the present invention.
Figure 39:
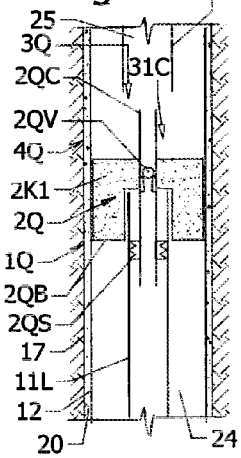
Figure 42:
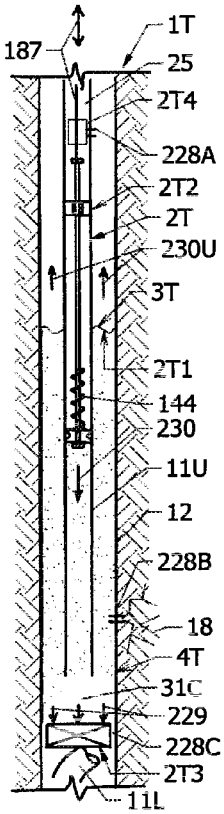
FIGS. 42 to 46 illustrate jarring member embodiments, usable within the system and method embodiments of the present invention.
Figure 37:
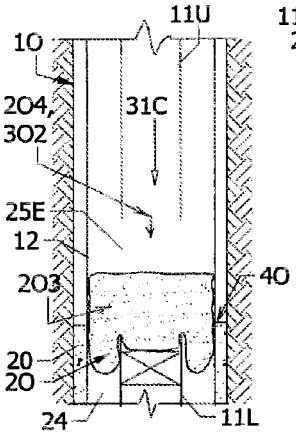

After cessation of production, the internal conduits (11C, 11D) may be severed and annular pistons (2D4, 2D5), e.g. 2N5 of FIG. 33, 2O2 of FIG. 37 and/or 2Q of FIG. 39, are usable to abandon the upper portions (4D3) across the primary barrier (3D2) at the production casing (12) shoe (16) and upper portion (4D4) across the primary barrier (3D3) of the conductor (14) casing by compressing severed well equipment downward, and potentially aiding said compression with a jarring member, e.g. (2T2 of FIG. 42), and rheological controllable fluid member (2T1) of FIG. 42, after which the upper portion of the wellhead (7), attached conduits and valve tree (10A) may be removed with, e.g. rig-less abrasive cutting, to return the ground level (121) to its original condition.

FIG. 20 depicts a diagrammatic elevation view of a slice through the subterranean strata, with break lines representing removed portions, showing a prior art hydrocarbon well completion for subsequent rig-less abandonment (171B), associated with FIG. 21, and using embodiments of the present invention, that depict a valve tree (10) with production valves (64) engaged to a wellhead (7), which is engaged with conductor (14), intermediate casing (15), production casing (12), perforating gun penetrated (129) liner (19) and production tubing (11), that can be controlled by a safety valve (74) via a control line (79), extending axially downward through pressure and fluid permeable strata formations (95G-95K) and relatively impermeable strata formations (94A-94K). The primary factor affecting all abandonment design of any subterranean well (171B) is the subterranean strata (94A-94K and 95G-95K), which may vary significantly from one well to the next, even within the same producing region which may potentially cause the abandonment design and the usable member embodiments to vary. Various types of production packers (40, 40B, 40C) can be used to segregate producible zones used, e.g., to control water production, wherein a bottom plug (25F) was used to isolate a water wet producible zone (95G), encountered during construction of the well.

FIG. 21 is a diagrammatic elevation cross section view through the strata, with break lines representing removed portions. The Figure shows embodiments of a method (1E) usable with a set (2E) of axially slideable annular blockage bypass (2E1, 2E5), axial conduit shredding (2E2), jarring (2E3), annulus boring access (2E4), circumferential milling (2E6), annular piston (2E7) and abrasive particle cutting (2E8) members, which can be usable for permanent rig-less abandonment of the well shown in FIG. 20, depicting suspension and marginal production recovered prior to final well abandonment.

A axially slideable annular blockage bypass member (2E1), e.g. (4M) of FIGS. 28 to 30, is usable to bypass the lower packer (40C of FIG. 20) and place a cement well barrier element (3E1) to abandon the lower portion (4E1), opposite a strong impermeable formation (94C of FIG. 20), after which an axial conduit shredding member (2E2), e.g. (2BR of FIGS. 135 to 140 with the motorized member (2BN) of FIGS. 124 to 127), may remove conduits around the sliding side door (123) which was allowed to fall downward and on top of which a cement barrier (3E2) may be placed, by bullheading the circulatable fluid column into the permeable producible zone (95H of FIG. 20) to abandon the next portion (4E2) of the well.

Figure 62:
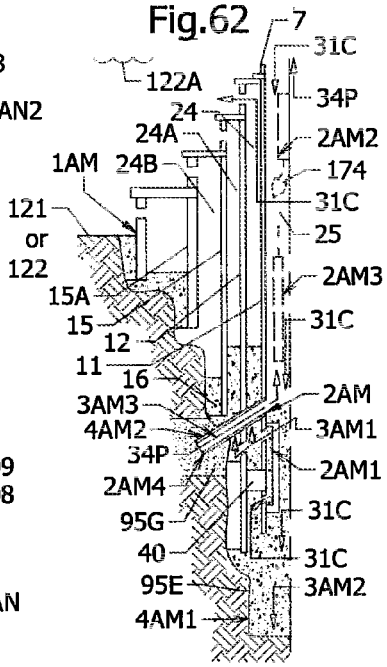

Because the liner (19 of FIG. 20) top represents a potential leak path, a jarring (2E3) member is usable against a jarable surface, such as a piston or rheological controllable member, to compress equipment and place a well element barrier (3E3) to further isolate and permanently abandon the lower portion (4E2) of the well, before suspending the abandonment and side-tracking with an annulus boring access member (2E4), e.g. (2AM4) of FIG. 62, to provide marginal production from a formation (95J of FIG. 20), that may not have been initially completed, e.g., because it presented a risk to the more favourable producible zones (95H and 951 of FIG. 20). After producing the side-tracked formation (95J of FIG. 20) the side-tracked portions (4E3) are abandoned by penetrating the conduits and placing an axially slideable annular blockage bypass member (2E5) over the penetrations to further place a well barrier element (3E4), using circulation to place cement within the annulus and inner bore.

During the previous abandonment, suspension and side-tracking operations, hazardous well substances, e.g. LSA scale, may be injected and abandoned into a fracture (18), formed for disposal purposes, that now comprises a portion (4E4) of the well that must be abandoned to protect a permeable ground water producible zone (95K). A circumferential milling member (2E6), e.g. (2AY1, 2AY2) of FIG. 74 or (2BP1-2BP4) of FIGS. 128 and 129, can be usable to remove the tubing (11) and production casing (12) so that a cement well barrier element (3E5) can be bull-headed into the fractures (18), thus abandoning the portion of the well (4E5) adjacent to the water table producible zone. Subsequently, an annular piston member (2E7) and method, e.g. (1BF) of FIGS. 94 to 99, can be usable to compress the conduits and safety valve (74) downward, so that a cement barrier (3E6) can be placed to abandon the uppermost portion (4E6) of the well, after which a boring pinning member, e.g. (1Z) of FIG. 49 and an abrasive particle cutting (2E8) can be usable to remove the wellhead in one piece with a crane, so that the ground surface (121) could be returned to its original state.

Additionally, while the rig-less abandonment method (1E) may comprise numerous steps and members with an increased time to implement, when compared to a drilling rig abandonment, the overall cost of the abandonment is, in practice, significantly less than that of a rig (163, 164, 165 of FIGS. 1, 2 and 3, respectively), because the work involves a limited amount of equipment and personnel, e.g. the rig-less abandonments (166A, 166B or 166C) of FIGS. 5, 6 and 7 respectively, that are generally available at a significantly lower cost per unit of time, and wherein they are usable with the present invention to meet the published minimum industry recommended guidelines (211-220 of FIG. 15).

FIGS. 22 to 26 and 26A depict elevation views of slices through fluid filled passageways showing method (1F-1K) embodiments usable for blocking associated passageways, permanently or temporarily, until another well barrier element member can be placed, using rheology controllable and annuli placeable fluid members (2F-2K) that comprise either conventional fluids or rheological controllable fluid slurry embodiments (32, 33), which can be usable with a circulatable fluid column (31C) and the flow regimes described herein to, in use, seal and/or support other conventional and invented members. The Figures illustrate various arrangements of fluid member placement. A rheology controllable and annuli placeable fluid member (2F-2J)

may comprise any conventional fluid or fluid slurry that can be usable for well abandonment, e.g. conventional gradated particle mixtures, or an embodiment of the present invention comprising a first fluid with a high concentration of a hydrated organophillic clay that can chemically react with hydratable cement and/or a second fluid, e.g. oil based mud, forming a viscous "gunk" (32) material. The gunk (32) material can be entrained with gradated mixtures of hard non-swellable and swellable particles (33) that chemically react with a reagent fluid, placed at the point of use or transported with the particles, to form a "swelling or expandable fluid slurry" that can be capable of providing a well barrier element member that is placeable, usable and/or removable, with the ease of the removal dependent upon the formulation being non-hardening and access. Fluid members (2F-2K, 3F-3K) can be deployable using rheological flow regimes and/or with separating upper (221B-221D) and lower (221A-221C) axial movable and sealable member plugs, which can comprise, e.g., conventional separating viscous non-reactive polymer fluids, mechanical separating plugs or alternatively a container, such as coiled slickline string deployable bailers. The reagents can be separated by the movable and sealable member plugs and can be controllably mixable using rheological flow regimes, as the plugs exit the segregating arrangement or bottom of the conduit (11) and fluid circulates upward within the various flow regimes, e.g., bubble flow (223), as the lighter and denser fluids interact, followed by slug or plug flow (224), for comparatively large volumes of the first fluid, or churn flow (225), for comparatively smaller volumes of the first liquid in relation to the second fluid, with some annular flow (226) and/or wispy annular flow (227) occurring at directional changes or in higher fluid friction passageways at the walls of the conduits.

Swellable particle well annuli abandonment expandable packs may be of any shape (2K1-2K4 of FIG. 26A) and comprised of uniform (2K of FIG. 26A), coated (2K2 of FIG. 26A) and/or layered (2K3, 2K4 of FIG. 26A) hydrocarbon reactive, water reactive or other swellable fluid reactive materials, that can be fluidly deployable within a well's plurality of passageways, wherein coatings can be applied to swellable materials or a film may inhibit swelling during deployment, that dissolves when placed and/or exposed to chemical reagents at a selected well passageway location and that aid forming a matrix when broken or dissolved, thus exposing the swellable materials to a reagent to cause packing of a gradated particle mix.

Various laminar and turbulent flow patterns of multi-rheological and/or multi-phase flow are possible when placing a well barrier element member or annulus engagable member of the present invention, e.g. swellable particle well annuli abandonment expandable packs, depending on the frictional characteristics of the flow passageway and the rheological properties, densities and velocities of the fluids. Two or more fluids of differing rheologies and densities, comprising two or more liquids and/or liquids and gases passing through a well passageway, can take any of an infinite number of possible forms; however, these forms can be classified into types of interfacial distribution, commonly called flow regimes or flow patterns. The regimes encountered in vertical flows include: Bubble Flow (223), where a first fluid is continuous, and there is a dispersion of a second fluid of differing rheological properties within causing a bubble effect within the first fluid; Slug or Plug Flow (224), where the second fluid bubbles have coalesced to make larger bubbles which approach the diameter of the passageway; Churn Flow (225), where the slug flow bubbles have broken down to form an oscillating churn regime; Annular Flow (226), where the first fluid flows on the wall of the tube as a film (with some of the first fluid entrained in the core of the second fluid flow in the centre); and Wispy Annular Flow (227), whereas the fluid flow rate is increased, the concentration of drops in the second fluid core increases, leading to the formation of large lumps or streaks (wisps) of the first fluid.

Rheology controllable and annuli placeable fluid members (2F-2J), comprising the embodiments of, e.g., abandonment gunk (32) with packable gradated swellable and/or non-swellable particles (33), have the desirable features of being easily placed within tight spaces, such as well annuli and permeable zones where, degraded conduits, partially collapse conduits, debris from milling or shredding conduits, and/or reservoir fractures exist, to, in use, provide a pressure bearing seal, by using their liquid and/or packed particle arrangement with a controllable rheology at placement and chemical reaction with surrounding or placed fluids. The chemical reaction of gunk (32) can be visualized as the hydrated organophillic clays mixing with the oils and suspended weighting particles, such as barite, in the oil based mud to form a gel like substance or clays mixed with cement to form a settable hard substance. The chemical reaction in a swelling gradated particle mix (33) can be visualized as gradated hard particles (191 of FIG. 26A), such as porcelain beads, sorted sand and gravel, or any other hard material to form a contacting matrix with pore spaces filled by smaller gradated non-swellable and/or swellable elastomeric particles (192 of FIG. 26A), which can fit within packed pore spaces and swell when exposed to, e.g., hydrocarbons, thus further packing the matrix of contacting particles to form a gradated swelling particle mix (33) that can be capable of bearing pressure.

The gradated particle mix (33) may be transported via the circulatable fluid column in, e.g., water or non-hydrocarbon gunk (32) components, and then mixed or dumped into a hydrocarbon fluid to swell and form a packer within, e.g., well annuli. As gunk (32) can be a hydrocarbon based formulation, with the swelling gradated particles (33) added to the gunk during mixing or when placed on top of the gunk in a plurality of placement stages, with the lighter hydrocarbons rising through the particles from the gunk (32) and being usable to swell gradated particle mixes (33), deployed separately or together, and dependent upon the swelling time of the particles once exposed to the reagent. Gunk (32) and swellable gradated particle (33) mixes can be compressed with the circulatable hydrostatic fluid column (31C) by applying pressure from the wellhead downward to further pack, compact, and/or solidify a gradated particle mix. Selectively controlling the mix of gradated particles (33) and low gravity solids of the gunk (32), placed within a well space, and forcing excess mobile fluid or gels of the gunk (32) from pores of the swellable gradated particle mix (33) can leave a packed matrix of hardened particles with pore spaces completely filled by either swellable particles or low gravity solids from the gunk to form a bridge across the walls of well conduits, which can be capable of holding more significant pressure to, e.g., hold a significant column of cement or act as a temporary production packer for further marginal production, prior to final abandonment of a well.

Gunk application is not generally practiced within industry because it involves a reaction similar to the flash setting of cement. As a result, its practice is generally confined to regional applications where lost circulation presents a larger risk than said flash setting. While gunk is practiced in drilling applications where formation fractures and lost circulation are prevalent, it is not practiced within well abandonment. However, as demonstrated herein, the present invention provides a significant improvement in abandonment by providing methods for its controlled placement, mixing and application, providing improvement relating to the inclusion of packable gradated swellable and non-swellable particles with gunk to form a fluid placeable pseudo packer pressure bearing particle matrix within annuli. Various formulations of gunk can be summarised, for example, by a first fluid mix of organophillic clay of 5% to 60% by weight of composition mixed with a hydratable gelling agent, sufficient to suspend the clay concentrations, and with weighting material and alkaline source components placed within 15% to 60% water by weight of composition. The first fluid can be then mixable and chemically reactable with at least a second fluid comprising 15% to 60% water by weight of composition, and mixed with either: i) a hydraulic cement of 15% to 75% by weight of composition or an oil based mud comprising 15% to 60% oil by weight of composition, mixed with weighting materials of 15% to 75% by weight of composition. Accordingly, various fluid rheological controllable embodiments of the present invention may provide a gradated mix of packable swellable and/or non-swellable gradated particles with gunk to provide a fluid deployable pressure bearing packing or matrix with gunk filled pore spaces.

As the gunk (32) member is a cementation and/or gelatinous mixture with optional packable swellable and/or non-swellable gradated particle mixes, it can form, for example, a pressure bearing packer embodiment, that relies on the friction between the reacted gelatinous rheological fluids and/or particles, such that the gunk members can be selectively and readily placed, used and then removed with chemicals that disperse the bonds, causing the gelatinous rheology, for reducing the swelling of, e.g., elastomers between hard particles and/or for dislodging the gels or particles with, e.g., wireline deployable motors, tractors and bits of the present inventor and/or other means.

FIG. 22, an elevation cross section diagrammatic view, illustrates the left half of a well conduit for a method (1F) embodiment, with a set (2F) of fluid members and separating plug (221A, 221B) members that can be usable with, e.g. production tubing (11), within another conduit. For example, production casing (12) can be used where the method (1F) involves circulating the fluid column (31C) between the innermost bore (25) and the production annulus (24), and through, e.g., the lower end of the tubing (11), a placed boring bit engagable conduit member (e.g. 2BI2 of FIGS. 112-116) or penetrations, thus, displacing a lighter and less dense fluid, such as water, with a more viscous and dense fluid, e.g. a well barrier element (3F) like cement (20) or a annulus engagable rheological member (2F) like gunk (32), within the portion of the well (4F) to be used and/or abandoned. The formation of a gunk (32) to, e.g., support a subsequent placement of cement, can occur by using two displacements, with the first step of displacing the water with a saturated highly concentrated hydrated organophillic clay fluid, and a second step of mixing the reagent fluid comprising dense and viscous oil based mud, similar to that used in drilling operations, to, e.g., provide a viscous gunk (32) capable of limited pressure sealing and/or support of another dense fluid, e.g. cement.

Referring now to FIG. 23, a diagrammatic elevation cross section of the left half of a well conduit is depicted, showing a method (1G) embodiment and fluid members (2G) usable with, e.g. production tubing (11), within another conduit, such as production casing (12), where the aim can be to circulate the fluid column (31C) between the annulus (24) and innermost bore (25) to place a rheology controllable and annuli placeable fluid member (2G), e.g., a swellable gradated particle mix (33), to abandon a portion of the well (4G), with the lower bridge across the larger conduit (12) walls comprising, e.g., a gunk member (32) or a piston member (e.g. 2AG of FIG. 56). The swellable gradated particle mix (33) can be deployed by circulating it into position and allowing the particles to fall onto a supporting member. A gunk fluid member (32 of FIG. 22) deployed in this manner may involve pressure injecting the gelatinous mixture downward into, e.g., any leaking portions of a crushing piston arrangement (e.g., 2AG of FIG. 56 or 2X2 of FIG. 46).

FIG. 24 is a diagrammatic elevation cross section of the right half of a well conduit, which depicts a method (1H) embodiment usable with fluid members (2H) within, e.g. the intermediate casing (15) and with a smaller conduit, e.g. the production casing (12), which has been expanded outwardly into the intermediate casing annulus (24A) by a piston member (2H1). The method (1H) involves bullheading fluids of the circulatable fluid column (31C) past the partial closure, caused by the deforming of the casing (12) inward by the piston member (2H1), using a well barrier element member (3H), e.g. cement, or a rheology controllable and annulus placeable fluid member (2H3), e.g. gunk (32), to close and seal the annulus (24A) at the closure (2H1). The fluid mixtures can enter through a boring bit engagable conduit member (2H2), e.g. 2BI2 of FIGS. 112-116, or through penetrations in the inner conduit (12) with, e.g., churning (225) and wispy flow (227) at the intersection, with denser fluid falling in annular flow (226).

Referring now to FIG. 25, a diagrammatic elevation cross section view of a method (1I) embodiment and fluid member set (2I), which can be usable with a well conduit, e.g. production tubing (11), within another conduit, such as production casing (12), where the portion of the well to be used and/or abandoned (4I1, 4I2) comprises the tubing (11) and casing (12) walls and a leaking bridge (4I1) across the walls of the casing. Conventionally, placing cement (20) involves mixing the chemical components at the surface and transporting them downhole with any misalignment of fluid levels (3I1), equalized (3I2) by the u-tube effect of the cements higher density. The method (1I) for placing a rheological controllable fluid, e.g., gunk (32) and gunk particle mixes (32, 33) comprises separately placing fluid well barrier elements (3I1-3I2) or fluid annulus engagable members (2I1-2I2), e.g. cement (20), gunk (32) or swellable gradated particle (33) components separated by plugs (221A-221C) that fall after conveyance through the innermost passageway (25); and allowing mixing of the fluids in the annulus (24) with, e.g., churning flow (225), caused by rocking the inner (25) and annulus (24) passageways upwards and downwards (2I1) with alternating pressures applied between the passageways at the wellhead openings to the annuli; followed by allowing the fluids to u-tube or equalize (2I2) at similar levels with density and/or to apply equal pressure from above to compact, e.g., gunk into the portions (4I1, 4I2) of the well, to be used and/or abandoned for assisting the packing of the gradated hard particles (191 of FIG. 26A) the mix until the swelling intermixed gradated particles (192 of FIG. 26A) support, e.g., cement, above the gunk.

FIG. 26 is a diagrammatic elevation cross section view of method (1J) and member set (2J) embodiments comprising boring bit engagable conduit, separating placement plug, rheological controllable fluid gunk and packable gradated particle mix members, usable with well conduits comprising, e.g., the intermediate casing (15), production casing (12) and tubing (11), where a plug (25A) is installed within the innermost passageway (25), connected to surrounding annuli (24, 24A) by a boring bit engagable conduit member (2J5, 2J6 similar e.g. to 2AQ1 of FIG. 66) penetration, with an expandable burstable seal sleeve (2J4 similar e.g. to 2AR2 of FIGS. 67 and 68) across the upper perforating gun or boring bit member penetrations (129). The lower boring bit engagable conduit member or penetrations were placed, then the lead and tail components of, e.g., a gunk (32) pill, separated by the lower separating placement plug members (221A, 221B), were transported by circulating the circulatable fluid column (31C) to mix as the fluids separated from the segregating plugs, once they entered the penetrations and annuli, to form a rheological controllable fluid gunk (32) annulus engagable member (2J1) in one annulus (24) and optionally (2J2) in the surrounding annulus (24A).

The upper penetrations and second plug train can be placed after placing the gunk or the expandable burstable sleeve, which is burst during packing and/or mixing of the gunk. The second plug train, with (221C 221D) separating members containing a swellable gradated particle (33) member (2J3), can be circulated downward using the fluid column (31C), by pumping through the innermost passageway and taking returns through the upper penetration (2J6 or 129) to release (222), e.g., the swellable gradated particles (2J3) through the upper annulus accesses (2J6 or 129) to the production annulus (24) and, optionally, any surrounding annuli (e.g. 24A), where the particles (33) are supported by the gunk until their swelling from the hydrocarbons in the gunk, supports their mass, providing one or more sealed annuli, thus closing and pressure sealing the lower portion (4J) of the annuli to placement and support of a more permanent well barrier element member (3J). Member placement within the annuli does not remove access to the innermost bore (25) because mixing occurred in the annulus, and the plug members (25A, 221A-221D) may be of a retrievable or boreable type. Plug members, whether axial movable separating plugs (221A-221D) or supporting plugs (25A), can comprise any form of pumpable conventional segregation means during placement, such as pumpable foam balls, cross-linked polymer fluids, darts and/or convention coiled string deployable devices. For example, a first portion of a rheological member can be placed using the circulating column, with the remaining second reagent portion of the member deployed with a conventional slickline bailer, that can be conveyed on a coiled slick line string, through a stagnant circulatable fluid column to dump the reagent from the bailer onto the first portion. Thereafter, the bailer can be removed and circulatable fluid column flow orientation cycled, if further mixing is required.

Additionally, chemical injection, using penetrations or embodiments of the present invention, may occur into or under the annuli gunk (32) and particle (33) placed members (2J1-2J3) to remove the unsettable fluid seal when required. Hence, fluid circumferential engagable members (2J1-2J3), e.g. gunk, are placeable, usable and removable when required.

FIG. 26A depicts a diagrammatic view of a method (1K) embodiment that can be usable with the rheology controllable and annuli placeable fluid member (2K) embodiment, comprising a mix (2K1-2K4) of non-swellable, hard gradated particles (191) for forming a bridging matrix across the wall portions (between 4K1 and 4K2) of one or more conduits to abandon a portion of a passageway and/or potentially support a permanent well barrier element (3K). Hydrocarbon or water swellable gradated particles (192) within a passageway may have pores between the harder particles (191) of the gradated mix (2K), that can be filled by the swelling particles (192) that, when exposed to hydrocarbons, or e.g. water, form a bridging seal, and/or other substances, e.g. the low gravity solids of an oil based mud used in a gunk or other conventional lost circulation materials (LCM), such as graphite or calcium carbonate, which are also usable within pore (131) spaces. Gradated hard particles (191) may be consistent throughout or partially comprised of swellable materials (192), e.g., a hard round particle member (2K2) may be coated in a swellable material, or vice versa, having any shape, e.g., a square particle member (2K3) and/or pentagonal particle member (2K4) may consist of layers and/or corners, and/or any irregular sand and/or gravel shaped or sized particles with sharp or rounded edges to form a settable/swellable hardened matrix across a wall of conduit or passageway after swelling of the swellable materials and/or filling of the pore spaces within the matrix. Dependent on the deployment and reactive reagent swelling fluids, particles may be, e.g., water or hydrocarbon swellable, and particles may be coated with a film to inhibit exposure to the swelling reagent fluid during transport.

FIG. 27 depicts an elevation view of the left half of a slice through a well and strata, depicting embodiments of a method (1L) usable with a set of members (2L) comprising logging tool (2L1), axially slideable annular blockage bypass (2L2) and annulus boring access (2L3) members. The Figure illustrates the abandonment of an onshore or offshore wellhead (7), above ground level (121) or mudline (122) and being disposed below the ocean's surface (122A). A annulus boring access member (2L3), e.g. 2AD of FIG. 53, has been used to bore through conduits (11, 12) engaged axially below the wellhead (7) to access annuli (24, 24A), within which a logging tool member (2L1) was used to measure the presence of primary well barrier elements (3L3, 3L4) about casing (12, 15). Having determined the necessary subterranean depths, placement of a well barrier element (3L2), to meet published industry recommended minimum guidelines (211-220 of FIG. 15), is attainable with an axially slideable annular blockage bypass member (2L2), e.g. (2M) of FIGS. 28 to 30, installed to provide flow about a production packer (40), allows a well barrier element (3L1) to be bull-headed into the permeable open hole producible zone (95E) by using the circulatable fluid column (31C1, 31C2), circulated down (31C1) the inner passageway and taking returns through the annuli (24, 24A) or down (31C2) the annuli and up the inner passageway (25), to place the second well barrier element (3L2). The method (1L) abandons the well's lowermost portion (4L1) and intermediate (4L2) portion, above the production casing shoe (16). During the process, the strata may have been fractured (18) with hazardous waste materials and fluids injected (36W) through the intermediate annulus (24B) into the strata, with the following step of the method (1L) being the abandonment of the fractured well portion (4L3).

FIGS. 28 to 30 are diagrammatic elevation views of a slice through a subterranean well and strata showing embodiments of a method (1M) for using an axially slideable annular blockage bypass member (2M), with break lines showing removed sections of the well and strata. The Figures illustrate a portion (4M) of the well, between break lines, to be used and/or abandoned. The member (2M) is placeable with a coiled string (187) running tool (187A), relative to upper (129U) and lower (129L) penetrations in the production conduit (11) within the cemented (20) production casing (12), with string tension and a setting pressure (31C3) applied to engage the tool slips (e.g. 180 of FIG. 93) of an engaging tool portion (2ME) to the inner conduit (11). Thereafter, the running tool (187A) can be retrieved with the coiled string (187) by, e.g., applying pressure to the innermost bore (25) against the closed wellhead valves of the annulus (24), with upward jarring of the assembly. The axially slideable annular blockage bypass member (2M) can be operated by circulating down (31C2) the annulus (24) and up the inner most passageway (25), through the upper penetrations (129U) and ports (2MP) in the slideable section and the engaging portion (2ME) of the member (2M), engaging the tubing (11). The circulated fluid column (31C2) can actuate the slideable portion (2MS) of the member (2M), upward, to disengage the lower penetrations (129L) for circulating through ports in its sliding portion. Alternatively, the member (2M) may be operated by circulating down (31C1) the inner passageway (25) and up the annulus (24), through the upper (129U) and lower (129L) penetrations between the member (2M) and the production tubing (11), wherein the pressure of the circulated fluid column (31C1) can actuate the slideable portion (2MS) of the member (2M) downward to engage the lower penetrations (129L), thus closing the ports (2MP) within its slideable portion. The method (1M) can be completed when a well barrier element (3M) is circulated (31C1) into the bore (25) and annulus (24) to abandon a portion (4M) of the well.

The member (2M) may be replaced, within the method embodiment (1M) with a cable-compatible, rig-less operable, non-slideable straddle that can cover penetrations above (129U) and below (129L) the production packer (40), to a fixed circulation path, for cleaning walls of conduits and placing cement. The axially slideable annular blockage bypass member (2M) can represent a significant improvement over a fixed conventional straddle because it can be usable to hydraulically change the circulation path to clean the tubing with reverse circulation and/or to hydraulically jar and pack, e.g., LCM, gradated particles mixes and/or piston members into an annulus and/or permeable strata formation to seal the formation, while minimising the risk of losing the ability to circulate.

For example, when circulating as described in FIG. 29, the production valve can be closable on the valve tree that is engaged to the wellhead to cause pressure to be applied to the bottom of the slideable part (2MS), pushing it downward, thus causing circulation through the lower penetration and hydraulically jarring, albeit lightly for the purposes of packing, the production annulus under the packer, with alternating opening and closing of the valve tree master or production valve during said jarring. Alternatively, when circulating as described in FIG. 30, the annulus valve may be closed to hydraulically jar the portion of the well below the tubing (11). Finally, alternating between the circulations in FIGS. 29 and 30, combined with closing valves for light hydraulic jarring of packings, allows the placement and compaction or packing of a rheological controllable fluid, gradated particle mixes, swellable materials and/or LCM into a permeable formation until the formation locks-up, or quits taking fluids, after which the circulating path may be re-established for controlled placement of a well barrier element, such as cement. In conventional practice of bullheading, this is not possible, because when the cement is bull-headed to a formation it "locks up," with no means by which to re-establish circulation or clear the tubing. Hence, access is lost and the conventional practice of bullheading represents a significant risk that is avoidable with the use of the method (1M) for a conventional straddle member or an axially slideable annular blockage bypass member (2M). The slideable member can allow an intermediate circulation point above the packer to remove a heavier fluid, e.g., cement, that for any reason stops flowing, so as to remove the cement before it sets with a second reverse circulation to restore the circulation passageways, after first removing the excessive hydraulic head of the heavier cement above the packer.

Figure 38:
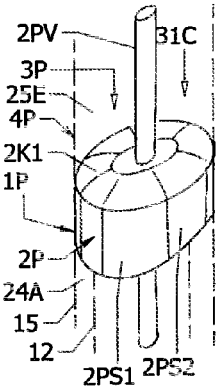
Figure 46:
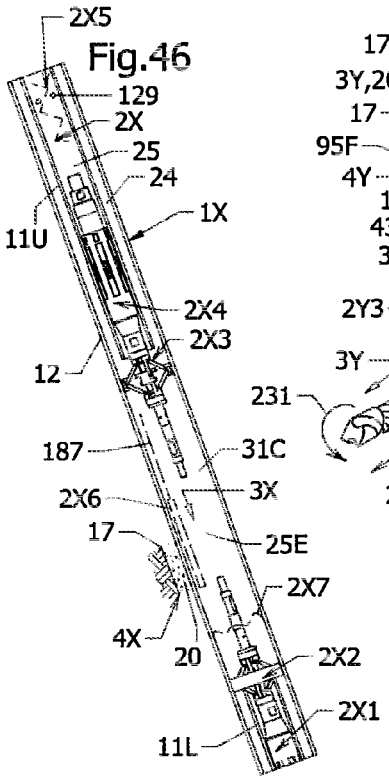

Additionally, straddles and axial slideable straddles can be placeable through the innermost bore (25) and can be usable in an enlarged innermost bore (25E, 25AE of FIG. 72) to, e.g., circulate around a placed annulus blocking member or a collapsed portion of casing, using the increased diameter capabilities of expandable packers (e.g. 2X2 of FIG. 46 or 2K of FIG. 38).

FIGS. 31 to 34 show diagrammatic elevation cross section views of embodiments of a method (1N) usable with a set (2N) of members comprising an axially slideable annular blockage bypass (2N2), annular piston (2N4), rheology controllable and annuli placeable fluid (2N1, 2N3, 2N5), boring bit engagable conduit (2N6), logging (2N8) and circumferential shredding and milling (2N7) members. The Figures depict a slice through the strata and a well's perforated (129) production casing (12), engaged with a permeable formation (95F) formerly produced through a conduit (11) engaged to the casing (12) with a packer (40), with production equipment (11A), e.g. a nipple or valve, forming part of the production string (11).

The lower portion (4N1) of the well can be used and/or abandoned by cutting the lower end of the conduit (11) with, e.g., a rotary cable tool cutter (175 of FIG. 75) for reliable cement placement about the packer (40), with well barrier element (3N1) comprising a swellable particle cement gunk fluid member (2N1), e.g. (2K1) of FIG. 26A, placed with separating wiper plugs (221A-221D of FIG. 26) and mixed, using various flow patterns (223-227 of FIG. 22), dependent on the rheology and degree of turbulent flow caused by the pumping rate when bullheading into the permeable zone (95F). The clay based gunk and swellable graded particles can be usable to form a hard particle matrix that can react with each other during mixing and/or after if, e.g., any hydrocarbons attempt migration through the mixture, to form a barrier (3N1) to support a further permanent barrier (3N2). Alternatively, LCM, gradated particles, other conventional packable materials or embodiments of the present invention, may be placed, hydraulically jarred, and packed by an axially slideable annular blockage bypass (2N2).

The intermediate well portion (4N2) of the casing (12) may be cemented (20) within the strata bore (17) by the placing of upper (129U) and lower (129L) penetrations in the tubing (11), then placing an axially slideable annular blockage bypass (2N2) across the packer (40) and penetrations to, in use, controllably place a permanent well barrier element (3N2) above the rheology controllable and annuli placeable fluid (2N1). Alternatively, packable materials may replace the member (2N1) with the axially slideable member (2N2) used to hydraulically jar and pack the materials into the permeable perforations (129), to the reservoir, until solid support for placement of the well barrier element (3N2), that prevents gas migration during setting of the cement (212 of FIG. 15), is achieved so as to control cement placement.

Figure 49:
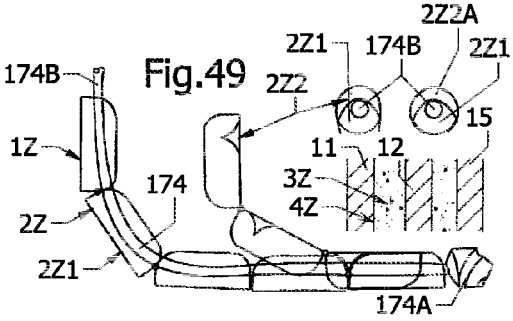

The upper well portion (4N3), comprising the intermediate (15) and uncemented production (12) casing within the strata bore (17), may be used and/or abandoned by cutting the tubing (11) and using an annular piston (2N4), comprising, e.g., a conventional cement umbrella with a rheology controllable and annuli placeable fluid member (2N3) or conventional graded particle abandonment material member, which can be placed using various methods (1G of FIG. 23, e.g.), or a clay based gunk embodiment that can be placed, e.g. with method (1I) of FIG. 25, to compress the conduit (11) and associated downhole equipment (11A) under the annular piston (2N4), axially downward, by placing pressure on the circulatable fluid column (31C) for the inner bore (25) and/or production annulus (24), to allow space for use of a logging member (2N8). In this instance, the logging member (2N8) found no cement behind the production casing (12), and a pinning boring bit engagable conduit (2N6), e.g. (1Z) of FIG. 49, is usable to engage and support a well barrier element (3N4) and to secure the conduits (11, 12) during removal of the lower ends with a circumferential shredding and milling (2N7) member, e.g. (2BP1-2BP4) of FIGS. 128 and 129, to place the well barrier element (3N4), thus abandoning the portion (4N3) above the cemented casing (15) shoe (16).

Figure 35:
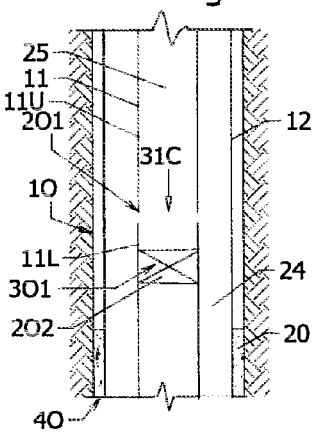
Figure 36:
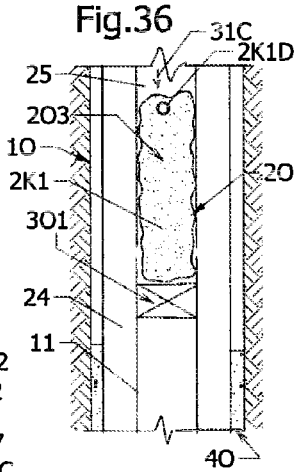

FIGS. 35 to 37 show elevation views of a slice through a subterranean well passageway and strata, with break lines representing removed portions, and depict embodiments of a method (1O) usable with a set (2O) with a circumferential engagable member (2O1) comprising any conduit cutting device, two annular piston members (2O2, 2O3), and a logging tool member (2O4), depicting placement of, e.g. a conventional wireline plug, that can be usable as a annular piston member (2O2) and engagable with the annulus (24), after using the circumferential engagable cutting member (2O1), e.g. (175) of FIG. 75, to cut the tubing (11U, 11L). The piston (2O2) can be usable as a well barrier element (3O1) and can be usable to compress the tubing (11L) below the piston member (2O2) for placement of a second piston member (2O3) or, e.g. a rheology controllable and annuli placeable fluid above the compressed tubing to form an enlarged innermost passageway space (25E) for cement, in addition to supporting the cement placed above the piston (2O2) and preventing it from falling through the annulus (24) below.

The second piston member (2O3) may comprise a loose bag made of, e.g., Kevlar, to prevent puncture from sharp edges within the well bore and can be filled with a rheology controllable and annuli placeable fluid member of gradated hard and swellable materials (2K of FIG. 26A) that may fluidly move loosely within the bag to allow deployment through the innermost passageway (25) using pressure from the circulatable fluid column (31C). The force of the fluid column can be further usable to burst a disc (2K1D) fitted with a screen to allow a reagent fluid of, e.g. water or hydrocarbons, to cause swelling of the inner gradated particle mix, with a mesh to prevent escape of the gradated particles (2K of FIG. 26A). Pressure applied to the expanded or swollen bag can force compressional bending or crushing of the tubing, which may also have been cut and weaken prior to placing the first piston (2O1), until, e.g., sufficient space is created for use of a logging tool member (2O4) to determine if a well barrier element (3O2), such as cement may be placed, using the circulatable fluid column (31C), to abandon the lower portion (4O) of the well.

FIG. 38, a diagrammatic isometric view of a method (1P) embodiment usable with an annular piston member (2P) embodiment, with segmented portions and a relief valve, illustrates abandoning an intermediate casing (15) portion (4P) of a well without cement, within the intermediate annulus (24A), by compressing the production casing (12) to form an enlarged innermost passageway (25E) with a segmented (2PS1, 2PS2, etc. . . . ) deformable bag that can be transportable through an innermost passageway (e.g. 11 of FIG. 41) and used to retain a piston shape, and/or membrane filed with gradated and/or swellable particles (e.g. 2K of FIG. 26A). A pressure regulated one way valve (2PV) can be added to allow fluid movement through the bag piston member (2P) to, e.g., allow a reagent fluid, e.g. water, to enter the segments and chemically react with swellable materials (2K of FIG. 26A) and/or allow fluid, from below, to exhaust upward when being forced down by pressure of the circulatable fluid column (31C), for placement of a well barrier element (3P). In this instance, the inner conduits (11 of FIG. 36) have been cut with the lower end (11U of FIG. 37) compressed downward, after weakening of the casing (12) with apparatus described in the referenced application GB1011290.2, and/or using a tractor embodiment of the present invention to weaken or push the conduits downhole.

FIG. 39 shows a diagrammatic elevation view of a slice through a subterranean well and strata and depicts embodiments of a method (1Q) usable with an annular piston member (2Q), with break lines representing removed portions. The Figure shows the abandonment of a portion (4Q) of a casing (12) that is cemented (20) within a strata bore (17), after the piston member has exited a cut conduit (11U). The piston member (2Q) comprises a deformable bag (2QB) engaged with, e.g., slips (2QS), to a conduit (11L) and filled with conventional gradated particles, e.g., gradated sand or cement, or a gradated swellable particle member (2K of FIG. 26A), whereby a breakable membrane may be used to temporarily isolate, or a deployable tool may be used to engage, either the bag or conduit connection (2QC) to instigate a swelling reaction with the mixing of a swellable gradated mix and reagent fluid, during or after said bag is deployed through the innermost passageway (25) of the upper end of an installed conduit (11U) that has been cut. The engagement (2QS) holds the lower end of the cut conduit (11L), and applied pressure from the circulatable fluid column (31C) forces it downward by, e.g. crushing or helically buckling the lower conduit column (11L) until the bag exits the upper conduit (11U) and falls into the annulus (24) within the casing (12). Thereafter, the trapped fluid can be released through the pressure relief one-way valve (2QV). After logging of the cement (20) behind the casing (12) and placement of a well barrier element (3Q), comprising, e.g., a cap or plug to isolate the valve (2QV) engaged to the upper connector (2QC), cement may be placed on top of the entire member (2Q).

Figure 40:
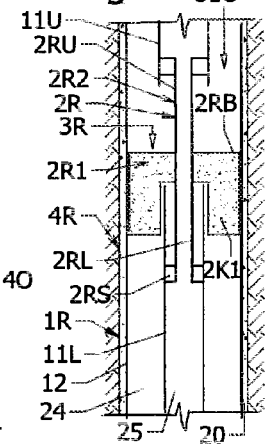

FIG. 40 is a diagrammatic elevation cross section view with break lines representing upper and lower removed portions of a slice through a subterranean well bore, which shows a method (1R) embodiment usable with a set (2R) of a straddle pipe member (2R2) or an axially slideable annular blockage bypass, e.g. (2M) of FIGS. 28 to 30, adapted with annular piston member (2R1) embodiments. The annular piston member (2R1) embodiments can be usable in combination, as a production packer, to form another member (2R) embodiment to fluidly isolate a lower portion of the well (4R) with a well barrier element (3R) comprising a deformable bag (2RB) and/or another barrier, e.g. cement, axially above supported by the bag. A lower piston portion (2RL) with a bag (2RB), filled with package conventional gradated material or filled with swellable gradated packable materials capable of isolating fluid flow in the annulus (24) after falling from the bore of the upper cut conduit (11U) and engaging the circumference of the casing (12), is further engaged (2RS) to the lower end of a cut conduit (11L). After forcing the piston member portion (2R1) downward with the circulatable fluid column (31C), logging can confirm cement behind casing and a straddle member portion (2R2) and upper straddle portion (2RU) may be engaged to the piston member portion (2R1) and upper conduit (11U) to form a pseudo production packer with an internal bore and blocked annular space.

Figure 41:
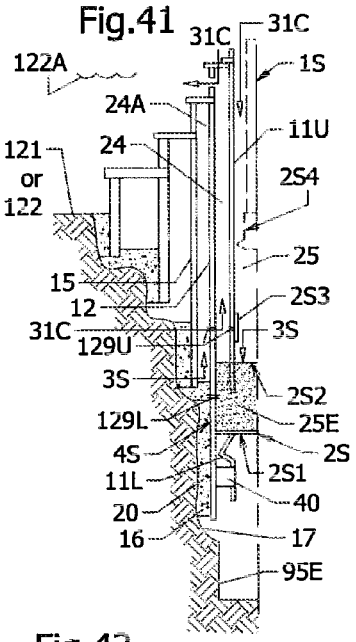

FIG. 41, a diagrammatic elevation view of the left half of a slice through a surface (121) or seabed (122) subsea well, below the ocean surface (122A) and subterranean strata, depicts embodiments of a method (1S) usable with annular piston (2S1), rheology controllable, and annuli placeable fluid (2S2), swellable expandable mesh membrane members (2S3) and jarring (2S4) members. The Figure shows placement of a well barrier element (3S) for abandoning a lower portion (4S) of the well. As shown, operations begin with cutting the tubing (11U, 11L), placing a piston member (2S1), and using applied pressure to the circulatable fluid column (31C) to compress the lower portion of the tubing (11L) secured to the casing (12), which is cemented (20) within the strata bore (17), with a production packer (40) and casing (12) shoe (16) above a producible zone (95E). The annular space (24) is increased, both, by applied pressure to the piston (2S1) and by jarring the fluid column (31C) with a jarring member (2S4), comprising any conventional jar suitable for the task or an embodiment of the present invention, e.g. (2T2) of FIG. 42, operated with the innermost passageway (25) conduit (11U).

A logging member can be usable, then, within the enlarged inner passageway space (25E) above the piston member (2S1) to determine the primary cement (20) level and/or bond between the strata wall (17) and the production casing (12), thus allowing selective placement of a lower penetration (129L) through the casing (12) at the required depth. For subsea wells, the annulus access passageway to annuli, other than the production annulus (24), are generally not readily available. Thus the intermediate annulus (24A), between the production casing (12) and intermediate casing (15), is not easily accessible. On surface wells, the annulus access valves may also be unusable if, e.g., the valves are seized or were never installed. Such conventionally inaccessible annuli can be accessed with, e.g., a boring member to penetrate the wells of the conduits.

Upper penetrations (129U) through the production tubing (11U) and casing (12) were then placed and a swellable expandable mesh membrane member (2S3) was placed to cover the penetrations in the tubing (11U), so that a circulation path is possible through the intermediate annulus (24A), using the circulatable fluid column (31C). Weighted abrasive cleaning and/or viscous fluids can be usable to choke the pore spaces of the expandable mesh or, e.g., a cleaning reagent may activate swelling of a membrane to close mesh pores, after which circulation through the passageways can continue until the surfaces are sufficiently clean and wettable to provide a good bond with the subsequent fluid well barrier element (3S), potentially using the jarring member (2S4) to help initiate circulation within the intermediate casing (15) annulus (24A), after which the well barrier element member (3S) is placed.

Referring now to FIG. 42, a diagrammatic elevation cross section view through a subterranean well and strata, with break lines representing upper and lower removed portions, is shown and illustrates embodiments of a method (1T) usable with a member set (2T), comprising rheology controllable and annuli placeable fluid (2T1), jarring (2T2), annular piston (2T3) and swellable expandable mesh membrane (2T4) members. A casing leak (228B) to a subterranean fracture (18) prevents applying sufficient pressure (229) to force the piston member (2T3) axially downward within the casing (12) with the circulatable fluid column (31C). A swellable expandable mesh membrane member (2T4) can be placed across the tubing leak (228A) to allow the pressurization of the tubing (11U) to drive a hydraulic jar member (2T2) that can be placeable within the inner passageway (25), and can be operated with deployment string (e.g. 187 of FIG. 9) tension and fluid pressure (229) to act against a rheology controllable fluid member of, e.g., circulatable viscosifying materials and LCM, or a gelatinous gunk usable to seal the leaking (228) fracture (18) and any leakage (228C) about the piston (2T3) member for compressing the lower tubing (11L). With sufficient space created by driving the piston downward, a logging member can be used to measure the cement bonding behind the casing (12) and a well barrier element (3T), such as cement, can be placed for abandoning a portion (4T) of the well, wherein excess viscous fluids and LCM are circulated out or gunk is removable using a rotary cable configuration with, e.g. a tractor member, wherein after cleaning of the conduits, the piston (2T3), with any remaining viscous fluid or remaining gunk (2T1) members above the crushed section, can be usable to support the barrier (3T) placement to meet the appropriate industry practices (211-220 of FIG. 15).

The use of rheology controllable fluid (e.g. 2T1) and swellable expandable mesh membrane (e.g. 2T4) members, comprising, e.g., conventional high viscosity materials, LCM, conventional expandable conduits and/or embodiments of the present invention, can be usable within any of the present invention method embodiments (1A-1BU of FIGS. 16 to 147) for accessing and abandoning wells where during use, over the life of the well, its structural integrity may have been weakened or removed, thus preventing full pressure control. A rheology controllable fluid and/or swellable expandable mesh membrane members can be usable to temporarily or permanently reinstate pressure control by, e.g., placing a well barrier element (3A-3BU of FIGS. 16 to 147) to abandon a portion (4A-4BU of FIGS. 16 to 147) of a well.

The jarring member (2T2) can be operable and usable, e.g., with cable string (187) tension to lift the lower portion of the jarring member piston and to compress its acceleration spring (144), where it is latched into the upper portion and engaged to the tubing (11U), after which pressure may be applied to the inner passageway (25) to release a fluid pressure pulse (230), that is increased by the release of the compressed spring, with the jar piston acting against the rheological fluid member (2T1), engaged with the piston member (2T3), to further drive it down with a fluid hammer effect. The upward reflected fluid hammer effect (230U) can be further controllable by, e.g., placing a pressure relief valve on the annulus outlet (13 of FIG. 16 or 13A of FIG. 17).

Figure 43:
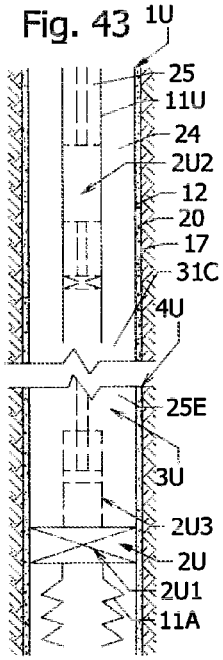

FIG. 43 shows a diagrammatic elevation view of a slice through a portion of subterranean wellbore and strata and depicts a method (1U) embodiment usable with the member set (2U) embodiment, comprising a jarring (2U2) embodiment, conventional jarring member (2U3) and annular piston member (2U1 for illustrating that a significant length of enlarged innermost passageway (25E), represented between the break lines, can be formable for deep wells of, e.g., 10,000-ft or 3,000 meters, with long conduit strings capable of being compressed, buckled, crushed, shredded, milled or otherwise demolished. If, e.g., accounting for various subterranean parameters, such as inclination and frictional resistance within the casing (12), the lower end of a cut conduit (11L) can be compressible by 25% over a length of 1000 meters, an enlarged inner passageway space of 250 meters can be usable then for logging of cement (20) behind casing (12) and placement of a well barrier element member (3U) to abandon a portion (4U) of the well, whereby the adverse effects of various subterranean parameters, e.g. dog-legs, inclination and friction, may be lessened by various jarring members (2U2, 2U3).

The jarring member (2U2), shown as a dashed line to represent any usable configuration, also applies to explosive charge hydraulic jarring effects upon a piston member (2U1) to displace any conduits (11A) axially downward, thus providing an enlarged innermost passageway (25E). The possible usable configurations include, but are not limited to: i) a compressed air or gravity deployable ram type jarring arrangement, similar to a pile driver engaged to the top of the wellhead or valve tree for jarring the entire fluid column, ii) an explosive charge tool using a series of light explosives capable of exploding within and jarring the circulatable fluid column (31C) without incurring lateral or upward damage to well components, and iii) sudden release of displacing gases within the circulatable fluid column comprising, e.g., compressed air and/or nitrogen that suddenly releases the displaced liquid fluid column, allowing a jarring plug or slug to accelerate downward while releasing gasses upward. The jar functions by suddenly releasing the energy stored in the deployment string, associated subassembly and/or circulatable fluid column (31C) when the jar fires. In a manner similar to using a hammer, kinetic energy is stored in the hammer as it is swung and suddenly released to the nail and board when the hammer strikes the nail. The method (1U) comprises the use of a conventional mechanical or hydraulic jarring member (2U3) and/or a jarring member embodiment (2U2) to further compress the piston member (2U1), e.g. (2X2) of FIG. 46, where a conventional jarring member (2U3) may be engaged with the piston member (2U1) or a fluid hammering jar (2U2) engaged to the circulatable fluid column (31C) jarring the piston member (2U1).

Figure 44:
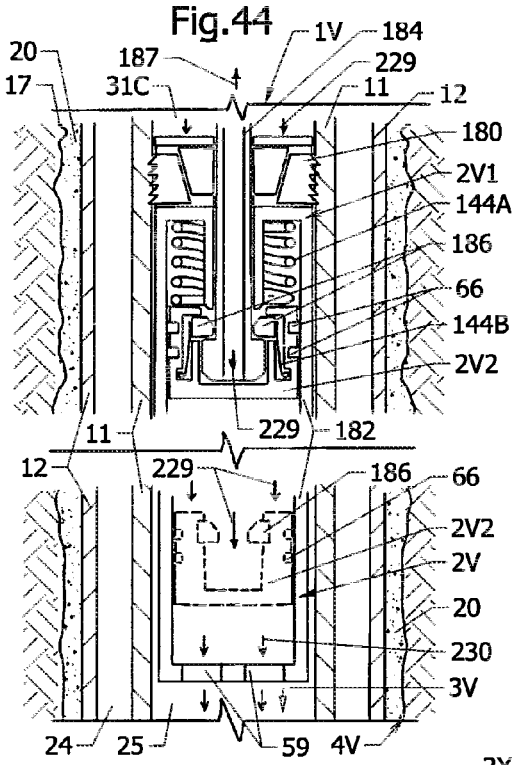

Referring now to FIG. 44, a diagrammatic elevation cross section view with break lines representing removed portions is shown, and the Figure depicts a method (1V) embodiment of separate portions of a jarring member (2V) embodiment usable to compress members and/or well barrier elements (3V), showing the jar piston (2V1) prior to firing in its latched position, above the dashed line representation of the jar piston (2V2), during firing. A piston housing (182) provides a cylinder for the jar piston (2V2), usable with seals (66), to hold the energy from pressurizing (229) and compressing the circulatable fluid column (31C) above and against the piston, e.g., with fluid communication through an internal bore of the travelling rod (184) from the fluid column until the springs (144B), holding the latching dogs (186), are urged away from the travelling piston rod (184) to release the compressed energy of the fluid column and fire the jar piston, creating a fluid pulse (230) with its motion, equivalent to a fluid hammer with its initial motion assisted by an accelerating spring (144A), wherein the fluid pulse passing through orifices (59) of the housing (182) can be usable to fluidly impact or jar downhole apparatuses, e.g. 2O3 of FIG. 36, axially downward.

A viscous rheological controllable fluid member may be placed within the annulus (24) between the tubing (11) and casing (12) to further increase the axially downward jarring force by retarding fluid movement and compression upward. Line tension of the string (187) can be usable to hold the jar (2V1) in place while pressure (229) can be used to engage the slips (180) and to anchor the jar to the circumference of the conduit (11), after which the travelling rod (184) can be usable to re-engage the latching dogs (186), after the jar has fired. Pressure (229) can be used to keep the slips (180) engaged and to push the travelling rod past the dogs' (186) springs (144B), with the piston lying against the bottom of the orifice (59) housing (182).

Figure 45:
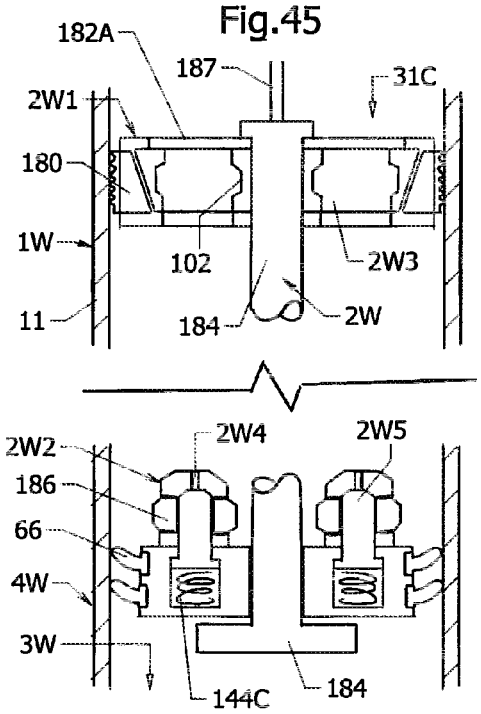

FIG. 45 depicts a diagrammatic elevation view of a slice through an installed well conduit, with break lines representing a removed portion of a method (1W) embodiment. The Figure shows upper and lower portions of a jarring member (2W) embodiment, and illustrates the jar housing (182A) in the upper portion of the Figure and a jar piston (2W2) that has fired and now rests on the bottom of the travelling piston rod (187) at the lower portion of the Figure. The jar piston (2W2) travels along the jar rod (184) when firing, with the rod (184) lifting the piston (2W2) after firing, for relatching into the housing (187A). Through repeated firing and relatching, the member (2W1) can be usable to compress members and/or well barrier elements (3W), e.g. conventional cement mixtures, rheology controllable gradated particle and/or organophillic clay and cement members, to abandon a portion (4W) of a well.

The jar (2W1) may be re-latched by pulling line tension on the string (187) to lift the travelling piston rod (184) and piston (2W2) at its lower end to engage and latch the dogs (186) within the housing receptacle (2W3) recess (102). During latching and firing, pressure may be applied through the pressure port (2W4) to force the locking pin (2W5) downward, against the locking pin spring (144C). When in latching position, pressure may be removed with the locking pin (2W5) spring (144C), forcing the dogs (186) into the receptacle (102) of the housing (182A). Then, the travelling piston rod (184) can be axially lowered to prepare the jar (2W1) for firing. Repressurizing the circulatable fluid column (31C) above the member can be usable to compress the circulatable fluid column, thus storing energy, and providing pressure through the ports (2W4) to the locking pin (2W5), which will depress the springs (144C), at a definable pressure, and the locking pin to release the dogs (186) from the receptacle (2W3, 102) and to fire the piston, which allows the sudden release of the stored energy in the compressed fluid to drive the piston and to cause a fluid pressure pulse axially downward as the piston (2W2) travels to the end of the rod (184). The amount of stored energy released is controllable with selective placement of the piston, wherein compressing a relatively large volume of fluid above the piston and applying it to relatively small value of relatively incompressible fluid below the piston, results in the largest release of energy. As a consequence, the jar piston (2W2) can be usable to induce a fluid pulse or hydraulic hammering effect on downhole apparatuses axially below when, e.g., the tool is arranged and positioned so as to place the lower end of the travelling rod at rest on conduits, apparatuses or piston members being jarred, so that the piston travels a short distance to an intermediate stop engagement on the travel rod, such that the lower end of the rod delivers a mechanical jarring force as the piston strikes the intermediate stop engagement.

If the slips (180) are extended, e.g., by an expandable centralizer (2X3 of FIG. 46) that is engagable to the casing (12 of FIG. 46) circumference and the jar piston (2W2) is usable on the casing (12 of FIG. 46) circumference, e.g., (2X2) of FIG. 46, the jarring member (2W1) can be usable to hydraulically and/or mechanically jar on the downhole apparatus (e.g. 2U1 of FIG. 43) within an enlarged innermost passageway (25E of FIG. 37). The method (1W) can be usable to easily engage the slips (180) with the circumference of the tubing (11) or casing (12 of FIG. 46) when latching the piston (2W2) to the housing (182A), using well pressure against string tension, and to disengage the slips (180) when jarring upward using, e.g., a conventional mechanical/hydraulic jar engaged to the upper end of the member (2W1), when the circulatable fluid column is not hydraulically pressurized. Thus, the member (2W1) can be usable to hydraulically and mechanically jar upon conduits and associated apparatuses while chasing the compressed conduits and apparatus as they are forced downhole.

Referring now to FIG. 46, an elevation view of a slice through two installed well conduits, inclined within a directional well, is shown and the Figure depicts embodiments of a method (1X) usable with a set (2X) of jarring (2X5 shown as a dashed line), conventional logging (2X6), annular separation (2X3, 2X4) and piston (2X1, 2X2) members supplemented by a rheological controllable viscous fluid sealing member (2X7), usable to abandon a portion (4X) of a well. As shown in FIG. 46, an upper (11U, also shown in FIG. 42) and lower (11L) conduit is cut and forced apart to form an enlarged innermost passageway (25E), by a piston member (2X2) engaged to the lower end cut conduit (11L) and forced downward by pressure exerted on the circulatable fluid column (31C) and a jarring member (2X5) for placing a well barrier element (3X). After forming sufficient height (219 of FIG. 15) for placement of a well barrier element, e.g. cement, within the enlarged innermost passageway (25E) between the innermost passageway (25) and conventional sized annulus (24), a logging member (2X6) can be usable to confirm cement (20) between the casing (12) and strata bore (17). Geologic records during drilling of the well may be used to confirm a strong impermeable formation, with primary cementation behind the casing (218 of FIG. 15) confirmed by logging (2X6). A hanger (2X4) and expandable separating member (2X3) can be usable to provide stand-off (211 of FIG. 15) for sealing both sides of the tubing (11U) in cement (217 of FIG. 15), thus embedding (215 of FIG. 15) all conduits (11U, 12) in cement, once placed through the tubing bore (25) and penetrations (129), using annular flow (226 of FIGS. 22 and 24) on the lower side of the casing (12), with the lighter fluid of the circulatable fluid column (31C) returning through the upper part of the annulus (24).

Figure 48:
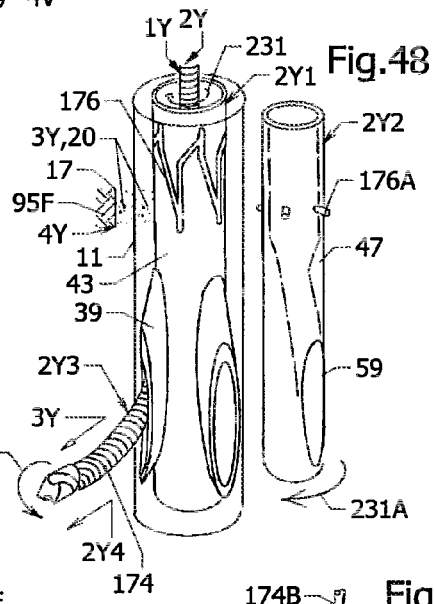
Figure 47:
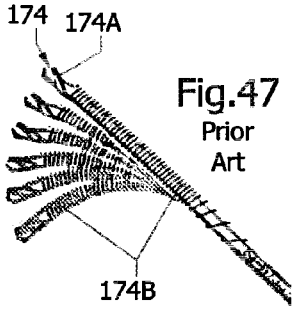

FIG. 47 is a diagrammatic elevation view of an example prior art flexible shaft and boring bit (174), showing a rotatable boring bit (174A) on a flexible (174B) rotatable shaft that are usable to form bored penetrations of well conduit and strata walls selectively through a guiding surface (2Y1, 2Y2 of FIG. 48).

Referring now to FIG. 48, a diagrammatic isometric view, showing embodiments of a method (1Y) usable with a set (2Y) of annulus boring access (2Y3) and annular access guiding member parts (2Y1, 2Y2) with only a portion (4Y) of the well strata and barriers (3Y, 20) is depicted. The Figure illustrates a flexible shaft and boring bit (174) guided by a chamber junction (43) and bore selector (47), which can be usable to, e.g., access and/or penetrate a wall of the conduit (11) through which it was deployed, including, e.g., any surrounding conduits, and the strata wall (17) to place logging members (2Y4) and/or to access a producible zone (95F) for production and subsequent placement of a well barrier element (3Y). The flexible shaft and boring bit (174) can be rotatable (231), retrievable, and replaceable through the exit conduit (39) of the chamber junction (43) and orifice (59) of the bore selector (47), which is also rotatable (231A), when not in conflict with the shaft and bit (174), using rotational guidance prongs (176) and associated guidance surfaces (176) to align the bore selector orifice (59) with the exit bore conduit (39), when the bore selector (47) is placed within the chamber junction (43). With reciprocation of the bore selector (47), flexible shaft, and boring bit (147), a plurality of selectively placeable penetrations through the walls of well conduits and the subterranean strata may be carried out.

Figure 76:
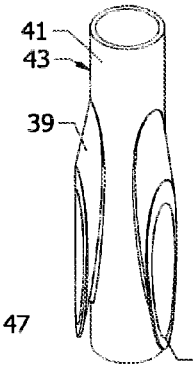
Figure 77:
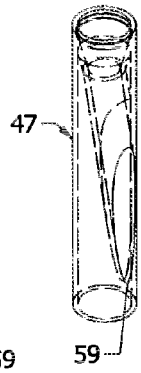

FIGS. 76 and 77, are isometric views of a chamber junction (43) and a rotatable bore selector (47), respectively, with dashed lines showing hidden surfaces in FIG. 77, illustrating that a bore selector can be insertable within the chamber (41) of a chamber junction (43) and usable as a selective guiding member with the orifice (59) of the chamber junction, and bore selector can be alignable to selectively access an exit bore conduit (39). For example, piston, separating, fluid, flexible shaft and boring bit embodiments can be usable with a chamber junction and bore selector within the innermost passageway of a well to selectively bore or enter a wall penetration, to access and re-access a plurality of penetrations through various conduit and strata bore walls, thus acting as a penetration selectable guiding member.

Figure 79:
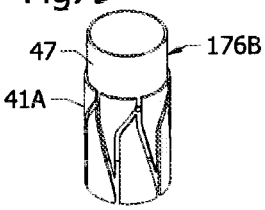
Figure 78:
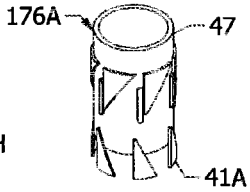
Figure 78:
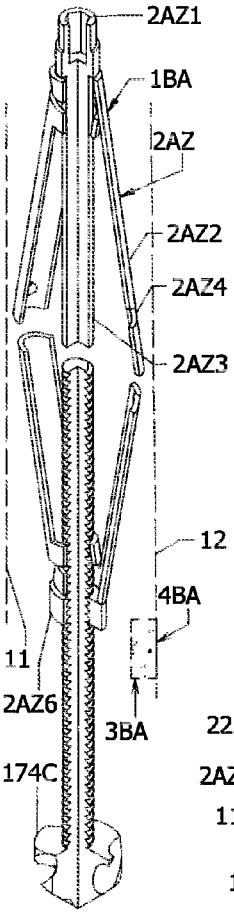

Referring now to FIGS. 78 and 79, isometric views of ratcheting rotational guides (176A (also shown in FIG. 48) and 176B, respectively), depicting a bore selector's (47) upper or lower end and a guiding surface of the chamber (41A) of a chamber junction, wherein any guiding surface shape, such as a helical surface, is usable to align a bore selector orifice (59 of FIG. 77) with an exit conduit (39 of FIG. 76) orifice (59 of FIG. 76) to selectively engage exit conduits (39 of FIG. 76) for engagement of, e.g., a boring bit with the wall of a conduit or the strata wall when using or abandoning a well.

FIG. 49 is a diagrammatic elevation view of a method (1Z) embodiment usable with embodiments of a conduit pinning and separating member (2Z) and boring bit engagable conduit (2Z1 and 2Z2) members, with only a portion (4Z) of the well elevation radial cross section shown below an upper right hand transverse side view elevation cross section of only the pinning shaft member's (2Z1, 2Z2, 2Z2A, 174B) diameters in differing left hand side and right hand pinning shaft configurations, shown in the upper right side. The Figure illustrates how a flexible shaft and boring bit (174) may be used to bore through conduits (11, 12, 15) with the flexible shaft (174B) usable alone or as a spine for linked partial conduit members (2Z1) that may be combined with securing and/or stiffening partial conduit members (2Z2, 2Z2A). The stiffening conduit member (2Z2) may be arranged with the linked member (2Z1) to pin the conduits (11, 12, 15) before their consolidated removal or to support a well barrier element (3Z) placed within an annulus. The stiffening member may become a securing member (2Z2A) if its collapsible edges are secured about the linked member (2Z1) to prevent the assembly from separating. If the stiffening member (2Z2) is not collapsed about the linked member (2Z1), then they may become separated after passing through the penetration in the wall of a surrounding conduit, preventing the boring bit (174A) from being retrieved and allowing the flexible shaft (174B) to be tensioned to separate conduits, thus creating standoff (211 of FIG. 15) for placement and support of a piston member and/or well barrier element (3Z). Boring bit engagable conduit members, whether comprising pinning supports or fluid passageways, selectively placed from the innermost passageway, can be usable to engage and support axial movable piston members and/or well barrier elements, placed from above the boring bit engagable conduit pinning members to, in use, selectively place axially piston and barrier members at a selected depth within the annuli of a well.

Referring now to FIG. 50, an elevation view of the left half of a slice through a subterranean well and strata is shown, and depicts embodiments of a method (1AA) usable with a member set (2AA) comprising annulus boring access (2AA1) and swellable expandable mesh membrane (2AA2) members, illustrating boring through the tubing (11) and casings (12, 15) to access the annuli (24, 24A, 24B), then placing of an swellable expandable mesh membrane (2AA2) to repair the bore through the tubing (11). The circulatable fluid column may be circulated in (31C2) through annulus (24B) wellhead (7) accesses and returned through other annuli (24, 24A) wellhead accesses (13) to place heavy cement, e.g., well barrier elements (3AA1, 3AA2) to abandon a portion of the well (4AA) strata wall (17) where a water producible zone (95F) exists below the intermediate casing (15) shoe (16), using channelled flow (226 of FIGS. 22 and 24) with lighter fluids travelling upward and heavier fluids travelling downward. A series of borings (2AA1) and expandable membranes (2AA2) may be used at various depths to systematically clean conduit walls (11, 12, 15), with the fine particulates resulting from cleaning the sand screen like expandable mesh permeability, to provide clean water wet surfaces for good well barrier element (3AA1, 3AA2) bonds (113 of FIG. 15). Additionally, if the tubing (11) is breached and the wells integrity has been lost, the method (1AA) can be usable to restore well integrity for further production from the producible zone (95E) by, e.g., applying the mesh membrane (2AA2) and using the sliding side door (123) to place, e.g., cement in the production annulus (24) with the cement closing the mesh's permeability to repair the breach. Use of swellable expandable mesh membrane (2AA2) for placement of cement in the production annulus is a significant improvement over conventional expanded tubing patches, because there is a high probability that the condition of the tubing, which caused the first breach, will lead to further breaches that cannot be repaired with a single patch, but can be repaired by the present method (1AA) because the permeability of the mesh provides pressure relief to prevent collapse of the tubing while the cement is hardening and allows release of free water associated with cement setting, unlike a solid tubing patch.

FIG. 51 depicts a diagrammatic elevation cross section view showing embodiments of a method (1AB) usable with a set (2AB) of annulus boring access member (2AB1), logging tool (2AB2) and boring bit engagable conduit (2AB3, 2AB4) members, with dashed lines showing the hidden surface of the flexible shaft (174B). The Figure illustrates tracking of the flexible shaft and boring bit (174) guided through orifices (59) of a guidance member, selectively orienting the annulus (24) access conduit carrying boring member (2AB1), adjusting operating line tension and the fluid column pumping rate to selectively control direction, and measuring its position by reflecting (173D) a signal (173C) back to the broadcasting and receiving logging tool (2AB2) member, engaged to the guiding member and tubing (11) with slips (180). The carried conduit member (2AB3) has a rotatable cutting portion (2AC1 of FIG. 52), rotatable by the flexible shaft (174B) passing through the bit (174A) carried conduit, further usable to place a well barrier element (3AB) to abandon a portion (4AB) of the well accessed by the conduit (2AB3). The flexible cable can be usable with an expandable carried conduit by, e.g., pulling the bit (174A), which acts as an expander, through the carried conduit (2AB3) to expand the conduit against the sidetrack bore (59T) of the tubing (11), after which a secondary rotatable cutter (2AB4) may be used to severe the expanded carried conduit (2AB3) engaged to the tubing (11) at the sidetrack (59T).

Referring now to FIG. 52, a diagrammatic elevation view of a slice through a boring bit engagable conduit member (2AC) embodiment is shown, which can be usable with a method embodiment (1AC) depicting a carried conduit (2AC2) with an engaged independent rotatable (231) cutting conduit (2AC1) at its lower end, which may be driven with a gear teeth (174AT) engagement to rotationally coincide and bore with the rotatable (231) bit (174A) of the flexible shaft (174B) and bit assembly (174). The circulatable fluid column (31C) may be pumped (31P) through orifices (59) of a housing with rotation of the bit (174A) to lubricate boring. The method (1AC) can be usable to, e.g., bore through one or more walls of a well to place a well barrier element (3AC) in a portion of the well (4AC), that can be accessed through the wall penetration made by the member (2AC).

FIG. 53, a diagrammatic elevation cross section view of a method (1AD) embodiment of a boring bit engagable separating or conduit member (2AD) embodiment, illustrates a flexible shaft (174B) and rotatable bit (174A) engaged to a stiff conduit section (2AD3), bent housing (2AD2) and more flexible conduit section (2AD1), which can be usable to directionally control boring direction and orientation during boring, e.g. with a boring separating member (2AZ of FIG. 80-82) forming the stiff conduit section (2AD3). Thereafter, a separating member may be expanded or a member apparatus can be placed with a well barrier element (3AD) placed through a bored penetrated wall portion (4AD) of the well.

FIG. 54, a diagrammatic elevation view of the left half of a slice through a subterranean well and strata shows embodiments of a method (1AE) usable with a member set (2AE) of annulus boring access (2AE1), annular piston (2AE2) and rheological controllable gradated particle (2AE3) members, depicts a bored hole through the tubing (11) and casing (12, 15) that can be usable to place annular pistons (2AE2, 2AE3), e.g. (2AG) of FIG. 56 or (2AI) of FIG. 58, in the production annulus (24) inflated to collapse the tubing (11) to provide a radially inward movable piston, and can be further usable for well barrier element (3AE1, 3AE2, 3AE3) support to prevent cement movement, slumping and gas migration while setting (212 of FIG. 15), to abandon a portion (4AE) of the well and to isolate the producible zone (95E). The well barrier elements (3AE1, 3AE2, 3AE3), e.g. cement, are placeable below the intermediate casing (15A) cement (20) shoe (16) using the circulatable fluid column (31C) through the tubing (11) bore (25) and annuli (24, 24A, 24B) exiting or entering the wellhead annuli accesses (13), depending on circulation orientation, and settling at a common depth using u-tubing forces (312 of FIG. 25). Also, rheological controllable gradated particle (2AE3) members may be replaced by, e.g., bladder or swellable pistons (2AF of FIG. 55) or a coiled bladder piston member (2AK of FIG. 60).

Referring now to FIG. 55, a diagrammatic plan view of a slice through a well bore and strata showing a method (1AF) embodiment usable with an annular bladder or swellable piston (2AF) member embodiment, showing fillable bladder and/or swellable piston elements (2AF) placeable, e.g., through the inner tubing (11) passageway (25) and wall penetration bore made by a flexible shaft and boring bit member that can expand within the annulus (24) between conduits, e.g. the tubing (11) and production casing (12) cemented (20) with a strata bore (17) wall portion (4AF) to act as, and/or to support a well barrier element (3AF). If the elements (2AF) are inflated or otherwise over expanded, they are usable to form (2AG) of FIG. 56.

FIGS. 56 and 58 are diagrammatic plan view cross sections through a well bore depicting method (1AG, 1AI, respectively) embodiments usable with an annular bladder or swellable annular piston member (2AG, 2AI, respectively) embodiments, and the Figures illustrate fillable bladder and/or swellable piston elements (2AG, 2AI) that can be placeable, e.g., through the inner tubing (11) passageway (25) and bore of the wall penetration made by a flexible shaft and boring bit member, which can expand within the annulus (24) to crush the tubing (11) passageway (25) by expanding between conduits, e.g. the tubing (11) and production casing (12), cemented (20) within a strata bore (17) wall portion (4AG, 4AI, respectively), to act as and/or support a well barrier element (3AG, 3AI, respectively). Rheological controllable fluid gradated swellable particle members can be usable above and/or about the elements (2AG, 2AI) to provide pressure bearing capacity and barrier (3AG, 3AI) support.

Referring now to FIG. 57, a diagrammatic plan view of a slice through a subterranean well bore is shown. The Figure depicts a method (1AH) embodiment usable with a annular passageway separating member (2AH) embodiment, illustrating a fillable bladder or swellable piston element (2AH) placeable, e.g., through the inner tubing (11) passageway (25) and bore made by a flexible shaft and boring bit member, that can expand within the annulus (24) to separate conduits, e.g. the tubing (11) and production casing (12), cemented (20) with a strata bore (17) walled well portion (4AH), to provide stand-off (211 of FIG. 15) for well barrier element (3AH) placement. If the element (2AH) is inflated or otherwise over expanded, it is usable to form (2AI) of FIG. 58.

Referring now to FIG. 59, a diagrammatic isometric view of a placement method (1AJ) embodiment, usable with a set (2AJ) of annular passageway separating member (2AJ1-2AJ3) embodiments, is depicted. The Figure shows a fillable bladder or swellable piston element in various placement positions (2AJ1-2AJ3) after, e.g., being conveyed through the casing (12) enlarged innermost passageway (25E), after compressing the tubing with a different embodiment, then exiting the wall penetration bore made by a flexible shaft and boring bit member through the production casing (12) with, e.g., a guiding member (2BL of FIGS. 119 and 120), and with pressure from the circulatable fluid column (10 of FIG. 36), so as to be longitudinally (2AJ1) placed through the bore with tethers (2AJ4, 2AJ5), and turning the placement position (2AJ2), as the tethers reach their extents, to place the element circumferentially (2AJ3) within the intermediate casing (15) annulus (24A), to, e.g., provide the placement of a fillable bladder or swellable piston element (2AH) in FIG. 57, and wherein three such elements can be placeable as shown in (2AF) of FIG. 55. The tether (2AJ4) can be usable to inflate a bladder type inflatable and/or swellable element by placing a fluid within, e.g. injecting a small quantity of oil into an oil swellable bladder and causing a portion to expand and push the oil to the next portion until the bladder is fully swollen. Alternatively, the tether (2AJ4) may comprise a flexible shaft with a surrounding bladder and auger bit for boring between conduits with the other tether (2AJ5) causing a directional turn within an annulus to bore between and lift or separate the production casing (12) from the intermediate casing (15), thus providing stand-off (211 of FIG. 15). Also, FIG. 59 includes a well barrier element (3AJ), which can be supported by the production casing (12) and/or a wall portion (4AJ) of the intermediate casing (15) or the well.

FIG. 60 is a diagrammatic plan view of a method embodiment (1AK), with conduits (11, 12) shown as dashed lines, that can be usable with a swellable conduit member about a disposable flexible shaft and boring bit member (2AK) embodiment. The Figure shows a helical pattern of deployment within the annulus (24) from, e.g., a helical pathway guide placed within the tubing (11) that coils the swellable conduit (2AK) around the annulus between the tubing (11) and casing (12), wherein a tether (2AJ5 of FIG. 59) can be usable to coil swellable material about an approximate depth with an auger, like boring bit (174A1) usable to auger between and separate conduits (11, 12), to provide standoff (211 of FIG. 15), while retaining axial flow through helical coil for placement of the well barrier element (3AK). After placement, a swellable reagent, e.g. water for a water swellable conduit or oil for an oil swellable conduit, surrounds the flexible shaft of the auger boring bit (174A1) to provide further stand-off for an unpacked coil bored, e.g., in an axial downward orientation or sealing of the passageway if the coils are tightly packed about the tubing (11) by, e.g., boring in an axial upward orientation using gravity a hydraulic jarring member to pack the coil, to support (212 of FIG. 15) a well barrier element (3AK) placed with a annular and gravity slugging flow regimes to abandon a portion (4AK) of the well.

Referring now to FIG. 61, a diagrammatic plan view of a method (1AL) usable with the bladder and swellable piston members (2AL) as a placement embodiment is depicted. The Figure shows a fan or accordion type deployment (1AL) from a compressed position, that can be usable for placing the member (2AL) through the smaller penetration diameters and can be usable to seal or support (212 of FIG. 15) a well barrier element (3AL) to abandon a portion (4AL) of a well, e.g., with the elements (2AF, 2AG, 2AH, 2AI) of FIGS. 55 to 58, after being placed through, e.g., a wall penetrating bore of a flexible shaft and boring bit member.

FIG. 62 depicts an elevation cross section left side view through a subterranean well and strata, showing embodiments of a method (1AM), usable with a set (2AM) of axially slideable annular blockage bypass (2AM1), annulus boring access (2AM2), logging (2AM3) and boring bit engagable conduit (2AM4) members, depicting first abandoning of a producible zone (95E), then side-tracking to a new producible zone (95G) for additional production (34P), prior to final abandonment for an onshore (121) or offshore subsea level (122A) wellhead (7) at mudline (122). Penetrations in the tubing (11) are placeable above the production packer (40), through the tubing (11) and production casing (12), and below the packer (40), through the tubing (11) using an annulus boring access (2AM2) member with a flexible shaft and boring bit (174), after which an axially slideable annular blockage bypass (2AM1) member can be usable to straddle the penetrations and place a cement well barrier element (3AM1) within the annuli (24, 24A), adjacent to the cemented intermediate casing (15) shoe (16), and across (3AM2) the producible zone (95E), to abandon the lower portion (4AM1) of the well using the circulatable fluid column (31C), to place the cement with any of the various flow regimes, after which u-tubing causes levelling of the cement within the annuli (24, 24A).

A boring bit engagable conduit (2AM4) member can then be usable to side-track to the new producible formation (95G), leaving a swellable sheathed and/or expandable conduit within the bore to seal the side-track passageway, after which a logging tool member (2AM3) can be usable to confirm the bonding and to seal prior to production (34P) from the new producible zone (95G). While the new producible zone may not have warranted completion during well construction, e.g., it may now provide sufficient marginal production to delay the cost of final abandonment and therefore may now be economically producible if it can be accessed using low cost cable compatible rig-less operations. Once production from the producible zone is completed, the logging tool member (2AM3) may again be used to determine a bond prior to placing a well barrier element (3AM3) to abandon that portion (4AM2) of the well.

Figure 63:
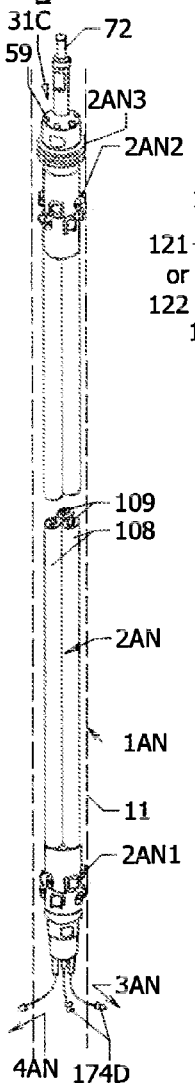

Referring now to FIG. 63, a diagrammatic isometric view of a method (1AN) embodiment, providing a motorized annulus access member (2AN) usable with a plurality of flexible shafts and boring bits (174), is shown. FIG. 63 depicts a plurality of fluid motors, comprising rotors (109) and stators (108) engaged between anti rotation members (2AN1, 2AN2) and operable from a cable engaged to the upper rotary connection (72). The circulatable fluid column (31C) is pumpable and divertible by seals (2AN3), through orifices (59), to rotate the rotors (109) within the stators (108) to consequently rotate a plurality of, e.g., disposable flexible shafts and boring bits (174D), which can be rotationally engaged to the lower end of the rotors (109) for boring through conduits to access portions (4AN) of the well through the resulting wall penetrations and annuli access, for placement of well barrier elements (3AN).

Disposable flexible shafts and boring bits (e.g. 174D) can be usable for various tasks, including the pinning of conduits together prior to abrasive cutting and removal of the wellhead and riser from, e.g., an offshore platform well or providing logging member sensors if, e.g., the flexible shaft also includes wiring or, alternatively, transponders or transmitters for passing a measurement signal to a receiver hooked to another part the well to, e.g., measure the bonding and existence of primary cementation behind the casing and between the casing and the strata from within any annulus.

As an outside diameter of conventional fluid motors can be, e.g., 1.68 inches, they are usable for simultaneous downhole boring of a plurality of small diameter bores, thus it is feasible to provide, e.g., three fluid motors within the 4.67 inch inside diameter of, e.g., a 5½ inch tubing (11), or significantly more with various guiding members, e.g., (2BM) of FIGS. 122 and 123, if flexible shafts are extended to pass with gaps (2AP7) between the fluid motors. While larger motors provide more power for boring larger fluid communicating bores, a plurality of smaller motors with less power and smaller flexible shafts and boring bits are usable to, e.g., provide a plurality of logging sensors for measuring cement bonding and existence, or to improve the helically coiling (1AK of FIG. 60) and bird-nest capability of choking an annulus to support, e.g., placement of a rheological controllable gradated particle member and/or permanent well barrier element through and/or above the bird nested plurality of disposable flexible shafts and boring bits (174D).

Figure 64:
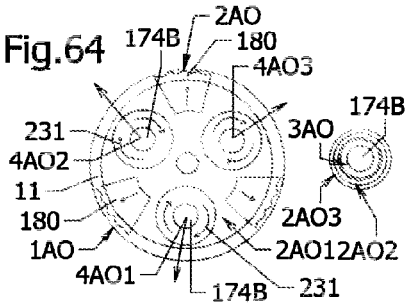

FIG. 64 is a diagrammatic plan view of cross section through an installed well conduit (11), showing a method (1AO) embodiment usable with a set (2AO) of members, shown in a left hand plan view, comprising an annular access guiding member (2AO1) embodiment adjacent to a right hand magnified detail plan view of the flexible shaft (174B) boring bit engagable conduit (2AO2, 2AO3) embodiments. The Figure shows three slips (180) engaged to guiding whipstocks for side-tracking out of the tubing (11) by rotating (231) bits at the end of flexible shafts (174B) to three different portions (4AO1, 4AO2, 4AO3) of a well. For example, one portion (4AO1) may be the conductor annulus (24C of FIG. 65), another portion (4AO2) may be the outer intermediate casing annulus (24B of FIG. 65), and the remaining portion (4AO3) may be the inner intermediate casing annulus (24A of FIG. 65). The outer boring bit engagable conduit (2AO2) can be, e.g., a mechanically expandable metal conduit with the inner conduit (2AO3) being a chemically swellable material, or vice versa, with the rotatable flexible shaft (174B) within, wherein a single conduit or any plurality of conduits, layering, and material types are possible. The annular space between the conduits (2AO2, 2AO3) and flexible shaft (174B) can be both usable for fluid communication and fillable with a well barrier element (3AO) to embed the conduits (2AO2, 2AO3) in, e.g., cement (217 of FIG. 15), wherein filling may also involve inflating a membrane, thus becoming an annular piston member, similar to those described in FIGS. 55 to 60.

Figure 65:
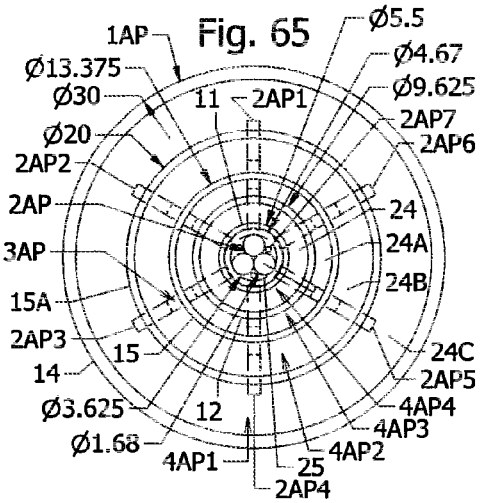

Referring now to FIG. 65, a plan view of a method (1AP) embodiment, usable with a member set (2AP) comprising an annular access guiding (2AP) and annulus boring access or boring bit engagable conduit annulus access member (2AP1-2AP6) embodiments, is shown. The Figure further depicts a common conventional well conduit size configuration below a wellhead of a 30 inch outside diameter (OD) conductor (14), with 20 inch OD outer intermediate casing (15A), 13⅜ inch OD inner intermediate casing (15), 9⅝ inch OD production casing (12), and 5½ inch OD and 4.67 inch internal diameter production tubing within which three 1.68 inch OD fluid motors may be fitted into a 3.625 inch outside diameter side-tracking whipstock guiding member (2AP). The members (2AP1-2AP6) may extend to and access any annulus (24, 24A, 24B, 24C) to place a well barrier element (3AP) in a portion of the well (4AP1-4AP4) or to access a producible zone, instead of using conventional perforating guns, to create larger and longer producible strata wall penetrations than are possible with conventional perforating gun tunnels, where the guiding member (2AP) may be rotated to provide various radial arrangements, such as the one shown, with a rotation of, e.g., 60 degrees using two simultaneous borings of three or six individual borings.

Figure 66:
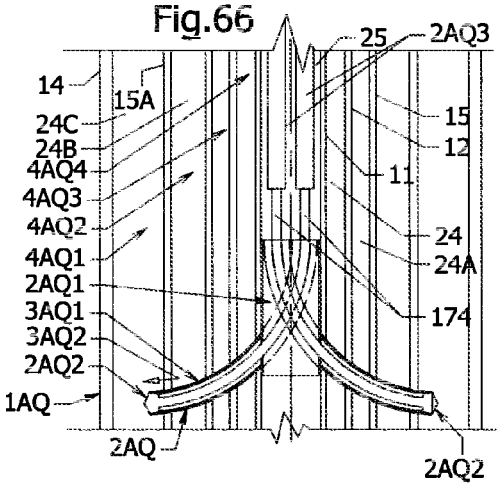

FIG. 66 depicts an elevation view with break lines showing removed well sections of a method (1AQ) embodiment, usable with a set (2AQ) of annular access guiding (2AQ1) and boring bit engagable conduit (2AQ2) member embodiments. The Figure shows a single motor member (2AQ3) and bit conduit assembly (2AQ2) with a flexible shaft and boring bit (174), usable in two opposite positions, where the guiding member (2AQ1) was rotated 180 degrees, and further usable to access portions (4AQ1-4AQ4) of the well, comprising annuli (24, 24A, 24B, 24C) between well conduits (11, 12, 14, 15, 15A), dependent upon the length of the flexible shaft and boring bit or annulus access boring bit and the engagable conduit (2AQ2) member used, wherein a conduit carried by the bit assembly (2AQ2) may be left as a well barrier element (3AQ1) for placing a fluid well barrier element (3QA2) in portions (4AQ1-4AQ4) of the well.

Figure 68A:
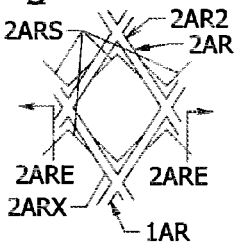
FIGS. 67 to 68 and 68A to 68B illustrate a swellable expandable mesh membrane member embodiment of the present invention.
Figure 68B:
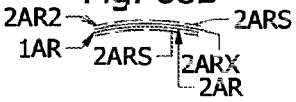
Figure 68:
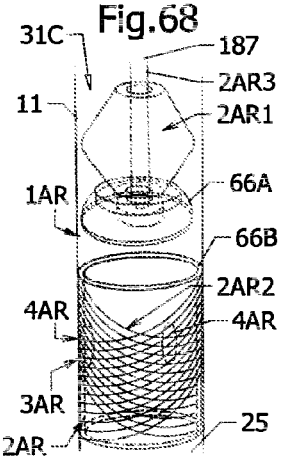

Referring now to FIGS. 67 and 68, diagrammatic isometric views, with dashed lines showing hidden surfaces and FIGS. 68A and 68B showing magnified detail views of a method (1AR) embodiment of a member set embodiment (2AR) comprising a swellable expandable mesh membrane member (2AR2), are shown. The Figures depict a swellable expandable mesh membrane (2AR2) that can be placeable with an expander (2AR1), explosive initiating jar (2AR4) and bottom supporting seal (66A), usable as a temporary LCM barrier until a substantial well barrier element (3AR)

is placeable in the portion (4AR) of a well, comprising a breach or penetration in the tubing (11). A coating or packaging (2AR5) of sealing elastomeric material, LCM, gradated particles and/or a rheological controllable gradated particle members may also be present.

While conventional tubing patch technology is usable with the present invention, its primary purpose and associated cost is for applying a persistent patch to repair breached tubing to an production operable specification, wherein the lost circulation method (1AR) can be usable to place a chokable sand screen, like mesh, to allow pumping while the annulus behind the breach is filled with, e.g., cement to not only repair the obvious breach, but also to remove the potential of further breaches within the worn conduit. The swellable expandable mesh membrane of the present invention provides a significant improvement over conventional expandable tubing patches because it provides a LCM chokable mesh, Tillable with swellable materials, gradated particle mixes, chemically reactive fluids and/or conventional LCM to provide a thin membrane usable to resist circulation pressures for placement of well barrier elements, e.g. placing cement within a production annulus across a leak without creating a significant circumferential obstruction to subsequent tool passage (1AM of FIG. 50). Additionally, e.g., if the membrane is no longer needed or hinders operations, it may be more easily removed with rotary cable tools of the present invention, which can be usable to remove the structural integrity of the mesh with, e.g., a boring bit and tractor. Also, the membrane (2AR2) can be designable as a pressure relief membrane if, e.g., only swellable materials or LCM are only placed within the pore spaces of the mesh, omitting the sealing cement, thus allowing the pore spaces to be cleared or the membrane ruptured, with excess pressure used, to dislodge or break the sealing portions.

FIG. 67 illustrates the member set (2AR) comprising an expandable mesh membrane between an expander (2AR1) and supporting deformable seal (66A), placeable on a cable string (187). FIG. 68 shows the member set (2AR) arrangement after the explosive initiating jar has fired and acted in an axially downward direction to rupture the coating or package (2AR5 of FIG. 67), exposing swellable materials to a swelling reagent, forcing LCM and/or a chemically reacting rheological controllable fluid through the breach or penetration and engaging the expandable top seal (66B) to the tubing (11), providing a seal and allowing pressure to be applied axially downward to continue expansion of the mesh with the circulatable fluid column (31C), while holding string (187) tension. If, for example, electric line is used, the explosive initiating jar may be fired by initiating a signal at surface level, or if slick line or non-electrical braided wire is used, the explosive initiating jar may be set with a timer, pressure and/or other downhole parameters. The explosion of the jar initially forces the top seal (66B) and breaks the coating or package (2AR5 of FIG. 67) with applied circulatable fluid column (31C) pressure, which can be usable to operate the expander (2AR1) axially downward on the dance pole (2AR3) until the supporting seal (66A) engages the dance pole (2AR3) end with fluid exiting the breaches or penetrations (4AR) or through the innermost passageway (25) below the assembly, deforming the supporting seal (66A) downward as the swellable expandable mesh membrane (2AR2) is engaged with the circumference of the tubing (11) to form a well barrier element (3AR) over the breaches or penetrations (4AR). Any portion of the mesh (2AR2), not inflated by the expander (2AR1), can be expanded, then, by releasing string tension to allow the expander to move downward and/or by using the curved downward surface of the deformable seal (66A), as the assembly is pulled axially upward through the mesh (2AR2) with string (187) line tension.

FIG. 68A shows a magnified elevation view of the member set (2AR) portion, comprising the swellable expandable mesh membrane member (2AR2) with a metal mesh (2ARX) similar to an expandable sand screen and with encapsulated or coated swellable material (2ARS) or LCM engaged within its pore spaces, with the coating preventing contact with the swelling reagent, e.g. water. When the swellable expandable mesh membrane's (2AR2) circumference is expanded (2ARE) to engage the tubing's (11 of FIGS. 67-68) inside circumference, the coating is broken, exposing the membrane to the swelling reagent, thus causing swelling of the material (2ARS) to hold the mesh's shape, thus providing pressure integrity as it seals against the metal mesh (2ARX). Portions of the mesh (2ARX) pore spaces may not be filled with swellable material (2ARS) until the material swells to seal the pore space forming a membrane, while other portions of the pore space may be filled to provide a holding force, once swelled. Alternatively, the expandable metal mesh (2ARX) may be designed to form selectively sized pore spaces before and after expansion, such that, e.g., circulatable LCM slurry is usable to fill the pore spaces.

FIG. 68B shows a magnified elevation view of the member set (2AR) portion comprising the swellable expandable mesh membrane (2AR2), with a dashed line showing optional layers, wherein the metal mesh (2ARX) can be usable as the only layer or can be placeable on the inside, outside or between a swellable membrane (2ARS), with the diamond shapes of FIG. 68A being, e.g., raised surfaces on a surrounding swellable membrane or only occurring within the pore spaces of the mesh (2ARX) by, e.g., pumping a fluid slurry of gradated particle sizes through the mesh to choke its pore spaces, wherein a coating on swellable gradated particles is rupturable by the mesh to provide exposure to swelling reagent within the circulatable fluid column, thus securing the particles within the mesh and strengthening it.

Figure 69:
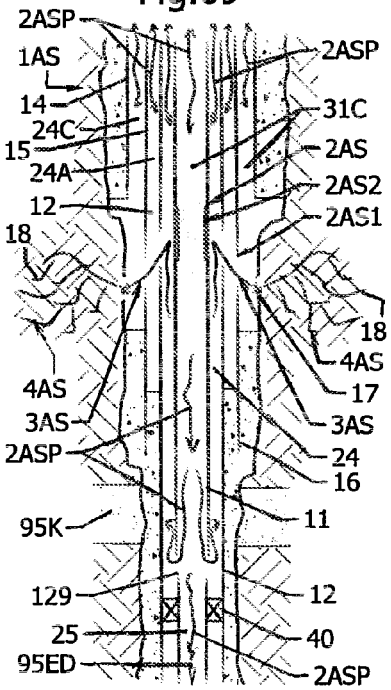
FIGS. 69 to 71 show various annular boring, annular logging and piston packer annular access embodiments, usable within the system and method embodiments of the present invention.
Figure 70:
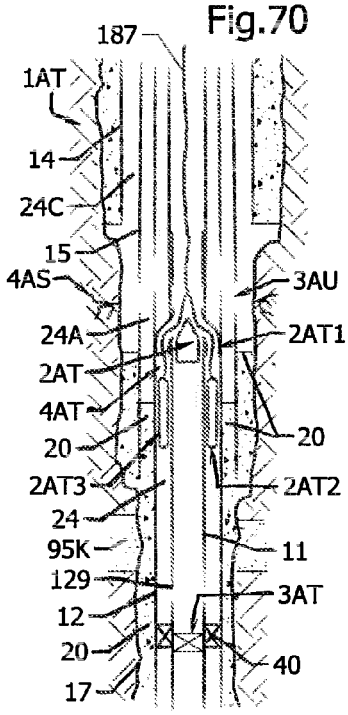
Figure 71:
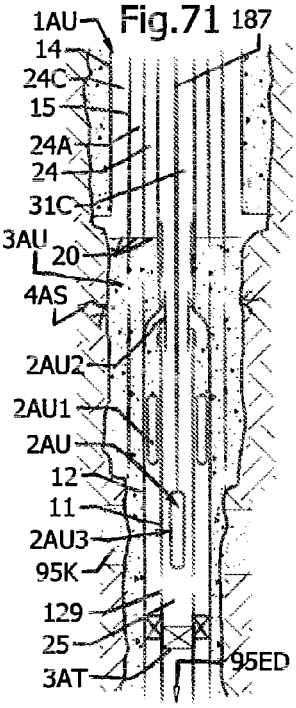

Referring now to FIGS. 69, 70 and 71, diagrammatic elevation views of a slice through a subterranean well and strata, through 3 stages of abandoning a portion (4AS) and accessing a new producible zone (95K) before final abandonment, as reshown. The Figures depict embodiments of methods (1AS, 1AT, 1AU, respectively) usable with member sets (2AS, 2AT, 2AU, respectively) comprising annulus boring access (2AS1, 2AT1), swellable expandable mesh membrane (2AS2, 2AU2), annular piston or rheological controllable fluid (2AU1), boring bit engagable conduit (2AT1) and coilable swellable conduit, flexible shaft and boring bit (2AT3) member embodiments, which can be usable with logging tool (2AT2) and circumferential engagable perforating (2AU3) members. FIG. 69 depicts cleaning a well to create wettable surfaces for good bonding (213 of FIG. 15). FIG. 70 illustrates confirming the sealing bond of the primary cement adjacent to a formation that is impermeable and strong formation (214 of FIG. 15). FIG. 71 shows providing pipe circumferential stand-off to prevent channelling (212 of FIG. 15) with axially downward cement support to prevent cement movement, slumping and gas migration (212 of FIG. 15) to provide casing and tubing embedded (215 of FIG. 15) in a minimum height of cement (219 of FIG. 15), wherein marginal production may occur until the final abandonment, when logging occurs to confirm bonding, and cement is bull-headed to the formation, filling the production tubing (11) to seal conduits with cement in cement (217 of FIG. 15). Thus, a sealing permanent abandonment plug (216 of FIG. 15) is provided at a depth of formation impermeability and strength, with cement behind casing (218 of FIG. 15) to contain future pressure (220 of FIG. 15) to, in use, meet published minimum industry best practice.

Referring now to FIG. 69, a member set (2AS) is shown that can be usable with the tubing (11) that is penetrated (129) or cut, with cleaning chemicals added to the pumped (2SAP) circulatable fluid column (31C) to clean the casings (12, 14, 15), and tubing (11) held at the lower end, by a production packer (40), to the production casing (12), wherein a annulus boring access (2AS1) member has been used to penetrate through the walls of the conduits (11, 12, 15), which is shown above and/or adjacent to the placement of well barrier elements (3AS) to seal fractured strata (18), and to potentially penetrate the strata wall (17) to provide fluid communication (2ASP) through the innermost bore (25) and annuli (24, 24A, 24C) and fluid disposal to the permeable depleted reservoir (95ED) and/or a fractured (18) strata portion (4AS) of the well, with a swellable expandable mesh membrane (2AS2) covering the penetration through the tubing (11) to provide a circulation path for cleaning circulation prior to sealing the fractures (3AS).

FIG. 70 shows a member set (2AT) that can be usable for placement of a well barrier element (3AT) to isolate the lower depleted reservoir and the use of a boring bit engagable conduit (2AT1) for providing a guiding conduit into the production annulus (24), for a logging member (2AT2), to determine the presence and bonding of cement (20) behind the production casing (12) annulus (24) or the intermediate casing (15) if, e.g., the conduit extended to that annulus (24A). A coilable swellable conduit, flexible shaft and boring bit (2AT3) is then usable to auger a swellable coil about the tubing (11) for stand-off and subsequent placement of a viscous mixture of, e.g., conventional polymers, LCM and/or gradated particle material or embodiments of the present invention to support a subsequently placed well barrier element member (3AT), which can be positioned within an annulus to support a well barrier element (4AT) within the well.

FIG. 71 depicts the use of a member set (2AU) comprising an annular piston or rheological controllable fluid (2AU1) placed on top of the coilable swellable conduit, flexible shaft and boring bit usable to form a permeable bird's nest (AT3 of FIG. 70) to provide support for cement within the annuli (24, 24A, 24C). A swellable expandable mesh membrane (2AU2) may be held below the annulus access conduits (2AT1 of FIG. 70), while cement (20), e.g., is placed in the annuli (24, 24A, 24C) using the circulatable fluid column (31C) pumped down one or more of the annuli and returned through the innermost passageway (25), or vice versa, with an explosive device initiating jarring and expansion of the swellable expandable mesh membrane (2AU2), set for time and pressure activation. Prior to reaching the designated firing time and pressure, the membrane (2AU2) may be raised to cover the penetration (2AT1 of FIG. 70), after cementing, to expand and hold the cement within the annulus, having initially held the heavier cement with u-tube forces between the annuli, causing an even top of cement (20), thus providing a permanent well barrier element (3AT) over a portion (4AS) of the well. Once the cement has set, logging can confirm the cement bonding of the tubing and a perforating member (2AU3) can be usable to penetrate the conduits (11, 12) and cement adjacent to the new producible zone (95K). After producing the zone (95K), the logging members can be re-run to confirm cement bonding of the tubing (11), and the well barrier element (3AT) may be removed to bullhead a rheological and hydrocarbon reagent controllable fluid reacting to and blocking permeability as it enters the hydrocarbon producible zones to, in use, to prevent gas migration and support a trailing cement during injection into the new zone (95K) and the depleted producible zone (95ED), thus permanently abandoning the remaining lower portions of the well.

Figure 72:
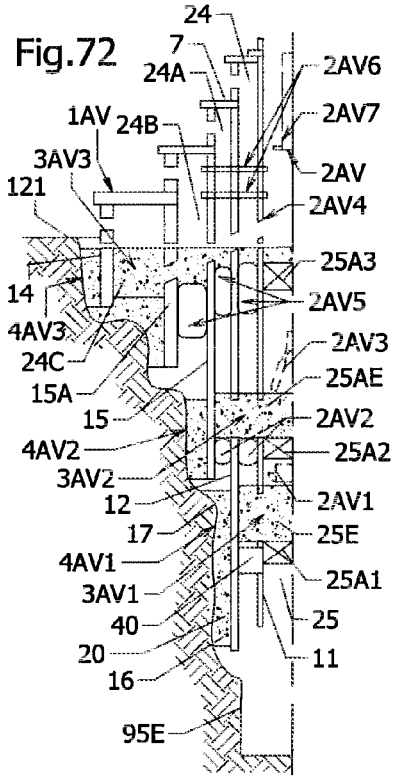

Referring now to FIG. 72, a diagrammatic elevation left side view of a cross section through a well bore within the strata, showing embodiments of a method (1AV) usable with a member set (2AV) comprising circumferential shredding and milling (2AV1), piston or rheological controllable gradated particle (2AV2, 2AV5), circumferential milling (2AV3), annulus boring access (2AV4), boring bit engagable conduit pinning (2AV6) member embodiments, usable with tubing plug (25A1-25A3) and abrasive particle cutting and/or explosive severance (2AV7) members, is shown. The Figure depicts primary cement sealing (3AV1, 3AV2, 3AV3), adjacent to formation well portions (4AV1, 4AV2, 4AV3) that are impermeable and strong (214 of FIG. 15), and the providing of pipe circumferential stand-off using various members to prevent channelling (212 of FIG. 15) with axially downward cement support (2AV2, 2AV5) to prevent cement movement, slumping and gas migration (212 of FIG. 15), thus providing casing and tubing embedded (215 of FIG. 15) within a minimum height of cement (219 of FIG. 15). The production tubing (11) can be sealed with cement in cement (217 of FIG. 15), further providing a sealing permanent abandonment plug (216 of FIG. 15) at a depth of formation impermeability and strength with the primary cement behind casing (218 of FIG. 15) logged to ensure that it will contain future pressure (220 of FIG. 15), thus meeting published industry best practice. The surface (121) is returnable to its original state by cutting off the wellhead engaged conduits (11, 12, 15, 15A, 14) with a conventional rig-less abrasive cutter or explosives, after pinning (2AV6) the various conduits (11, 12, 15) that are to be lifted off as a unit to safely save the cost of handling them separately. Additionally, by logging of the primary cement bonding and placement of primary well barrier elements (3AV1, 3AV2) within the enlarged innermost passageways (25E, 25AE), the present invention simulates abandonment by a drilling rig (172A of FIG. 10) with all of its inherent advantages at a significantly lower level of resource usage and associated cost.

Figure 73:
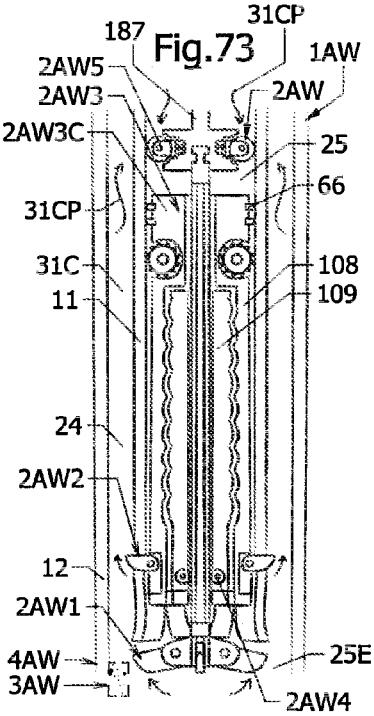
Figure 74:
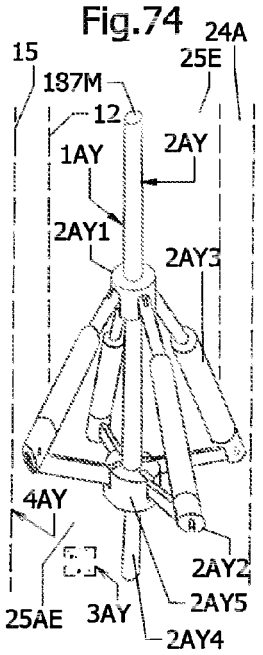
Figure 146:
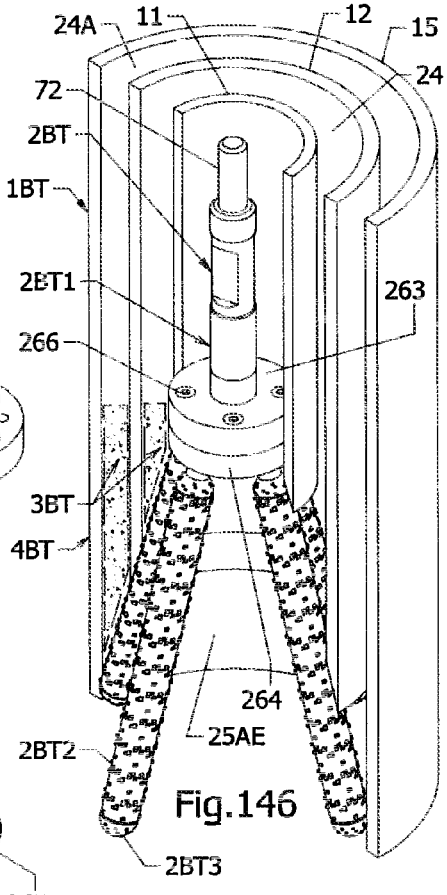

One of the possible sequences for the method (1AV) is to set the lowest tubing plug (25A1) member and then shred and/or mill the tubing (11) with member (2AV1), comprising e.g. with (2AW) of FIG. 73, (2AY) of FIG. 74 or (2BT) of FIG. 146, followed by using a logging member within the enlarged inner passageway (25E), after compressing any shredding and/or milling downward with a piston member to confirm the cement bond (213 of FIG. 15) behind the production casing (12); and then, placing the well barrier element (3AV1), e.g. cement, within the enlarged innermost passageway (25E) to abandon the lower portion (4AV1) of the well. If a good cement bond behind the production casing (12) does not exist, it may be milled and/or shredded prior to placing a barrier (3AV1).

In this embodiment, a review of the logging performed during construction of the well shows that the necessary cement does not exist in the intermediate casing (15) annulus (24A), so the next step is to place an intermediate tubing plug (25A2) member, followed by operation of a milling member (2AV3) to destruct the tubing (11) and production casing (12), allowing it to fall downhole and/or compressing it with a piston member, after which a logging member can be usable within the enlarged innermost passageway (25AE) to confirm cement bonding behind the outer intermediate casing (15A), after which a rheological controllable fluid, swellable gradated particle mix and/or pistons member (2AV2) are placeable in the annuli (24, 24A), above any debris from milling, to support the well barrier element (3AV2) placed in the enlarged innermost passageway (25AE) to abandon the adjacent portion (4AV2) of the well.

With primary (3AV1) and secondary (3AV2) permanent well barrier elements in place in the well, the next steps may involve using an annulus boring access member (2AV4) to provide fluid communication with the annuli (24, 24A, 24B, 24C), after which piston and/or rheological controllable fluids, swellable gradated particle members (2AV5) can be usable to provide support within the annuli for the well barrier element (3AV3) to abandon the final portion (4AV3) of the well. Additionally, if penetrations are placed above and below the pistons and/or packed and partially solidified rheological fluids (2AV5), an axial slideable annular bypass member method (1M of FIGS. 28-30) can be usable to straddle the bores (2AV4) and penetrations to hydraulically jar and pack the annular blockages (2AV5) to ensure that they can support the well barrier element (3AV3). After placing the final barrier, the surface level (121) is returnable to its original state, potentially using a boring bit engagable conduit pinning (2AV6) member, e.g. (2Z) of FIG. 49, to secure the conduits together for lifting, followed by operation of a conventional abrasive cutting or explosive severance member (2AV7) to cut all of the conduits engaged to the wellhead (7) so that it might be lifted off using, e.g., a mobile or floating crane, for offshore wells, to complete the abandonment of the well.

FIG. 73 depicts a diagrammatic elevation view of slice through installed well conduits and shows a method (1AW) embodiment that can be usable with the member set (2AW) comprising circumferential kelly milling (2AW1), axial conduit shredding (2AW2), axial movable screw tractor (2AW3) member embodiments and/or conventional tractor (2AW3C), showing the shredding and milling of tubing to create an enlarged innermost passageway (25E) usable to place the partially shown well barrier element (3AW) to abandon a portion (4AW) of the well. The cable string (187) operable kelly mill (2AW1) can be rotated by a kelly bushing (2AW4), that can be operated by a rotor (109) turned by pumping (31CP) the circulatable fluid column (31C), diverted by seals (66) between a stator (108), held by a tractor (2AW3 or 2AW3C) pulling the assembly axially upward to engage shredding cutters (2AW2) with the tubing (11) and the motor, an anti-rotation member (2AW5) with spring operated anti-rotation wheels to pass obstructions and prevent rotation of the cable string (187). A constant force can be applied by the tractor to shred the tubing while the rotating kelly mill is operable axially with string (187) tension and the axial rolling circumferential anti-rotation swivel member (2AW5) is engagable, between the stationary string (187) and rotating kelly mill, and further usable to engage and disengage the rotating mill to and from the tubing, thus preventing jamming of the shredding mill member (2AW). In various other embodiments, the tractor unit (2AW3) can be usable to weaken the tubing prior to shredding and milling.

Once engaged, the member (2AW) can be operated with string tension, usable to operate the mill and fluid pressure of circulated fluid column (31C), usable to operate the tractor and shredding assembly, after which the tool may be disengaged by mechanically and/or hydraulically jarring downward to shear various pins within the member (2AW) to release the cutters and mills from the tubing, thus allowing it to be retrieved to the surface for repair and/or replacement. Alternatively, conventional disposable or releasable motors are usable, with low cost shredding and milling assemblies that are usable to dispose of worn shredding, cutting and milling equipment downhole, which is possible by, e.g., cutting tubing to which it is engaged and letting it fall into the enlarged innermost passageway formed by the milling and/or shredding to further support a rheological fluid member and/or well barrier element placed axially above it.

Referring now to FIG. 74, a diagrammatic isometric view of a method (1AY) embodiment, usable with the circumferential milling (2AY) member embodiment comprising an annular separating elbow (2AY2), roller mills (2AY3), elbow connector (2AY1), screw shaft (2AY4) and elbow screw (2AY5) parts, is shown. The Figure includes the formation of an enlarged innermost passageway (25AE) that can be usable to place the partially shown well barrier element (3AY) to abandon a portion (4AY) of a well. The mill can be usable with a motor member of a cable string (187M) for rotating the screw shaft (2AY4) to screw the lower elbow connector (2AY5) axially upward, extending the separating elbows (2AY2) and roller mills (2AY3), and pivoting on the upper elbow connector (2AY1) secured to the screw shaft (2AY4). In this instance, the tubing has already been compressed axially downward, forming an enlarged production passageway (25E) and a logging member has found that the cement bond was unacceptable or there was an absence of cementation behind the production casing (12), thus the milling assembly (2AY) is being operated to enlarge (25AE) the innermost passageway into the intermediate casing (15) annulus (24A). The separating elbows and rotatable milling sleeves (2AY3) may extend until the mill engages the production casing (12) or the separating elbow engages the intermediate casing (15), wherein expansion of the assembly (2AY) centralizes and mills the production casing when rotated by the motor member (187M) engaged at its upper end to the cable string. The elbow mill (2AY) is therefore operable with string line tension holding the mill against the casing (12), while the motor using, e.g., a positive displacement fluid motor, can be used to turn the rotating mills (2AY3). Retraction and retrieval of the mill is possible with the opposite rotation unscrewing the mills deployment, so that it may be retrieved using the cable string.

As cable compatible operations cannot, generally, be operated in a robust manner of a jointed pipe operation on a drilling rig, the objective in rotary cable operations is less than milling in the jointed pipe drilling rig conventional sense, and more akin to abrasively eroding the casing (12) and/or poor cementation with continued rotation of the mill, while limiting the tension placed on coiled cable strings to prevent becoming jammed or otherwise unable to rotate. While conventional drilling rig operations may mill a sufficient length of casing, on average with ample torque available, to provide an acceptable barrier height in a matter of hours and days, cable compatible operations may take significantly longer to abrade conduits using significantly lower torque and may be measured in days and weeks. The costs of performing low torque cable compatible abrasive casing erosion is, however, significantly less than using, e.g. a drilling rig, even with such disparities in required time for milling.

Figure 80:
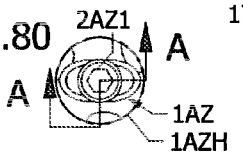
FIGS. 80 to 84 show various annulus separation embodiments of the present invention.
Figure 81:
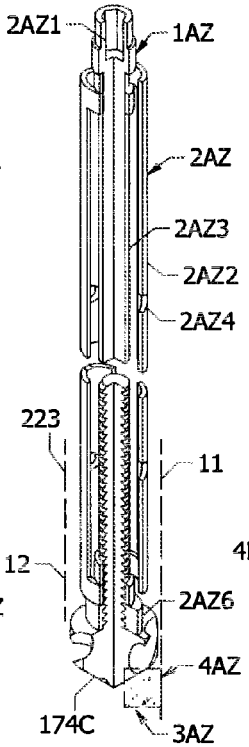
Figure 82:
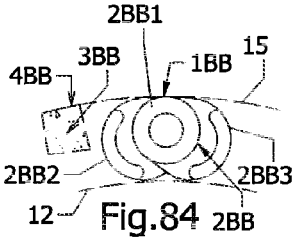

FIGS. 80, 81 and 82 are plan, elevation and projected views, respectively, with FIG. 80 section line A-A associated with FIG. 81 cross section along line A-A, and FIG. 82 a projection of FIG. 81, showing a method (1AZ) embodiment of a collapsed annular passageway separating member (2AZ) embodiment. The Figures illustrate a flexible shaft connector (2AZ1) that can be usable to drive a shaft (2AZ2) with threads and a boring bit (174C), at its lower threads, engagable to a nut (2AZ6) for compressing, bowing and/or bending a flexible blade (2AZ2) with fluid communication ports (2AZ4). The flexible blades (2AZ2) can be held by the bore (223) made by the boring bit (174C) or passageway of a guide member (e.g. 2BK of FIGS. 117-118) and can be usable as stabilizers on the drilling assembly, with the assembly (2AZ) rotatably placeable through a penetration (1AZH) made by rotating the assembly's boring bit (174C) or, e.g., using an auger type bit for pulling the assembly into a previously made wall penetration or using the assembly and placing it without a bit using a flexible shaft and rotation after insertion in an annulus to expand the flexible blades (2AZ2) by rotating the nut (2AZ6) on the threads, with the blades (2AZ2, 2AZ6) usable to provide stand-off (211 of FIG. 15) between the tubing (11) and the production casing (12) to place the partially shown well barrier element (3AZ) and to abandon a portion (4AZ) of a well.

Figure 83:
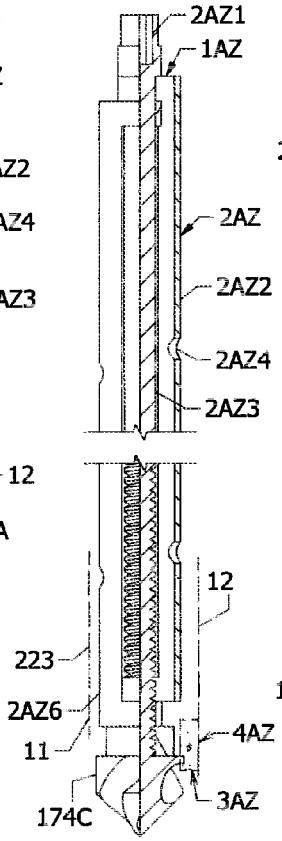

Referring now to FIG. 83, an isometric cross sectional view along line A-A of FIG. 80, showing a method (1BA) embodiment of an expanded annular passageway separating member (2AZ of FIGS. 80-82) is shown. The Figure includes a shaft (2AZ3) with sufficient rigidity to facilitate thread and nut movement that has rotated the flexible shaft rotary connector (2AZ1) to cause the nut (2AZ6) to travel on the threaded portion of the shaft, which is causing the penetrated (2AZ4) blades (2AZ2) to bend and further provide stand-off between, e.g., the tubing (11) and the casing (12) so that the partially shown well barrier element (3BA) may be placed to abandon the portion (4BA) of the well, thus providing tubing conduits sealed with cement in cement (217 of FIG. 15). If a logging member is placed through the penetration (1AZH of FIG. 80), prior to placement of the separating member (2AZ), and confirms a good cement bond (213 of FIG. 15) then the methods (1AZ and 1BA) can be usable to provide stand-off between casing (12) and tubing (11) so that each may be embedded in cement (215 of FIG. 15). The member (2AZ) is placeable through penetrations formed by other boring members using an auger bit and/or by using the member engaged to flexible shaft for boring and separation with a cable compatible motor that can be deployable and operable from the innermost passageway.

Figure 84:
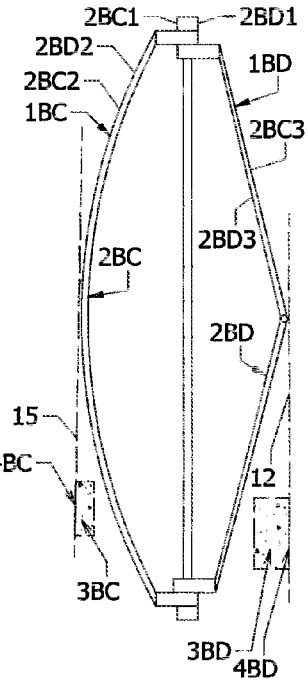

FIG. 84 depicts a plan view above an elevation view of method (1BB, 1BC, 1BD) embodiments that can be usable with annular passageway separating member (2BB, 2BC, 2BD) embodiments, respectively, for depicting a central member part (2BB1, 2BC1, 2BD1) engaged with left (2BB2, 2BC2, 2BD2) and right (2BB3, 2BC3, 2BD3) bendable parts, which can be placeable and engagable between conduit circumferential walls of the production casing (12) and intermediate casing (15) to provide stand-off (211 of FIG. 15) between the conduit, by displacing their walls to a more concentric position for placement of the partially shown well barrier elements (3BB, 3BC, 3BD) usable for abandoning a portion (4BB, 4BC, 4BD) of a well. The stand-off can be usable to provide conduits, which are embeddable within cement (215 of FIG. 15), that when combined with providing a logging member to measure the existence of cement behind the casing prior to placement of the separating members (2BB, 2BC, 2BD), can be usable to provide a permanent well barrier element. Both the separating and logging members can be placeable, e.g., through bores made by other members penetrating conduit walls to access annuli. The method (1BB) illustrates that conduit stand-off right (2BB2) and left (2BB3) members can be orientatable with the curvature of the concentric annuli conduits, about the central member (2BB1), to allow full expansion of the member. The method (1BC) shows that a member (2BC) part (2BC2) may bend to fully expand and provide stand-off or, as shown, the right hand method (1BD) one or more elbow joints may be added to a member part to provide better expansion, dependent on the annulus in which the members (2BB, 2BC, 2BD) are expanded for stand-off, wherein rotation of the central member (2BB1, 2BC1, 2BD1) by a flexible shaft extending from a motor in the innermost bore, causes through penetration in a conduit wall to an annulus, bends the separating member to provide stand-off between the member parts and conduits they separate.

Figures 85, 86, 87, 88, 89, 90, 91, 92, 93:
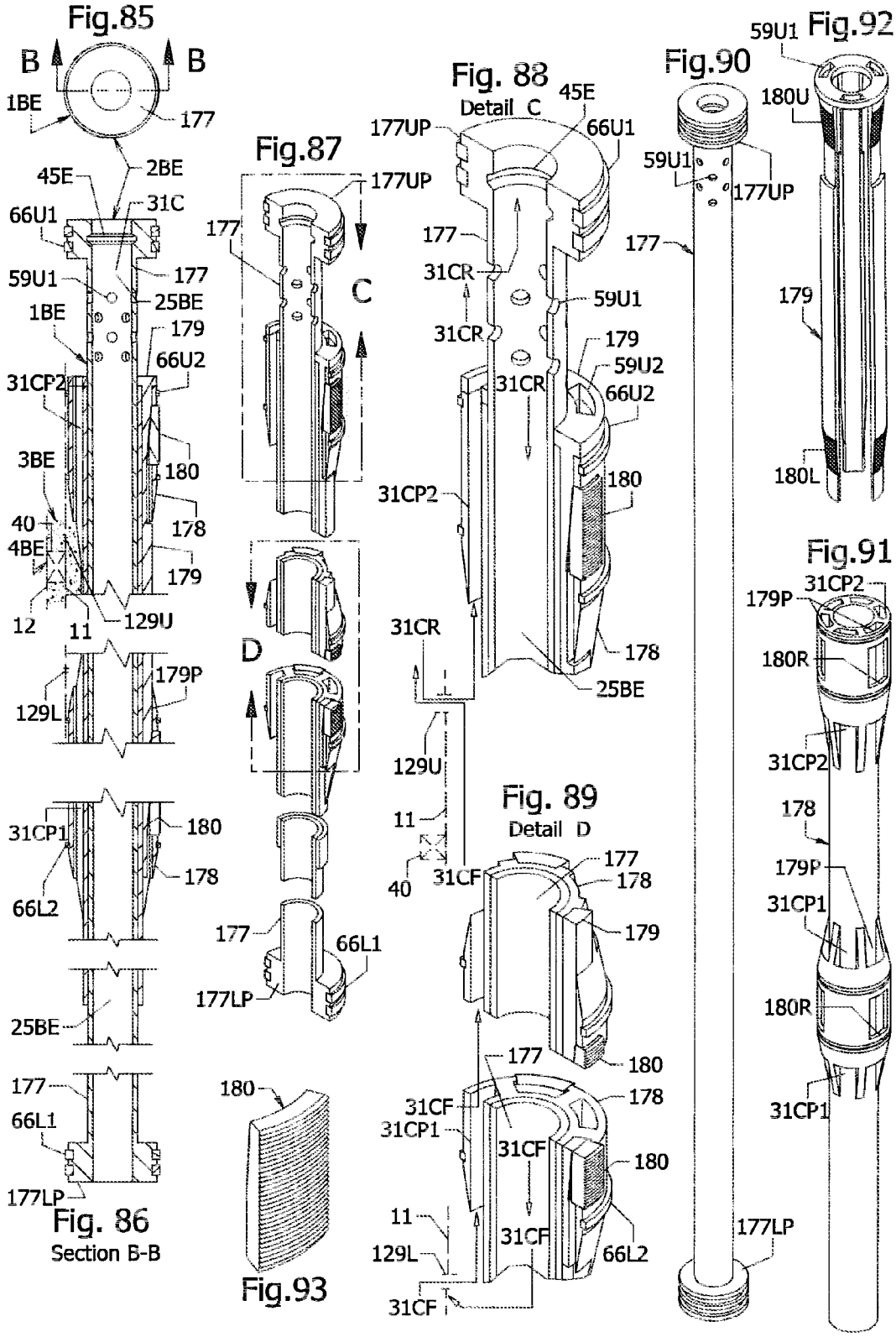
FIGS. 85 to 92 illustrate an axially slideable annular blockage bypass member embodiment.

Referring now to FIGS. 85 and 86, a plan view and elevation cross section view with and along line B-B, respectively, with break lines representing removed portions of a method (1BE) embodiment, usable with the axially slideable annular blockage bypass member (2BE) embodiment are shown. The Figures illustrate circulation through upper (129U) and lower (129L) penetration between the member (2BE) and production tubing (11) to bypass a production packer (40) engaged between the tubing (11) and production casing (12) and to place the partially shown well barrier element (3BE) to abandon a portion (4BE) of the well.

The slideable conduit (177), with upper (177UP) and lower (177LP) pistons, moves within the housing (178), which can be usable to engage the tubing (11) with slips (180) held by slip piston fingers (179) passing through slip finger passageways (179P) in the housing (178), wherein the member (2BE) can be placeable with a cable string using a receptacle (45E) and pressure applied against the top of the slip piston fingers (179) to engage the slips (180) in the slip receptacle (180R of FIG. 91), thus causing them to engage the tubing, after which the member is anchored and the cable string may be removed. Upper (66U1) and lower (66L1) seals on the upper (177UP) and lower (177LP) pistons, respectively, react to the orientation and circulating pressure of the circulatable fluid column (31C) to move the slideable conduit (177), dependent on the direction of circulation, to open and close the body's (178) upper circulating passageway (31CP2) and orifices (59U1) in the slideable conduit (177). The body's (178) upper circulating passageway (31CP2) and orifices (59U1) in the slideable conduit (177) are open during reverse circulation (31CR of FIGS. 89-90) and closed during forward circulation (31CF of FIG. 89-90).

Once anchored with the upper (66U2) and lower (66L2) seals straddling the penetrations (129U, 129L) and packer (40), the member (2BE) can be operable with the circulatable fluid column (31C) using: forward circulation (31CF of FIG. 89-90) axially downward through the tools innermost bore (25BE) and returning fluid axially upward through the production annulus to the lower penetration (129L), then between the member (2BE) and the tubing (11) until exiting the upper penetration (129), having bypassed the packer (40) and re-entered the production annulus, and reverse circulation (31CR of FIGS. 89-90), axially downward through the production annulus above the packer (40) and returning axially upward through the upper penetration (129U), the circulation passageway (31CP) in the body (178), and through the orifices (59U1) in the slideable conduit (177) and into the member's inner bore (25BE).

FIG. 87 depicts a projected view of FIG. 86 with removed cross sections corresponding to the associated break lines, with detail lines C and D associated with FIGS. 88 and 89, respectively, of the axially slideable annular blockage bypass member (2BE). The Figure illustrates the slideable conduit (177) with upper (177UP) and lower (177LP) pistons within the housing (178 of FIG. 91).

Referring now to FIGS. 88 and 89, magnified views of the portion of the axially slideable annular blockage bypass member (2BE) within detail lines C and D of FIG. 87, respectively, are shown, illustrating the member (2BE) in a reverse circulation (31CR) position with the upper slideable piston (177UP) allowing circulation to occur axially downward through the production annulus and the upper penetration (129U) above the packer (40) to return axially upward through the body's (178) upper fluid passageway (31CP2), to be diverted by the seals (66U1) against the tubing (11) into the orifices (59U1) and then axially upward or downward in the member's (2BE) bore (25BE). As the maximum circulating pressure is against the lower side of the upper slideable piston (177UP), which is held in a raised position during reverse circulation, the reverse circulation position can be usable to, e.g., first place a cement plug below the production packer (40) with forward circulation, and then reverse circulate to remove excess cement from above the production packer, after which a plug may be placed in the tubing to isolate formation below the production packer. Alternatively, reverse circulation can be usable for cleaning the production annulus prior to cementing, directly injecting waste cleaning fluids into the permeable reservoir before forward circulating and packing a fluid member into the pore spaces of a reservoir to support cement within the production tubing and production annulus and prevent gas migration.

Forward circulation travels axially downward from above the upper slideable piston (177UP) holding it in a closed position and, thus, closing the body's (178) upper fluid passageway (31CP2) orifice (59U2) with the piston's lower face, while placing the slideable orifices (59U1) against the body's bore to close them also. Circulation (31 CF) continues axially downward until reaching the annulus and returning axially upward to the lower penetration (129L) and diverting, as a result of the production packer (40) or other annular blockage, into the space between the tubing and the member (2BE) to the lower body (178) fluid passageway (31CP1) until reaching the closed upper fluid passageway (31CP2) orifices (59U2) and, then, exiting through the upper penetrations (129U) to continue in the production annulus. This forward circulation method is usable, e.g. to clean the production annulus and tubing, while intermittently closing the annulus to inject waste fluids into the permeable reservoir, repeatedly, until a clean circulation fluid is achieved. Once clean, a cement, rheological controllable fluids and/or swellable gradated particle members may be intermittently squeezed into the permeable reservoir until it locks up and is capable of supporting a cement column, after which circulation can be rocked between reverse and forward circulation, against alternately open and closed annular and tubing bores, to hydraulically jar and pack the reservoir to fluidly isolate it sufficiently and to stop gas migration upward while clearing the circulating pathways for subsequent placement of a well barrier element, e.g. cement.

Referring now to FIG. 90, an isometric view associated with FIGS. 85 to 89 is depicted, showing the reciprocating slideable straddle piston (177) within the axially slideable annular blockage bypass member (2BE) of FIGS. 85 to 89, and depicting upper (177UP) and lower (177LP) pistons with intermediate circulating orifices (59U1).

Referring now to FIG. 91, an isometric view of a reciprocating slideable straddle piston housing body (178), associated with FIGS. 85 to 90 of the axially slideable annular blockage bypass member (2BE) parts, is shown, depicting upper (31CP2) and lower (31CP1) fluid passageways adjacent to slip engagement finger (179 of FIG. 92) passageways (179P) for engaging slips (180 of FIG. 93) through slip receptacles (180R).

FIG. 92, an isometric view of a piston with slip engagement fingers (179) for actuating slips (180 of FIG. 93) associated with FIGS. 85 to 91 of the axially slideable annular blockage bypass member (2BE) parts, shows a piston with circulation orifices (59U1) above upper (180U) and lower (180L) slip (180 of FIG. 93) surfaces that hold the slip in place when the upper piston is forced downward with pressure from the circulating system, and wherein jarring upward jarring of the string is usable to remove the engagement of slips for retrieval of the assembly.

FIG. 93 shows an isometric view associated with FIGS. 85 to 92 of axially slideable annular blockage bypass member's (2BE) parts, depicting a slip segment usable with the member (2BE) and various other embodiments.

Referring now to FIGS. 94 to 104, methods (1BF to 1BH) are shown for using an annulus jarring member to provide an explosive hydraulic pulse with the circulatable fluid column to displace a member and/or conduit wall to, in use, provide space for placement of well barrier elements to permanently fluidly isolate (211-220 of FIG. 15) at least one of producible zone or annuli from the wellhead.

Figures 94, 95, 96, 97, 98, 99:
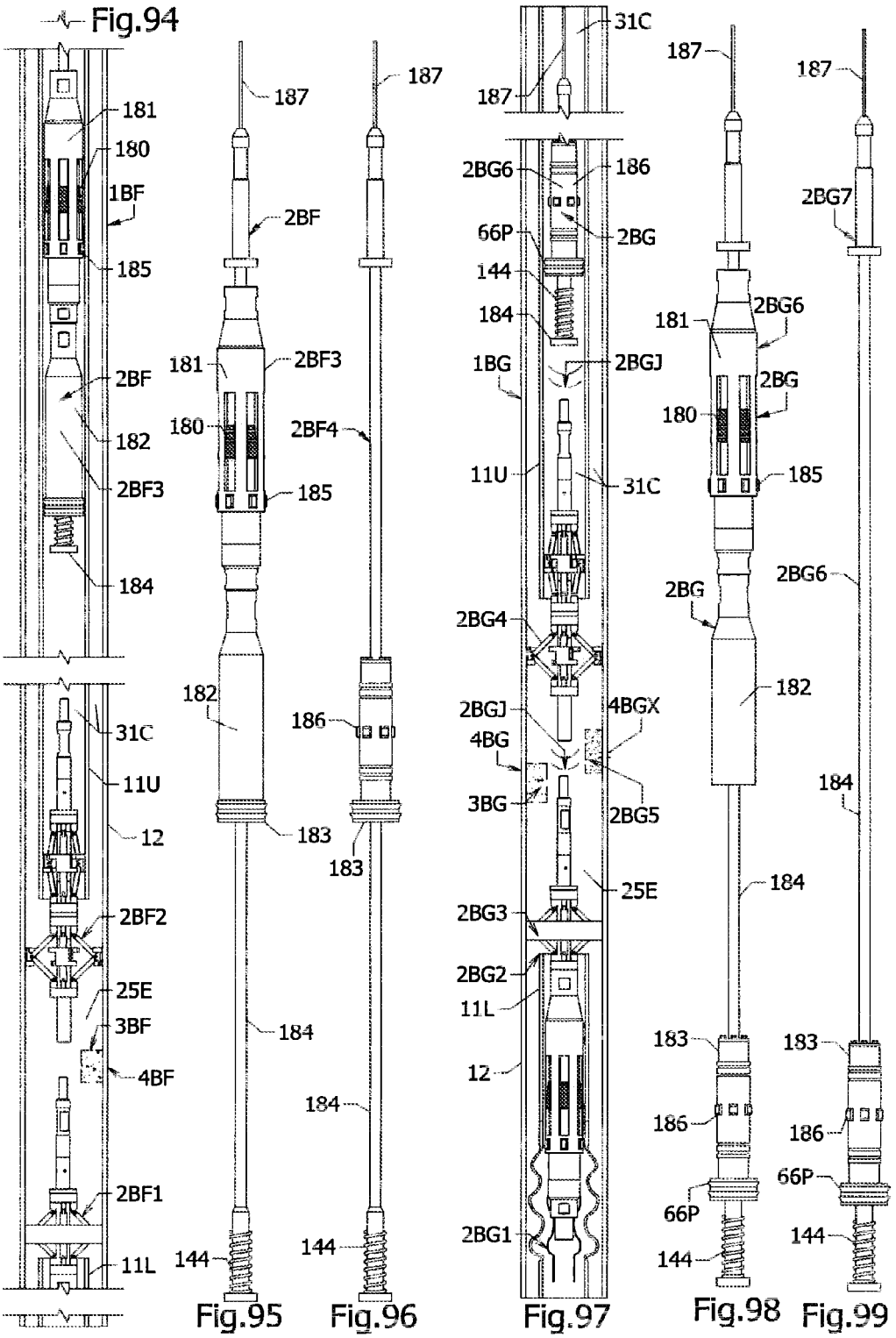
FIGS. 94 to 104 depict various jarring member embodiments, usable within the embodiments of the present invention.

FIGS. 94 to 96 illustrate embodiments of the method (1BF) for a cocked jar (2BF) and FIGS. 97 to 99 depict embodiments of the method embodiment (1BG) for a fired jar (2BG), for illustrating the firing sequence, wherein the same apparatus is used within FIGS. 94 to 99 with different positional relationships (2BF, 2BG), while the method embodiment (1BH) of FIGS. 100 to 104 illustrates the latched (2BH1 of FIG. 102), latching (2BH2 of FIG. 103) and unlatched (2BH3 of FIG. 104) positions of the hydraulic housing and piston assembly (2BH).

Referring now to FIG. 94, an elevation view with break lines showing removed sections, associated with FIGS. 95 to 104, of a method (1BF) embodiment usable with a jarring member (2BF) embodiment is shown, depicting the member (2BF) in a cocked position within the upper end of cut production tubing (11U) and centralized by two expandable frame members (2BF2), thus providing stand-off (211 of FIG. 15) of the tubing from the production casing (12) above a piston member (2BF1) of the present inventor, engaged to the lower end (11L) of the cut production tubing, wherein the arrangement is used to form an enlarged innermost passageway (25E) for placement of the partially shown well barrier element (3BF) to abandon a portion (4BF) of a subterranean well. The enlarged innermost passageway (25E) is further enlarged by forcing the piston (2BF1) axially downward with pressure exerted on the circulatable fluid column (31C) and by the hydraulic jarring of the piston member (2BF1) by the other member (2BG of FIG. 97).

The jar (2BF) can be engagable to the upper tubing (11U) with the slips (180) of a hanger (181) initiated by the rapid downward movement of releasing tension in the cable string (187 of FIG. 95) acting against frictional drag blocks (185), engaged with the tubing (11U), after which pressure may be applied to circulatable fluid column (31C) to fully actuate and secure the hydraulic jar (2BF) for subsequent operation. After operation, the jar is released with upward tension of the cable string (187), wherein mechanical jars may be added to the assembly (2BF) above the hanger (181) to aid retrieval. The piston travel rod (184) has been retracted into its upper most position with pressure applied to the circulating column to ensure the jar piston (186 of FIG. 96) is latched (2BF3) within the jar piston housing (182).

FIG. 95, an elevation view associated with FIGS. 94 and 97, shows the embodiment of a jarring member (2BF) removed from the casing (12 of FIG. 94) and tubing (11U, 11L of FIG. 94) in the latched position (2BF3). The upper end is engagable with a cable string (187), coiled tubing or jointed pipe arrangement with the slips (180) extending from the hanger (181), which is settable using the drag block (185) friction when quickly releasing line tension, after which the slips are settable by pressuring the hydrostatic column and releasable with upward movement of the string (187), optionally using an upward acting mechanical jar to release the assembly. The hydraulic jar's (2BF) piston (183) is shown engaged within the piston housing (182), wherein the piston (183), when fired, travels from the housing (182) to the spring (144) at the lower end of the piston travelling rod (184).

FIG. 96, an elevation view associated with FIG. 95, shows the parts (2BF4) of the jarring member (2BF of FIG. 95) comprising the piston (183) with latching dogs (186) movable along the piston travelling rod (184) with a string (187) connection at its upper end and a dampening spring (144) at its lower end, wherein the anchor (181 of FIG. 95) and piston housing (182 of FIG. 95) are removed.

Referring now to FIG. 97, an elevation view with break lines showing removed sections, associated with FIGS. 94 to 96 and FIGS. 98 to 100 of a method (1BG) embodiment of a jarring member (2BG6) is shown. The Figure depicts the member (2BG) in a fired position (2BG6) within the upper end (11U) of cut (2BG2) production tubing, centralized by two expandable frame members (2BG4) above a piston and hanger member (2BG3) of the present inventor, engaged to the lower end (11L) of the cut and compressed (2BG1) production tubing, wherein the arrangement is used to form an enlarged innermost passageway (25E) for placement of the partially shown well barrier element (3BG) to abandon a portion (4BG) of a subterranean well. The enlarged innermost passageway (25E) is further enlarged by forcing the piston (2BG3) axially downward with pressure exerted on the circulatable fluid column (31C) with hydraulic jarring by the member (2BG) to further compress or crush (2BG1) the cut (2BG2) lower end (11L) of the production tubing.

After latching the hydraulic jar (1BF of FIG. 94), pressure is applied to the fluid column (31C) acting against seals (66P) of the piston (186) causing it to fire (2BG6), after which it travels along the rod (184) to engage the dampening string (144) at the lower end of the rod (184), having delivered a sudden jarring hydraulic pulse (2BGJ) to the upper end of the piston and hanger member (2BG3) to further compress (2BG1) the cut (2BG2) tubing (11L) with, e.g., helical buckling, plastic failure and/or contortion, thus causing the enlarged innermost passageway (25E) to become larger so that a well barrier element (3BG) may be placed adjacent to a portion of the well (4BG), wherein a viscous rheological fluid (2BG5) may be used to bridge a breach (4BGX) in the casing. After increasing the enlarged inner passageway space sufficiently to allow logging, the vertical extent of the breach may be determined for subsequent cement squeezes or the cement bond can be confirmed behind the casing (12). The centralizing (2BG4) member can be usable during a jarring operation, but is not required. If logging is required, the centralizing member (2BG4) could, e.g., be removed to provide space for a logging member, then replaced to provide tubing (11U) stand-off.

FIG. 98 is an elevation view, associated with FIGS. 94 and 97 of an embodiment of a jarring member (2BG) removed from the casing (12 of FIG. 97) and tubing (11U, 11L of FIG. 97) in a fired position (2BG6). The piston (183), with latching dogs (186) and seals (66P), can be positioned at the lower end of the travelling piston rod (184) adjacent to the impact dampening and latching spring (144).

FIG. 99, an elevation view associated with FIG. 98, shows the parts (2BG7) of the jarring member (2BG of FIG. 97) comprising the piston (183) with latching dogs (186) movable along the piston travelling rod (184) with a string (187) connection at its upper end and a latching and dampening spring (144) at its lower end, wherein the anchor (181 of FIG. 97) and piston housing (182 of FIG. 97) are removed.

Figures 100, 101, 102, 103, 104:
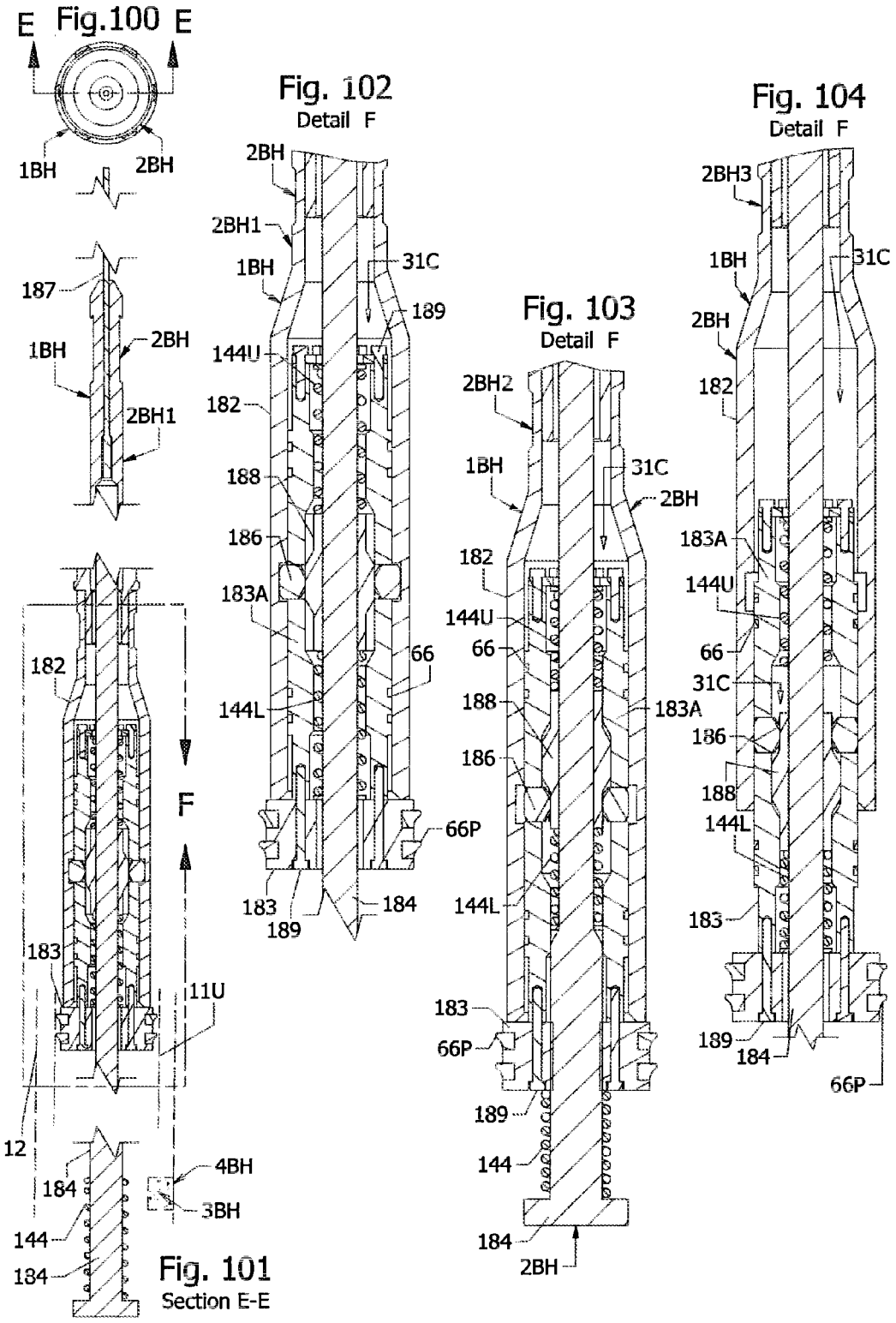

Referring now to FIGS. 100 and 101, plan and elevation cross section views with line E-E and along line E-E, respectively, are shown with break lines representing removed sections of method (1BH) and jarring member (2BH) embodiments associated with FIGS. 94 to 99, wherein FIG. 101 has a detail line F associated with FIGS. 102 to 104, depicting the latched position (2BH1) of the cable string (187) deployable jarring member (2BH), usable to enlarge an inner passageway (25E of FIGS. 95 and 97) and to place a well barrier element (3BH) adjacent to a portion (4BH) of a well to be used or abandoned. The piston (183) can be usable to create an explosive hydraulic jarring fluid pulse as it is driven by compressed pressurized fluid above the piston and exits the housing (182) travelling along the re-latching rod (184) until it reaches a dampening and latching spring (144).

FIGS. 102, 103 and 104 are magnified views of a portion within detail line F of FIG. 101 of the latched (2BH1), latching (2BH2) and unlatched (2BH3) jarring member positional embodiments, respectively, showing a travelling rod (184) passing through the piston (183) with piston seal (66P) secured to a piston body (183A), and with seals (66) and maintenance connections (189), shown as bolts for repair and replacement of parts, like the latching dogs (186) within the piston housing (182). A triggering cam (188) between upper (144U) and lower (144L) springs within the piston body (183A) actuate and release latching dogs (186) from the piston housing (182) during latching and firing of the jarring member.

FIG. 102 shows the hydraulic jarring piston assembly (2BH) in the latched position (2BH1) with the triggering cam (188) positioned by upper and lower springs (144U, 144L) to extend the latching dogs (186) into a receptacle in the housing (182), to hold the piston assembly in place against the pressure of the circulatable fluid column (31C) being hydraulically compressed over its volume to store energy for firing jarring member, with the firing pressure defined by the spring's (144U, 144L) resistance.

FIG. 103 shows the hydraulic jarring piston assembly (2BH) in the latching position (2BH2) with the triggering cam (188) pushed upward by string (187 of FIG. 101) tension applied to the travelling rod (184), and the latching/dampening spring (144) against the fluid column (31C) and upper spring (144U) to allow the latching dogs (186) to retract against the cam's surface and enter the housing (182) moving upward until reaching the receptacle in the housing (182), when string tension is released and the upper spring (144U) pushes the cam (188) downward as the latching/dampening spring (144) holds the piston (183) in place when the travelling rod (184) is lowered. Thus, the dogs (186) are allowed to extend into the receptacles of the housing (182) and latch (2BH1 of FIG. 102) the piston assembly (2BH) in place.

FIG. 104, shows the piston in the firing position (2BH3), where the pressure exerted on the circulatable fluid column (31C) is increased until the triggering cam (188) is pushed down to release the latching dogs (186) from the receptacle in the housing (182), thus firing the hydraulic piston with pressure from the compressed fluid column expanding and acting first against seals (66) on the piston body (183A) against the housing (182) and, then, on seals (66P) on the piston (183) engaged against the conduit (11 of FIG. 101), thus forming an explosive hydraulic pressure pulse or fluid hammer acting on the fluid trapped fluid and/or fluid member below the piston, thus transferring a kinetic jarring force onto downhole equipment (2BG3 of FIG. 97 e.g.).

Referring now to FIGS. 105 to 122, methods (1BI, 1BJ) of using an annulus boring access members in a retracted deployable position (2BI) and extended boring position (2BJ) are shown, usable with various other method and cable compatible rig-less string operable member embodiments to penetrate conduits and/or strata walls and to access annuli at one or more subterranean depths (218-219 of FIG. 15) to permanently fluidly isolate (211-220 of FIG. 15) at least one of producible zone or annuli from the wellhead.

Referring now to FIGS. 105 and 106, plan and cross-section elevation views with line G-G and along line G-G, respectively, are shown and include a method (1BI) embodiment usable with an annulus boring access (2BI1), boring bit engagable conduits (2BI2), swellable conduit (2BI3), pressure assist piston (2BI4), boring conduit (2BI5) and annular access guiding (2BI6) member embodiments, which are associated with FIGS. 107 to 111. The Figures further depict a flexible shaft (174B) and boring bit (174A) assembly (174) in a retracted (2BI1) deployable position, operable with a downhole motor (111) and using the line tension of the deployment string and applied pressure of the circulatable fluid column (31C) against an assisting piston (2BI4) through a guide (e.g., whipstock) (2BI6) to penetrate a conduit wall (11), at a selected depth, for placing the partially shown well barrier element (3BI) to use and/or abandon a portion (4BI) of a well.

The whipstock guiding member (2BI6) can be deployable with the motor (111), e.g. a motor assembly of the present inventor (2BO of FIG. 123), and can be usable with any form of engagement (180A) between the whipstock (2BI6) and conduit (11), operable with string tension and/or fluid pressure, such as slips or inflatable element grips, wherein after boring the guide may be left in place by releasing the motor assembly (111) from the guide at a connector engagement (45R). As guides are usable to, e.g., place logging members or direct fluids, such as cement, they may be left downhole permanently or retrieved at their connector engagement (45R) after disengaging the hold (180A) on the conduit in which they are placed.

Placeable conduits (2BI2, 2BI3) may or may not be present with the flexible shaft and boring bit (174) being retrievable or detachable and disposable through the guide and/or conduits. In some instances flexible shafts (174B) and/or boring bits (174A) may be sheared from the motor (111) and left within the annuli to, e.g., free a stuck assembly and/or provide standoff (211 of FIG. 15). A boring bit also can be usable as a mechanical expander to expand an expandable conduit (2BI2) placed within an annulus and held by an assisting piston (2BI4) as the bit (174A) is retrieved from its bore by pulling the flexible shaft (174B). A guide (2BI6) may be relatively straight or curved as shown in the depicted method (1BI), to accommodate conduits that are relatively inflexible or malleable materials requiring protection from adverse stresses during placement. Alternatively, if the axial length of the guiding whipstock is significant, e.g. 10 meters, relatively straight conduit members usable for guiding and deploying, e.g., long logging tools within an annulus are usable without adverse affect upon most conduit materials because inclinations and the associated curvature are relatively low.

FIG. 107, a rotated isometric view of an annulus boring access (2BI1) member embodiment associated with FIG. 106 and engagable members of FIGS. 108 to 111, shows a motor (111) with a flexible shaft (174B) and boring bit (174A) assembly (174) with orifices (59B) through the bit for fluid communication and engagement orifices (59A) for the boring conduit (2BI5 of FIG. 111) with, e.g., shear pins. The bit (174A) is shown without cutting surfaces as it may be of any type or angularity, including, e.g., a tractor or auger to crawl and/or bore between the circumferences of adjacent conduits within an annulus to create stand-off (211 of FIG. 15) and separation or flow between eccentric conduits (167C of FIG. 13), wherein the auger pushes through a coupon cut, e.g., by a cutting conduit (2BI5 of FIG. 111).

Referring now to FIGS. 108 and 109, isometric views associated with FIGS. 105 and 106 of boring bit engagable conduit (2BI2) and swellable conduit (2BI3) member embodiments, respectively, are shown with dashed lines illustrating hidden surfaces, and showing conduits that may be, e.g., rigid, flexible, expandable and/or swellable dependent upon use, e.g., the swellable conduit (2BI3) can create a pressure seal between annuli after having been expanded against the bore through the walls of the conduits by the expandable conduit (2BI2). Dependent upon the application, conduits may be rotated with the flexible shaft and boring bit (174 of FIG. 107) or held stationary by the guide (2BI6 of FIGS. 105-106). A race or bearing engagement (190B) at the lower end of the non-rotational conduit (2BI2) allows the lower end conduit (2BI5 of FIG. 111) to rotate and bore a round coupon for an auger bit to push through or assist a boring bit (174A of FIG. 107) during boring operations. An assisting piston (2BI4 of FIG. 110) can be usable for insertion of the conduit into a bored hole and/or pressure assisting the penetration rate of boring bit by engaging a pushing surface (96B of FIG. 110) with the conduit's end or a load shoulder (96A), further usable to engage the conduit (11) wall, thus determining when the conduit is fully inserted and preventing over-insertion. The conduit lip (96A) also serves to connect the bit engagable conduit (2BI2) to the bored conduit (11 of FIGS. 105-106) by, e.g., shaping the lip to the inside diameter of the bored conduit and placing a sealing material between the lip and conduit and/or by constructing the conduit and lip of an expandable metal to deform to the inside diameter of the installed, wherein the lip connector (96A) may hold differential fluid pressure. The boring bit engagable conduit (2BI2) and swellable conduit (2BI3) may also comprise, e.g., swellable expandable mesh membranes (97).

FIG. 110, an isometric view associated with FIGS. 105 and 106 of a pressure assisting annular piston part (2BI4) of annulus engagable member usable to increase the force applied to the boring bit and conduits, illustrates an internal orifice (59C) for passageway for the flexible shaft (174B of FIG. 107) arranged with angular offset surfaces within the orifice to prevent binding of the flexible shaft, when passing through the annular guide member (2BI6 of FIGS. 105 and 106). The piston portion (143) can be arranged to provide a surface for continued pressure assistance once the conduit engagable lip (96A) has left the guide (2BI6 of FIGS. 105-106) with the conduit engagement surface (96B) to the conduit lip connection (96A) to, e.g., deform a sealable elastomeric or metal material to the circumference of the conduit (11 of FIGS. 105-106).

FIG. 111 is an isometric view associated with FIGS. 105 and 106 of a rotatable boring bit engagable conduit member (2BI5) embodiment that can be engagable to the flexible shaft and bit (174 of FIG. 107), with orifices (59A) to, e.g., engage shear pins anchoring the cutting structure (100) rotatable conduit (2BI5) to the bit (174A of FIG. 107), illustrating a conduit engagement race or bearing (190A) axially secured for rotation about a rotating or non-rotating conduit (2BI2 of FIG. 108), wherein the member (2BI5) may rotate with the boring bit (174A of FIG. 107) to, e.g., enlarge the bore for passage of the trailing conduit (2BI2 of FIG. 108).

Figure 112:
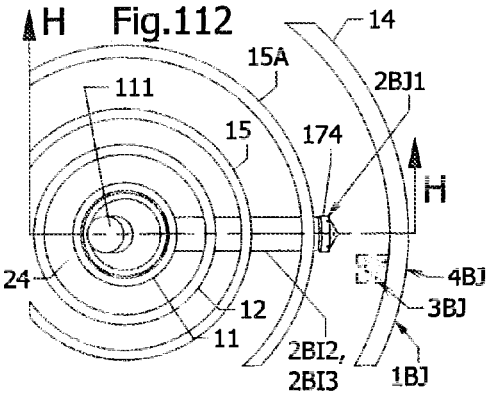
Figure 113:
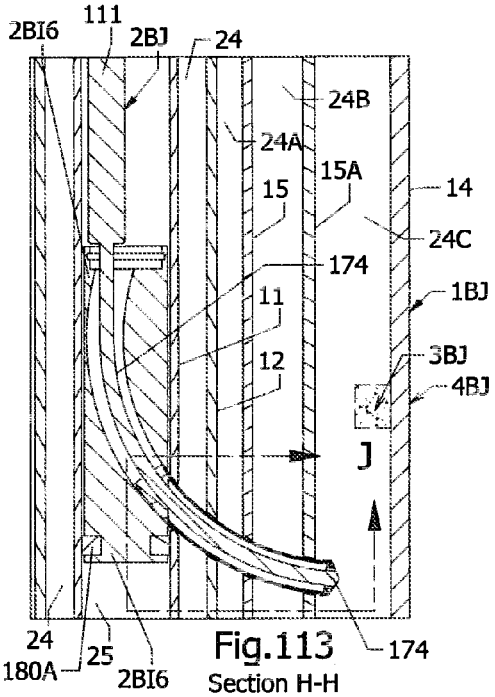

Referring now to FIGS. 112 and 113, a partial plan view and elevation cross section, with line H-H and along line H-H, respectively, associated with FIGS. 105 to 111 and FIGS. 114, 115 and 116 magnified views, showing portions within detail lines J, K and L of FIG. 113, respectively, are shown and depict a method (1BJ) and boring bit engagable conduit member (2BJ) embodiments, which illustrate a flexible shaft and boring (174) arrangement in an extended position (2BJ1) having bored through installed conduits of a well to access annuli (24, 24A, 24B, 24C) and to place the partially shown well barrier element (3BJ), thus using and/or abandoning the annulus (24C) adjacent to a portion (4BJ) of the well. Conduits may be placed with the boring bit or placed after removing the bit and, depending on the pressure bearing nature of the conduit along its axis, one or more annuli may be fluidly accessed.

Straight or curved and relatively rigid or flexible conduits of malleable or hard material are usable with the arrangement (1BJ1), showing that a rigid conduit is placeable through the inner bore (25), concentric conduits (11, 12, 15, 15A) and annuli (24, 24A, 24B) to reach the outer annulus (24C) within commonly sized concentric conduits contained within, e.g., the 30 inch outside diameter conductor (14) casing. Alternatively, the curvature and inclination of the whipstock, (2BI6) deployable through and engagable (180A) to the innermost conduit (25), may be varied and arranged to access any number concentric or eccentric conduits and their associated annuli with flexible or rigid conduit members.

Figure 115:
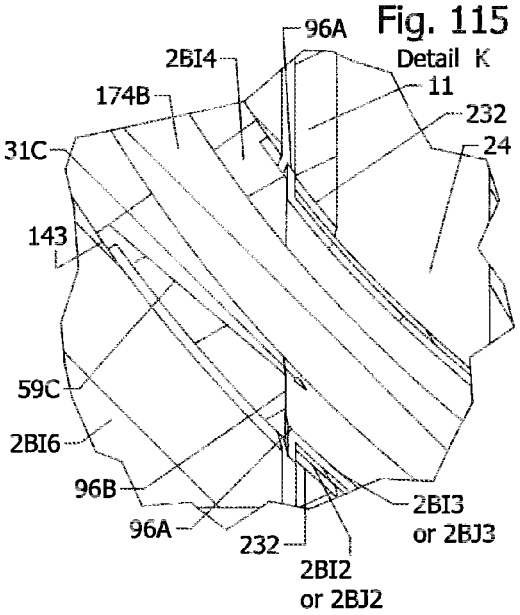
Figure 116:
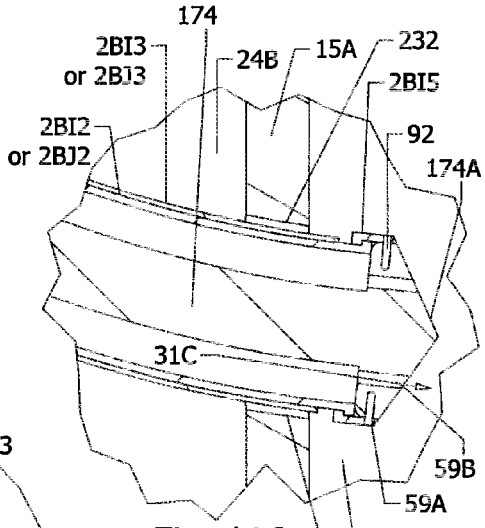
Figure 114:
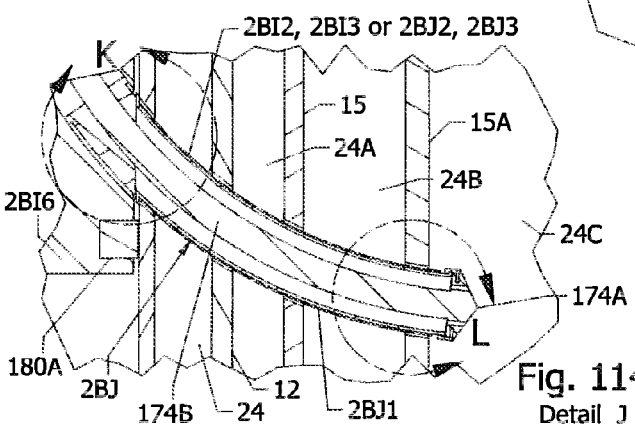

FIGS. 114, 115 and 116, are magnified detail views of the portions of the boring bit engagable conduit member (2BJ), in an extended position (2BJ1), within detail line J of FIG. 113 and detail lines K and L of FIG. 114, respectively, illustrating a conduit member (2BJ) comprising, e.g., an expandable metal conduit (2BI2) with an elastomeric conduit sheath (2BI3) or a rigid metal conduit (2BJ2) with a swellable elastomeric sheath (2BJ3), or other suitable combinations, that are placeable and sealable against the bores penetrating the walls of the well conduits (11, 12, 15, 15A) to provide, e.g., selective fluid communication between the innermost passageway (25) and the outer annulus (24C), wherein the length and sealing capabilities of the wall of the conduits (2BI2, 2BJ2, 2BI3, 2BJ3) may be varied to access and selectively communicate between the innermost passageway (25) and one or more of the annuli (24, 24A, 24B, 24C).

The flexible shaft and boring bit assembly (174) is contained within a conduit capable of fluid communication of the circulatable fluid column (31C) to supply fluid boring bit lubrication and cooling, while penetrating through the well conduit walls, with fluid flowing between the flexible shaft (174B) and the pressure assisting piston (2BI4), carried conduits (2BI2, 2BJ2, 2BI3, 2BJ3), and passageway orifices (59B) of the bit (174A). A rotatable boring conduit (2BI5) can be engagable to the bit (174A) with, e.g., shear pins (92) through orifices (59A), thus providing a slightly larger diameter bore than the bit (174A) for ease of conduit placement, conduit expansion, bit retrieval and/or fluid circulation, cleaning, lubricating and/or cooling.

The pressure assisting piston (2BI4) can be latchable into the guide (2BI6) to hold conduits (2BI2, 2BJ2, 2BI3, 2BJ3) within the bore while extracting the flexible shaft (174B) and boring bit (174A). Conduits may be secured and sealed within the wall penetrations through the conduits (11, 12, 15, 15A) by using expandable metal conduits (2BI2) expanded by boring bit extraction, swellable conduit sheaths (2BJ3) expanded by chemical reactions or other means, such as settable materials like glues, cements or wedges within the space between conduits. After securing placed conduits (2BI2, 2BJ2, 2BI3, 2BJ3) within installed conduit (11, 12, 15, 15A) penetrations, the bit and pressure assisting piston can be retrieved with the guiding member (2BI6) or the guiding member can remain to guide further members or fluid communications, after which the guide (2BI6) may be permanently left downhole or retrieved.

Referring now to FIGS. 117 and 118, plan and elevation cross section views with line M-M and along line M-M, respectively, with dashed lines showing hidden surfaces of method (1BK) and annular access guiding member (2BK) embodiments, usable with flexible shafts and boring bits to access the annuli (24, 24A) of a well for use and/or placement of a well barrier element (3BK) adjacent to a portion (4BK) of the well. Guiding whipstock members, e.g. (2BK), are usable for accessing a plurality of annuli (24, 24A) with a plurality of penetrations (232) through a plurality of conduit (11, 12) circumferential walls at one or more subterranean depths for using a well and/or placing a permanent barrier. Guiding whipstocks are placeable, usable and retrievable with various conduit (11) engagement means (180A), shown for illustration purposes as slips, and connections (45R), wherein a spring operated check valve (84) is usable for fluid displacement from above when, e.g., checking pressures below the whipstock and/or operating a positive fluid displacement motor.

The whipstock member (e.g. 2BK) may form part of a multi-motor assembly (2AN of FIG. 63) or single motor assembly (2BO of FIG. 123) with multi-part (43, 47 of FIG. 48) rotatable whipstocks (2Y of FIG. 48). The method (1BK) may also be combined with various rotatable engagements (180 of FIG. 51) and/or indexing means (e.g. 176A, 176B of FIGS. 78-79) to produce the pattern shown in method (1AP) of FIG. 65 when rotated once to produce 6 bores or, e.g., twice to produce 9 bores. A plurality of bores is usable for cleaning of conduits walls to ensure a wettable surface for bonding (213 of FIG. 15) and, e.g., placement of rheological controllable fluid members around the circumference of annuli conduit walls to support (212 of FIG. 15) or form well barrier elements that bridge the entire annuli.

Referring now to FIGS. 119 and 120, plan and cross section elevation views with line N-N and along line N-N, respectively, are shown and are associated with FIGS. 121 and 122, with dashed lines depicting hidden surfaces. The Figures depict method (1BL) and annular access guiding member (2BL) embodiments, usable to guide another annulus accessing member to place the partially shown well barrier element (3BL) for using and/or abandoning a portion (4BL) of a well.

The member (2BL) can be usable with any conventional rig-less conveyance and/or anchoring apparatuses (e.g. 45R and 180B of FIGS. 117-118) to place a member at one or more selected depths, wherein any annulus engagable (2BL4, 2BL5) or well barrier element (3BL) member parts, being transversely sized or fluidly mobile, may pass through any of the member's (2BL) guiding passageways (2BL1, 2BL2, 2BL3). Cables for logging members (2BL5), flexible shafts for boring bits, or any suitably sized or fluidly acting member is both guidable and usable within the method (1BL).

Swellable and/or fluid members comprising, e.g., a swellable packer element and/or swellable gradated particles (2BL4) may be expelled from the main passageway (2BL4) and forced downward through the enlarged innermost passageway (25E) within the casing (12) using the density, rheological properties and/or pressure exerted on circulatable fluid column to the lower end of the member (2BL), with reagent swelling fluids and/or segregated reactive reagents expelled through each of smaller passageways (2BL2, 2BL3) to mix within the enlarged passageway (25E) forming a gunk and/or swellable packing that bridges across the inner wall of the casing (12). Various conventional pressure burstable separating members may be placed at the lower ends of, e.g., the smaller passageways (2BL2, 2BL3) to release reagents at a defined pressure. Additionally, a motor member (e.g. 2BO of FIG. 123) may be engaged with, and rotate the upper end of the member, (2BL) to assist mixing of a rheological controllable fluid member.

FIGS. 121 and 122 are plan and elevation views, respectively, with dashed lines showing hidden surfaces of method (1BM) and annular access guiding member (2BM) embodiments, depicting a stack of angularly offset members (2BL of FIGS. 119 and 120) usable with various other embodiments to access or place other members, including the partially shown well barrier element (3BM) within one (4BM) or more portions of a plurality of annuli simultaneously. The guiding member comprises larger passageways (2BM1, 2BM3, 2BM5) usable for holding and deploying suitably sized mechanical, elastomeric or fluid annulus engagable members, wherein the larger passageways extend axially downward from smaller connected passageways (2BM2, 2BM4) usable to, e.g., transmit pressure from the circulatable fluid column and to deploy mechanical or electrical cables, flexible shafts or other member parts usable from within the spaces, wherein a plurality of angular offset passageways can be usable, at various depths, to guide the annular engagement of another member, and wherein the guiding member can be selectively rotatable, repeatably around the circumference at the same depth with, e.g., ratcheting devices (176A, 176B of FIGS. 78, 79).

The method (1BM) can be usable to, e.g., guide larger boring bits than are possible from (2BK) of FIGS. 117 and 118, wherein flexible shafts (174B, 2BM6, 2BM7) can be placeable through passageways (2BM2, 2BM4) to engage larger diameter boring bits (174A) extending from within associated larger passageways (2BM1, 2BM3, 2BM5) and usable to bore through an innermost passageway conduit (11) engaging the annulus (24) between the conduit and the casing (12) for placement of the partially shown well barrier element (3BM) to abandon a portion (4BM) of the well. The service breaks (2BM8, 2BM9) are usable to access the flexible shafts and boring bits for repair and replacement, with conduits and associated passageways placeable between the service breaks to vary the depths between penetrations. Additionally by rotating the member (2BM), it is possible to form a plurality of passageways (e.g. 1AP of FIG. 65) simultaneously at various depths using a motorized member (e.g. 2AN of FIG. 63).

Referring now to FIGS. 123 to 147, methods (1BO to 1BU) of using annulus engagable members to mill and shred conduits to form an enlarged innermost passageway are depicted and can be usable for logging and cement placement to permanently fluidly isolate (211-220 of FIG. 15) at least one of producible zone or annuli from the wellhead and to emulate a drilling rig abandonment, wherein the methods and members are also usable in various other embodiments.

FIG. 124 is an isometric view of method (1BN) and axial screw tractor member (2BN) embodiments with an intermediate section removed to show an internal rotor (109) and stator (108), wherein detail lines P, Q and R are associated with FIGS. 125, 126 and 127, respectively. The upper end rotary connector (72U) can be engagable to a slickline or braided wire cable using anti-rotation devices to prevent undesirable twisting of the cable in the event of tractor (2BN) slippage and the lower end rotary connector can be usable with, e.g., a mill (1BT of FIGS. 143-145) the appropriate cross-over and/or vibration dampening devices, wherein the assembly can be usable with, e.g., a conduit shredding member (1BR of 135-140) to form an enlarged innermost passageway (25E of FIG. 127) for placement of the partially shown well barrier element (3BN of FIG. 127) for using and/or abandoning a portion (4BN of FIG. 127).

Referring now to FIGS. 125, 126 and 127, magnified views of the portion of the axial movable screw or tractor member (2BN of FIG. 124), within detail lines P, Q, R of FIG. 124, respectively, are shown and illustrate using the flow of the circulatable fluid column (31C), diverted by an upper seal (2BN1), into upper passageways (2BN2) and to an internal positive displacement fluid motor, comprising a rotor (109) within a stator (108), to drive a lower rotary connector (72L), engagable to, e.g., rotary cleaning, cutting and boring members, an axially tractor within a subterranean conduit engaged to a wellhead, such as a well conduit (11) or buried pipeline engaged through a production header and valve tree to the wellhead, to move the assembly (2BN) axially upward, downward or laterally within the vertical and horizontal portions (4BN) of the innermost passageway of a well or pipeline conduit, depending on the orientation of the screw arrangements (2BQ) against the subterranean conduit wall and, of course, the orientation of the subterranean conduit itself.

The method (1BN) and apparatus (2BN) can be usable for accessing and using a portion (4BN) of a subterranean conduit engaged to a producible zone and/or abandoning a well conduit with a well barrier element (3BN). The tractor (2BN) functions with reactive torque from the rotor (109), with the tractor screw (2BQ) secured to the stator (108), wherein as fluid is positively displaced between the rotor and stator through the fluid, the stator urges the screw (2BQ) engagement of the tractor (2BN) to the conduit (11) and pushes or pulls drive the tractor axially to operate, e.g., cutters (2BP2 of FIG. 129) constrained by the shredding of tubing or other devices.

Fluid from the fluid motor may be discharged through lateral ports (2BN3) and/or axially downward about a solid shaft or through a rotating conduit fluid passageway engaged to, e.g., a drilling bit or cleaning brush with jetting fluid nozzles pulled by the tractor axially downward, wherein the discharged fluid that can be usable by the boring drilling bit for cooling, lubricate and jetting downward to remove a bored object, e.g., previously placed expandable conduits, expandable mesh and/or cement, or, e.g., a nozzled brush may be used to mechanically brush and hydraulically jet clean scale from an installed conduit, so as to provide a clean wettable surface for a permanent cement bond.

FIGS. 128 and 129 are elevation views with the strata and a half section of the conduits removed, wherein the portion below the break line at the bottom of FIG. 128 is connected to the portion shown below the break line at the upper end of FIG. 129. The method embodiment (1BP) can be usable with the set (2BP) of circumferential milling (2BP1), axial conduit shredding (2BP2) and axial movable screw tractor (2BP3) member embodiments rig-lessly operable, using cable string tension and the circulatable fluid column, to drive a fluid motor and kelly (233). The fluid column (31C) can be circulated down the innermost passageway (25), diverted by seals (2BP6) through ports (2BP5) to drive a fluid motor (239), conventional mill (238) and tractor screws (2BP3, 2BP4) pulling a conduit shredder (2BP2), wherein the circulated fluid returns past the lower end of the innermost conduit (11U) through the annulus (24), resulting in the arrangement forming an enlarged innermost passageway (25E) usable to place the partially shown well barrier element (3BP) and abandon a portion (4BP) of the well.

The members (2BP) can be usable to mill the lower end of production tubing (11U) to form an enlarged innermost annulus (25E) engaged with the production annulus (24) using a conventional mill (238) or embodiments (e.g. 2AY of FIG. 74 or 2BT of FIG. 146), wherein an internal kelly (233) extending through the motor (239) to the swivel (234) can be rotated by a kelly bushing engaged to the rotor within the motor, such that the kelly and mill are axially movable (237) to mill the conduit (11U) after it has been shredded by an embodiment (2BP2) pulled by upper (2BP4) and lower (2BP3) screw tractors with radial circumferential fixed or wheeled screw cutters, operated with the reactive torque of the stator, to cut and weaken (236) the conduit helically. The helical weakening (236) of the conduit (11U) assists the shredder (2BP2) restraining, and the pulling by the tractor to split the conduit while the mill (238) is rotated by the motor and reciprocated upward and downward (237), to minimise jamming and stalling of the motor, thus deconstructing the tubing (11U) with the assembly (2BP).

The rotation of the reciprocating (237) kelly (233) and mill (238) are prevented from transferring, damaging and potentially breaking the coiled slickline or braided wire cable string (187) using the bearings and races of the swivel (234) with a further anti-rotation device (235) used to hold the upper end of the swivel (234), thus preventing the transfer of rotation. Rotary cable tool anti-rotation devices of the present inventor engage the wall of the conduit (11U) with spring operated rollers to allow passage of the tools through restrictions, such as nipples, without damaging the inner wall, should it be further needed.

Figure 130:
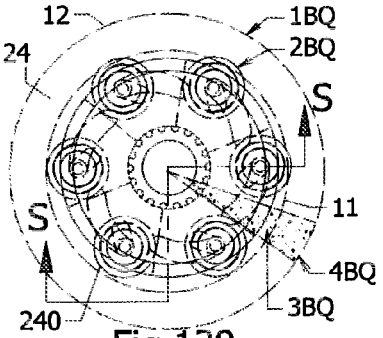
Figure 131:
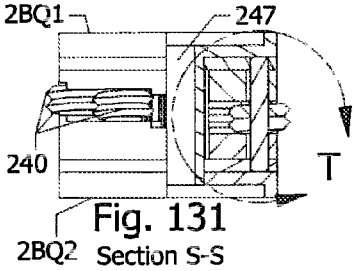
Figure 133:
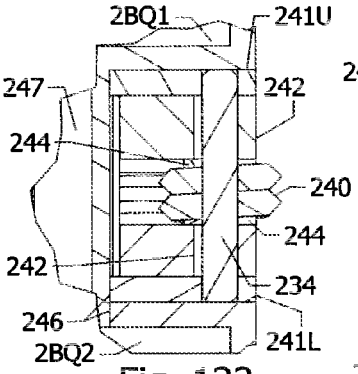

Referring now to FIGS. 130 and 131, plan and cross section elevation views, with line S-S and along line S-S, respectively, of method (1BQ) and axial movable screw member (2BQ) embodiments with dashed lines showing hidden surfaces in FIG. 130, and the detail line T of FIG. 131 associated with FIG. 133, are shown. The Figures illustrate a series of helically placed rotational screw wheel cutters (240) arranged to act as a moving rotational screw tractor within the walls of the containing and deployment conduit (11) that cuts and weakens (236) the wall as it uses its helically placed and rotatable screw wheels. The screw tractor's (2BQ) upper end (2BQ1) or lower end (2BQ2) are engagable to a stator of a fluid motor or the housing of an electric downhole motor and arranged to move upward, e.g., with a conduit shredder, or downward with, e.g., a boring bit, wherein a solid shaft or fluid conduit engaged to the bit, mill or other rotational device can rotate within the central passageway (247) as the tractor pushes or pulls the device. The tractor (2BQ) is therefore usable to apply axial force to a rotating device using the reactive torque of any downhole motor against the a wall of a subterranean well, e.g., to form an enlarged innermost passageway (2BP3 of FIG. 129) for placement of the partially shown well barrier element (3BQ) to use or abandon a portion (4BQ) of a well.

Figure 132:
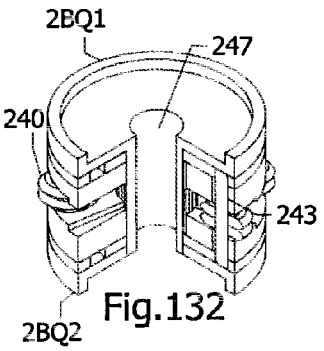
Figure 134:
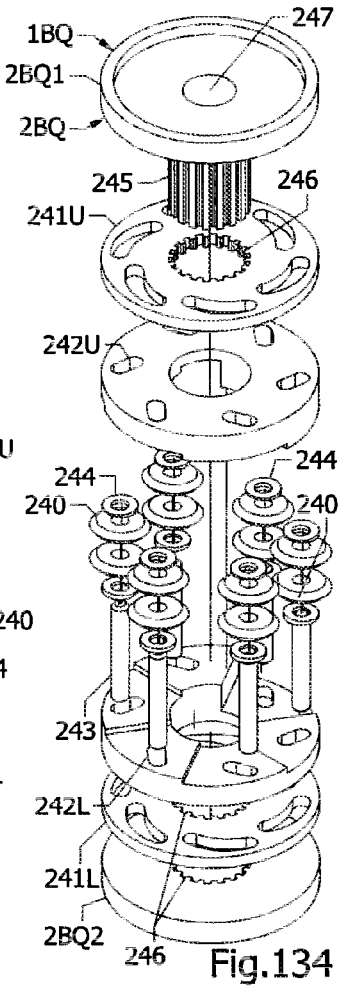

FIGS. 132, 133 and 134 depict an isometric projected view of FIG. 131, a magnified portion of FIG. 131 within line T and an exploded view of component parts of the axial movable screw (2BQ of FIG. 130), respectively, showing that the tractor (2BQ) can be arranged with deployable and retractable wall engagements, to pass restrictions, such as subsurface safety valves and nipples, using, e.g., cam retractable and deployable cutting wheels (240) to weaken (236 of FIG. 129) a wall or non-damaging gripping wheel comprised of a reinforced elastomeric tyre, or tire, material engagable and disengagable from the wall using reactive torque applied to the upper (2BQ1) or lower (2BQ2) connection with the circumference of the tool acting as drag block. For example, when used with a cable deployable downhole motor of the present inventor, the tractor (2BQ) may be deployed with its wheels retracted to pass restrictions within the production tubing (11 of FIG. 130), then deployed to push or pull the fluid motor using the reactive torque of the motor, activated with fluid circulation at a selected depth, to rotate internal cam plates (242U, 242L) and engage the wheels (240) the wall of the conduit (11).

The upper connector (2BQ1) can have gear teeth (245) or splines engagable with associated gear teeth or splines (246) of cam plates (241, 241U, 241L) for driving screw wheel shafts (243) within associated terraced or inclined cammed wheel guides (242U, 242L), arranged to deploy the screw wheels (240) with right hand rotation from the reactive torque of a motor and to retract the wheels with left hand rotation from reactive torque of the motor turning in the opposite direction, or vice versa, dependent on the rotary connections involved and the direction of tractor axial travel. The helical curving of the wheels (240), to form the screw to push or pull the tractor along the wall, is formable with the terraced upper (242U) and lower (242L) cam guide using eccentric shim washers (244) to angularly align the wheels to form a helical screw about the circumference of the member. Alternatively, e.g., the surface may be inclined instead of terraced, without the need for eccentric shimmed washers, wherein an eccentric bearing passageway through the wheel (240) for the shaft (243) is used to form the helical screw.

Figure 135:
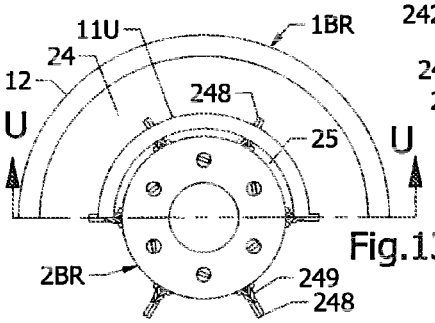
Figure 136:
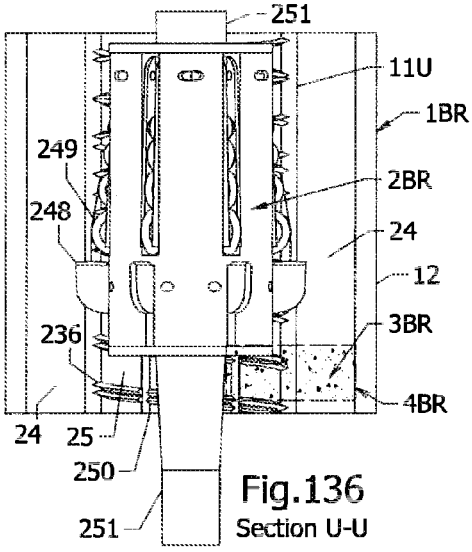
Figure 137:
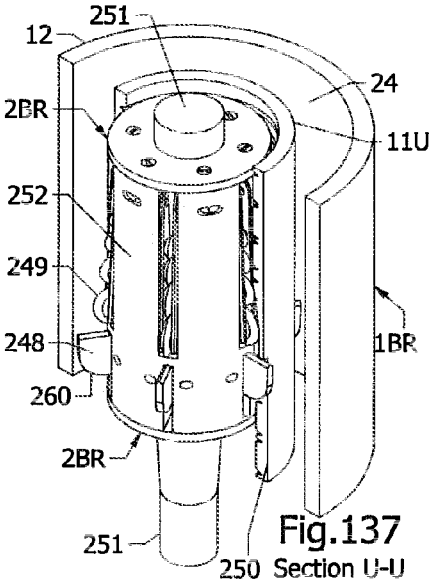
Figure 138:
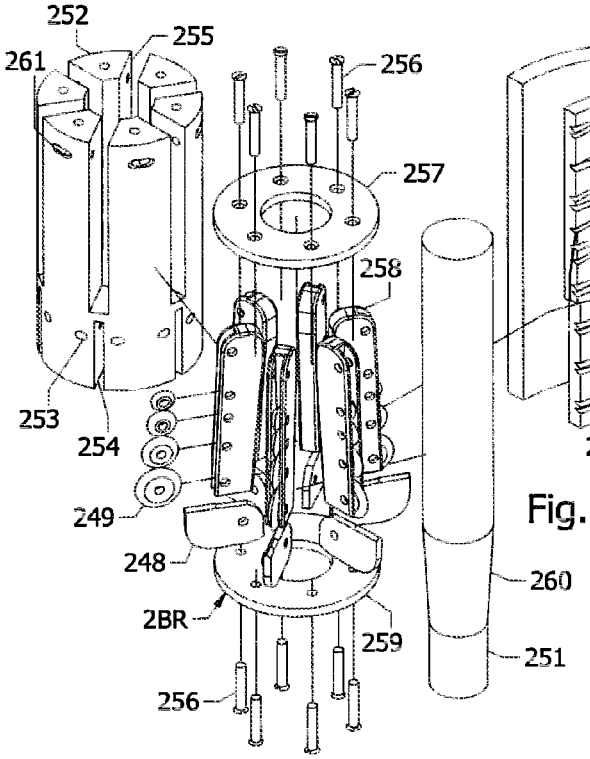
Figure 138:
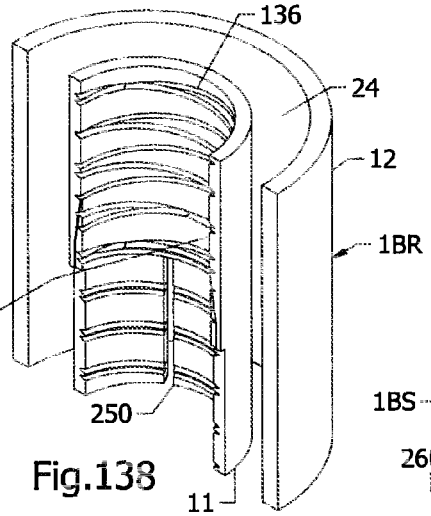
Figure 139:
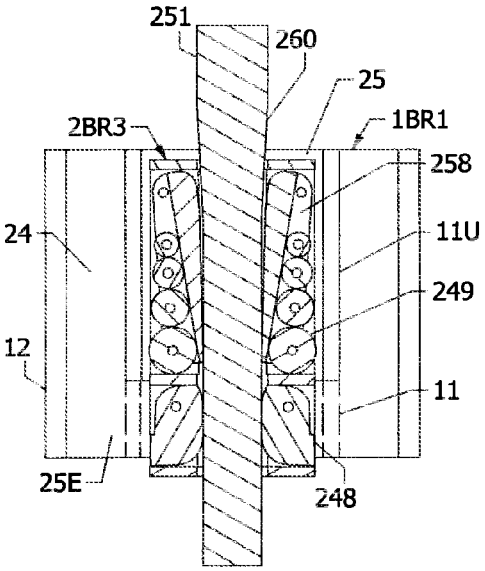
Figure 140:
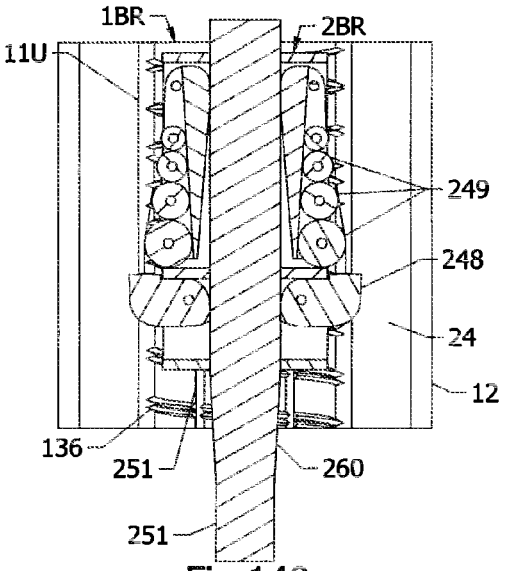

Referring now to FIGS. 135, 136, 137 and 138, plan, elevation, isometric projection and isometric exploded views, respectively, are shown with a half section of the installed well conduits removed and line U-U of FIG. 135 associated with FIGS. 139 and 140. The Figures depict a method (1BR) and axial conduit shredding member (2BR) embodiments, with an upper end (2BR1) rotatable pass through internal axial cam (260) shaft (251) engagable to, e.g., a tractor, motor or a braided cable line pulled by a surface capstan unit capable of supplying sufficient line tension to shred the same conduit through which the member was deployed to, after use, place the partially shown well barrier element member (3BR) to permanently seal a portion (4BR) of a well.

The depicted method (1BR) uses the member (2BR) to shear or shred the weakened (236) conduit (11U) in an axial direction using line tension applied to the upper end or tension applied by an engaged device, e.g., a tractor engaged to the upper end. The cutting extendable and retractable knifes (248) can extend into and engage the annulus (24) within the production casing (12) to produce a cut (250), wherein associated cutting wheels (249) are also usable to weakened the conduit (11U) prior to engagement of the knife (248).

A series of cutting wheels (249) are engagable to and deployable with pivot arms (258) hinged with a pin (not shown) through a shaft support (261) in the body (252) from within cavities (255), that can be actuated by the axial cam (260), wherein the cam (260) is also usable to deploy knives (248) with similar shaft support (253) and knife recesses (254) from within the body (252). The recesses (254, 255) of the body (252) are supported with upper (257) and lower (259) plates secured with connectors (256) to the body (252).

Referring now to FIGS. 139 and 140, elevation cross section views along U-U of FIG. 135 showing the method (1BR1) associated with the axial conduit shredding member (2BR) and the method (1BR) associated with the axial conduit shredding member (2BR) of FIGS. 135 to 138, illustrating a rotatable shaft (251 of FIG. 139) and cam (260 of FIG. 139) in an inactivated deployment position (2BR3), with the wheel cutters (249) and knives (248) deployable through the inner passageway (25) of the innermost conduit (11U) and in an activated position (260 of FIG. 140), and with the cutters (249) and knives (248) deployed to cut (250) and shred the conduit (11U), which in FIG. 140 has been weakened (136) by a tractor's screw cutters.

The method (1BR1) can be usable with a coiled cable string and capstan pulling unit deployed within a previously uncut conduit (11 shown as dashed lines), wherein the cam can be arrangable to extend the cutters with applied string tension using, e.g., a mechanical and/or hydraulic jar to selectively actuate the tool at a depth with upward acceleration and/or jarring, and releasing the tool from the wall of the conduit with, e.g., downward jarring. A shredding member is formable with both or either of the knives (248) and wheel cutters (148), with or without tractor cutter weakening (136). In this method, the member can be deployable once the assembly (1BR, 2BR) has exited a cut conduit (11U) with a compressed lower end or, e.g., directly from within an uncut conduit (11) using a surface hoisting and/or capstan unit. Additionally, the complexity and associated construction cost of member may be such that they are disposable downhole, within the well to be abandoned after having served their purpose. For example, a shredder may be activated with a small explosive charge after placement at a desired depth followed by shredding of the conduit with a capstan, disengaging the coiled cable string and leaving the shredder downhole, once a sufficient length of tubing has been shredded. This may be followed by circulation, cleaning and placement of cement or, e.g., cutting the tubing above the shredded conduit portion and disposed of member, then placing a piston member to compress the shredded conduit leaving an enlarged innermost bore within the production casing to simulate drilling rig abandonment (172A of FIG. 10).

Figure 142:
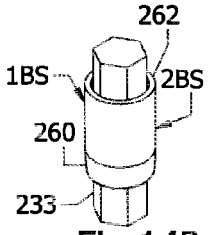
Figure 141:
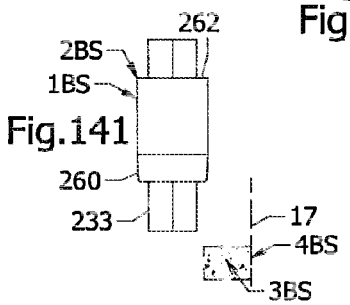

FIGS. 141 and 142 are elevation and isometric views of an axial adjustable cam arrangement method (1BS) for a kelly slideable cam member (2BS) usable with the axial conduit shredding member (2BR, 2BR1 of FIGS. 135 to 140) and hexagonal kelly (233 of FIG. 129), to allow pass through of a kelly (233), through an axial cam (260) sleeve (262), for actuating an axial conduit shredding member between shredding (2BR) and deployment (2BR1). The cam can be engagable to any member, e.g. a tractor (2BP2 of FIG. 129) to allow axial movement (237 of FIG. 129) and rotation of the kelly together with actuation and deactivation of a shredder by moving the sleeve (262) upward or downward. The method can be usable with axial movable and rotational mills, cutters, boring devices and/or other annulus access members to displace at least one wall of a well for placement of the partially shown well barrier element (3BS), usable to abandon a portion (4BS) of a well within, e.g., a strata wall (17) of the well.

Figure 143:
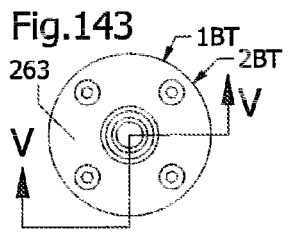
Figure 144:
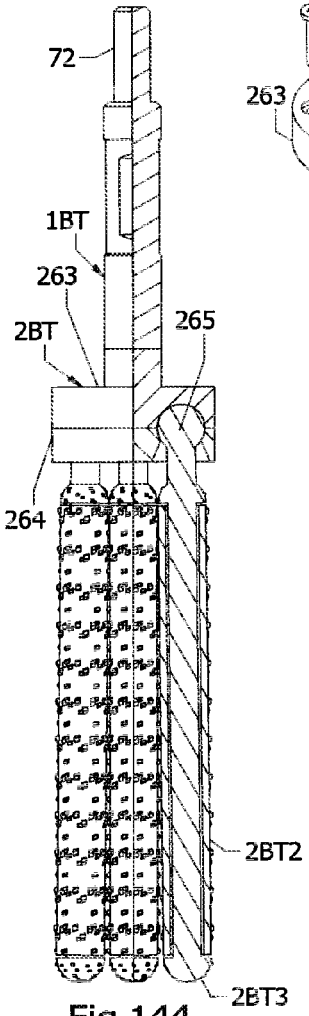
Figure 145:
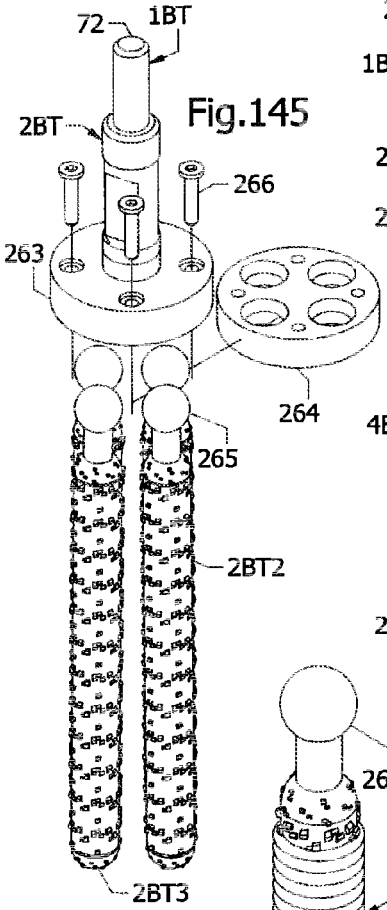

Referring now to FIGS. 143, 144 and 145, plan, elevation cross section and isometric exploded views with line V-V, along line V-V and associated with FIG. 143, respectively, are shown and depict a circumferential milling member (2BT) embodiment usable in the method (1BT of FIG. 146) to place a well barrier element (3BT of FIG. 146) for abandoning a portion (4BT of FIG. 146) of a well, wherein the apparatus represents a low cost milling member that is disposable downhole should it become stuck.

An upper rotary connector (72) can be usable to engage the mill to, e.g., a cable deployable fluid motor (2B1 of FIG. 17) with rotation of the upper ball joint housing (263) and ball joints usable to deploy the milling arms (2BT3) outward with the centrifugal force of rotation, with milling sleeves (2BT2) rotatable about the arms (2BT3), such that the ball joints (265) at the upper end of the milling arm and rotatable sleeves (2BT2) and associated cutting structures reduce the required torque and propensity to jam the mills, because jamming forces are limited by the centrifugal deployment and rotating sleeves.

Releasing bolts (266), engaging the lower ball joint housing (264) to the upper ball joint housing (263), resist shearing during rotation, but may be jarred out of the lower ball joint housing (264) to retrieve the remaining portion of the motor assembly if the milling arms (2BT2, 2BT3) become struck.

Flexibility of the ball joints (265), rotatable abrasive sleeves (2BT2) and disposable lower end mills provide an economic means for milling casing (12) and/or poorly bonded cement, because the method is usable with the low space requirements and available torque of rotary slickline unit operations, albeit additional time will be required at a significantly lower daily cost than a drilling rig. Where conventional rig-less methods use tools generally requiring more torque than is supportable on, e.g. minimal facilities (170A and 170B of FIGS. 4 and 6, respectively), the present inventions casing milling methods can be usable for milling over a sufficient period of time, wherein if tools become stuck, they may be left downhole without significant consequences to the cost of operations or the well being abandoned.

FIG. 146 is an isometric view associated with FIGS. 143 to 145 of a method embodiment (1BT) within a plurality of installed conduits, with a half section removed, to show a circumferential milling member (2BT), illustrating the mill in a centrifugal force deployed position (2BT1) having milled the conduits (11, 12) and engaged the annuli (24, 24A) through rotation of the motor engagable rotary connector (72) to allow placement of the partially shown well barrier element (3BT) in the annuli (24, 24A) and enlarged innermost passageway (25AE) within the intermediate casing (15) to abandon a portion (4BT) of the well.

Figure 147:
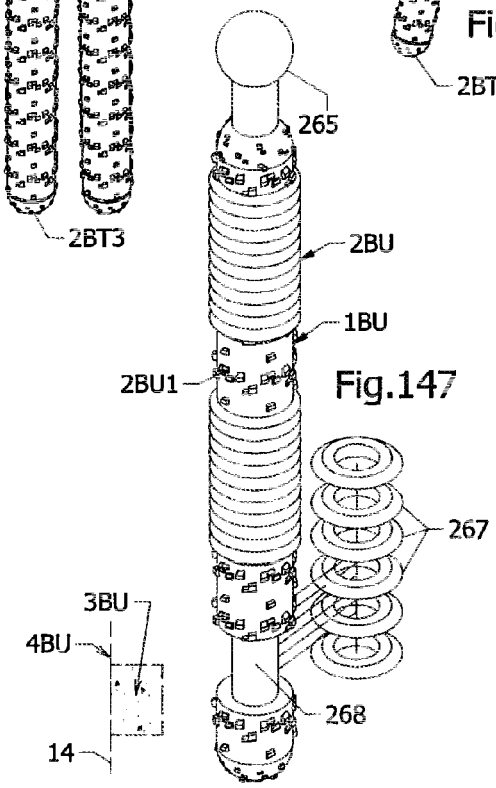

FIG. 147 is an isometric view of method (1BU) and circumferential shredding and milling arm member (2BU) embodiment, depicting an arm with a ball joint (265) usable with the mill of FIGS. 143 to 146. The arm (2BU1) has a shaft (268) for rotatable cutting wheels (267) that can be usable to reduce torque requirements and jamming or sticking of a mill, so as to mill and or shred within and including the conductor (14) and to place the partially shown well barrier element (3BU) to abandon a portion (4BU) of the well.

Embodiments of the present invention thereby provide a system of methods and members usable in any order, depth or well configuration as demonstrated in FIGS. 16 to 19, FIGS. 21 to 46, FIGS. 48 to 74 and FIGS. 80 to 147 to rig-lessly access annuli to use and/or abandon a well with better economics than are possible with conventional drilling rig operations, said system being usable with minimal supporting facilities and within a limited space and/or within environmentally sensitive areas, such as offshore or the arctic, to suspend, side-track and/or abandon wells rig-lessly placing a permanent barrier according to published industry minimum requirements.

While various embodiments of the present invention have been described with emphasis, it should be understood that within the scope of the appended claims, the present invention might be practiced other than as specifically described herein.

Reference numerals have been incorporated in the claims purely to assist understanding during prosecution.

The invention claimed is:

1. A method (1A-1BU) of providing (220) or enabling (211-219) restoration of cap rock of at least a portion (4A-4BU) of a producible zone of a subterranean well, the method comprising the steps of:

placing and supporting at least one cement equivalent well barrier member (3A-3BU, 20, 216) within an operable usable space formed by at least one cable operable and rig-less string operable, annulus engagable member (2A-2BU) comprising components that are cable and rig-less string conveyable through an innermost passageway (25, 25E, 25AE) surrounded by at least one annulus of a plurality of annuli formed by installed conduits (11, 12, 14, 15, 15A, 19) extending downward from a wellhead (7) within subterranean strata (17) for forming a plurality of passageways (24, 24A, 24B, 24C, 25, 25E, 25AE) in fluid communication with said producible zones through said cap rock;

using energy conductible through said rig-less string or through movable fluid of a circulatable fluid column (31C) within said plurality of passageways to operate said at least one annulus engageable member; and using said at least one annulus engagable member to access said at least one annulus from said innermost passageway, displace at least one portion of a wall of at least one conduit about said innermost passageway to provide an operable space, bridge across said operable space, and place said at least one cement equivalent well barrier member through said operable space adjacent to said cap rock to form at least one geologic time-frame space usable to fluidly isolate said at least one portion of said subterranean well without removing said installed conduits and associated debris from below one or more subterranean depths (218) of associated capping rock to provide or enable said restoration of said cap rock above said producible zone.

2. The method according to claim 1, further comprising the step of providing said fluid isolation and sidetracking to access another of said producible zones to provide subterranean well production (34P).

3. The method according to claim 1, further comprising providing permanent said fluid isolation and said restoration of said cap rock by using said operable space to measure (2A1-2A3, 2L1, 2AB2, 2AM3, 2AT3) or provide (214) cement-like (216) bonding (213) across a sufficient axial length (219) of conduits embedded in (215) or filled within and embedded in (217) cementation with stand-off (211) between conduits and support (212) of said cementation at said subterranean depth (218) adjacent to impermeable strata capping rock prior to performing said placing of said at least one cement equivalent well barrier member through said operable geologic time-frame space for enabling said restoration of said cap rock above said producible zone.

4. The method according to claim 1, further comprising providing an abrasive, explosive, or cutting component for said accessing of said at least one annulus from said innermost passageway, or said displacing of said at least one portion of said wall of said conduit to provide said operable space.

5. The method according to claim 4, wherein said cutting component comprises a conduit shredding member (2E2, 2AW2, 2BP2, 2BR) comprising one or more peripheral cutting edge components, wherein said one or more peripheral cutting edge components comprise wheels, blades, or combinations thereof, and wherein said conduit shredding member is deployable axially and radially outward from said innermost passageway with a solid or kelly pass-through cam to shred and displace said wall.

6. The method according to claim 4, wherein said cutting component comprises an annulus milling member (2E6, 2AV3, 2AW1, 2AY1, 2BP1, 2BT1-2BT3) comprising one or more rotatable peripheral cutting edge components, wherein said one or more rotatable peripheral cutting edge components comprises wheels, blades, or combinations thereof, usable for axially, rotatably, and circumferentially penetrating and cutting said wall.

7. The method according to claim 1, further comprising providing a motorized member (2B1, 2AN, 2AM2, 2BN, 2BO, 2BP) comprising at least one downhole motor that is suspendable from a cable and operable with the energy from said rig-less string or said circulatable fluid column to drive at least one rotatable cutting component or a mechanical linkage component.

8. The method according to claim 7, further comprising providing an axially tractor operable member (2AW3, 2BN, 2BP3-2BP4, 2BQ) comprising said mechanical linkage or at least one cutting component that is engageable to said wall of said conduit to axially move through said innermost passageway for displacing another well barrier member or said wall.

9. The method according to claim 7, wherein the step of providing the motorized member further comprises providing a motorized annulus boring access member (2B3, 2C1, 2E4, 2L3, 2Y3, 2Z1, 2Z2, 2AA1, 2AB1, 2AC, 2AD, 2AE1, 2AN, 2AM2, 2AQ2, 2AS1, 2AV4 and 2BI1) comprising at least one rotatable cutting component having a flexible shaft and boring bit for penetrating and displacing a portion of said wall of said installed conduit.

10. The method according to claim 7, wherein the step of providing the motorized member further comprises providing a motorized borable mechanical linkage component for displacing at least one portion of said wall of said conduit to provide a stand-off displacement or to prevent further displacing of at least one portion of said wall of said installed conduit from another portion.

11. The method according to claim 1, further comprising providing a guiding member (2C1, 2D3, 2E4, 2N6, 2Y1, 2Y2, 2Z1, 2AB3-2AB4, 2AC, 2AM2, 2AO1, 2AP, 2AQ1, 2AQ2, 2AT1, 2BI2-2BI3, 2BJ, 2BI6, 2BK, 2BL, 2BM) comprising a selectively orientable guiding whipstock (2Y2, 2AB1, 2AQ1, 2BI6, 2BK, 2BL, 2BM, 47), a conduit (2D2, 2AE3, 2AF, 2AK, 2AL, 2AO3, 2AS2, 2AT3, 2AV2, 2AV5, 2BI3, 2AB3, 2AC1, 2BI5), an annulus bridge (2X3, 2AH, 2AJ1-2AJ3, 2AU1, 2AY2, 2AZ, 2BB, 2BC, 2BD, 2BM2), or combinations thereof, that is engagable and orientable within said innermost passageway to urge a passage of another well barrier member or said movable fluids through said wall using an alignable bore selector between said innermost passageway and at least one penetration in said wall.

12. The method according to claim 11, wherein at least one portion of said selectively orientable guiding whipstock or said guiding conduit is rotatably orientable and selectable with said bore selector between a plurality of penetrations in said wall from within said innermost passageway.

13. The method according to claim 11, further comprising providing a fluid communication conduit component that is placeable within said operable space through said innermost passageway or through said guiding member with said movable fluid pressure against a wall of said fluid communication conduit component.

14. The method according to claim 13, wherein the wall of said guiding conduit comprises a rigid material, a mechanically expandable material, a chemically expandable material, or a rigid and expandable material, that is sealable against said wall of said installed conduit.

15. The method according to claim 13, further comprising providing said fluid communication conduit borable mechanical linkage component within said operable space to bridge across or through at least two passageways of said plurality of passageways to access said operable space.

16. The method according to claim 15, further comprising providing a fluid communication mesh wall conduit component with at least one portion of said wall of said fluid communication conduit comprising permeable pore spaces sized for packing and unpacking of particles or compositions that are usable to selectively prevent or provide fluid communication through said pore spaces using a flow orientation of said circulatable fluid column, said pore space sizing, or said particles or compositions.

17. The method according to claim 13, further comprising providing a straddle member (2B4, 2C2, 2D1, 2E1, 2E5, 2L2, 2M, 2N2, 2R2) with said fluid communication conduit component for bridging across at least two perforations in said wall of said conduit to segregate flow between said at least two perforations and another passageway of said plurality of passageways to fluidly connect an annulus above and below a blockage in said annulus to fluidly communicate around said annular blockage.

18. The method according to claim 17, wherein said straddle member comprises a slideable piston for displacing or impacting said movable fluids or another well barrier member within said plurality of passageways using pressure from said circulatable fluid column, wherein said slideable piston forms a valve for opening and closing at least one penetration in said wall of said conduit to selectively and fluidly bypass a portion of said circulatable fluid column in one circulation orientation through said at least one penetration or to fluidly communicate through a longer portion of said circulatable fluid column in the opposite circulation orientation.

19. The method according to claim 1, further comprising providing a mechanically or fluidly placeable pressure bearing packer member (2F-2K, 2N5, 2S2, 2T1, 2B7, 2D4, 2E7, 2N4, 2O2, 2P, 2Q, 2R1, 2S1, 2T3, 2U, 2V1-2V2, 2W2, 2X2, 2AE2, 2AG, 2AI, 2AK, 2AL, 2BF1, 2BF3, 2BI4) that is expandable within said operable space and is axially fixable or movable within at least one of said plurality of passageways to provide: said displacing of said at least one portion of said wall of said conduit to provide said operable space, said bridging across said operable space, or said placing of said at least one cement equivalent well barrier member through said operable space to fluidly isolate said at least one portion of said subterranean well.

20. The method of claim 19, wherein the fluidly placeable pressure bearing packer member comprises a mechanical packer with cylindrical, bag or umbrella components.

21. The method of claim 19, wherein the fluidly placeable pressure bearing packer member comprises a gelatinous packer with particles or rheological fluid components fluidly placeable and gelatinously fixable within at least one of said plurality of passageways.

22. The method of claim 21, wherein the particles comprise gradated particles with intermediate pore spaces that are fillable by a chemical reagent mix for forming said gelatinous packer.

23. The method according to claim 19, further comprising axially compressing adjacent well components within axially adjacent operable spaces with said fluidly placeable pressure bearing packer member for forming or enlarging said operable space.

24. The method according to claim 19, further comprising laterally compressing well components within radially adjacent operable spaces with said fluidly placeable pressure bearing packer member for forming said operable space for said placing of said at least one cement equivalent well barrier member through said operable space to fluidly isolate said at least one portion of said subterranean well.

25. The method according to claim 1, further comprising providing a jarring member (2E3, 2S3, 2T2, 2U2, 2V1, 2W1, 2X5, 2BF3, 2BG6, 2BH1-2BH3) comprising a latchable and releasable piston, sealable within said innermost passageway and fireable with energy released from compressing said circulatable fluid column, to travel along a dance pole or a re-latching rod and to deliver an explosive hydraulic jarring pulse, a mechanical impact, or combinations thereof, to objects below said releasable piston.

26. A system for providing (220) or enabling (211-219) restoration of cap rock of at least a portion (4A-4BU) of a producible zone of a subterranean well, comprising:

at least one cable compatible apparatus member (2A-2BU) that is cable and rig-less string operable and annulus engagable for forming an operable space and an assembly of placeable, disposable and retrievable components that are cable and rig-less string conveyable through an innermost passageway (25, 25E, 25AE) surrounded by at least one annulus of a plurality of annuli that are formed by installed conduits (11, 12, 14, 15, 15A, 19) extending downward from a wellhead (7) within subterranean strata (17) for forming a plurality of passageways (24, 24A, 24B, 24C, 25, 25E, 25AE) in fluid communication with said producible zones through said cap rock, and at least one cement equivalent well barrier member (3A-3BU, 20, 216) placed in said operable space formed by operating said at least one cable compatible and annulus engagable apparatus member within the operable space using energy conductible through said rig-less string or through movable fluid of a circulatable fluid column (31C) within said plurality of passageways to operate said at least one cable compatible apparatus member to provide said operable space by accessing said at least one annulus from said innermost passageway, displacing at least one portion of a wall of at least one conduit about said innermost passageway to provide an operable space adjacent to said cap rock, bridging across said operable space, to form at least one said geologic time-frame space usable for placing said well barrier member to fluidly isolate said at least one portion of said subterranean well without removing said plurality of installed conduits and associated debris from below one or more subterranean depths (218) of associated capping rock to provide or enable said restoration of said cap rock above said producible zone.

27. The system according to claim 26, further comprising at least one cutting component that comprises a rotatable or a pullable cutting end for said accessing of at least one annulus from said innermost passageway, or said displacing of said at least one portion of said wall of said conduit to provide said operable space.

28. The system according to claim 27, wherein said cutting component comprises a conduit shredding member comprising one or more peripheral cutting edge wheels, one or more blades, or combinations thereof, wherein said conduit shredding member is deployable axially and radially outward from said innermost passageway with a solid or kelly pass-through cam to shred and displace said wall.

29. The system according to claim 27, wherein said cutting component comprises an annulus milling member comprising a kelly deployable, flexibly engagable ball joint milling and cutting arrangement having one or more rotatable, peripheral cutting edge wheels or blades usable for axially, rotatably and circumferentially penetrating and cutting said wall of said conduit with said downhole motor or said downhole motor and another member.

30. The system according to claim 26, further comprising a motorized member comprising at least one downhole motor, wherein said motorized member is suspendable from a cable and operable with the energy from said rigless string or circulatable fluid column to drive said at least one rotatable or pullable cutting component with a mechanical linkage component.

31. The system according to claim 30, further comprising an axially screwing tractor operable with the reactive torque of said at least one downhole motor for driving a screw arrangement to engage said wall of said conduit and to screw through said innermost passageway to displace said wall or pull said at least one rotatable or pullable cutting component.

32. The system according to claim 30, wherein the motorized member comprises a motorized annulus boring access member having at least one rotatable cutting component comprising a flexible shaft and boring bit for penetrating and displacing at least one portion of said at least one wall.

33. The system according to claim 30, wherein the motorized member comprises a motorized borable mechanical linkage component for displacing at least a portion of said wall of said conduit to provide stand-off displacement or to prevent further displacing of at least a portion of said wall from another portion.

34. The system according to claim 26, further comprising a guiding member comprising a selectively orientable guiding whipstock, a conduit, or a conduit and whipstock, wherein the guiding member is engagable to and orientable within said innermost passageway to urge the passage of another well barrier member, said movable fluids, or combinations thereof, through said at least one wall using an alignable bore selector between said innermost passageway and at least one penetration in said wall.

35. The system according to claim 34, wherein at least one portion of said selectively orientable guiding whipstock or said guiding conduit bore selector is rotatably orientable and selectable with said bore selector between a plurality of penetrations in said wall from within said innermost passageway.

36. The system according to claim 34, further comprising a fluid communication conduit component placeable within said operable space through said innermost passageway or through said guiding member with said movable fluids pressure against a wall of said fluid communication conduit component.

37. The system according to claim 36, wherein the wall of said fluid communication conduit component comprises a rigid material, a mechanically expandable material, a chemically expandable material, or a rigid and expandable material, that is sealable against at least one of said installed conduit.

38. The system according to claim 36, wherein said fluid communication conduit components, borable mechanical linkage components, or conduit and mechanical linkage components are within said operable space for bridging across or through at least two passageways of said plurality of passageways to access said operable space.

39. The system according to claim 38, wherein the fluid communication conduit component comprises permeable pore spaces within a portion of a wall of said fluid communications conduit component that are sized for packing and unpacking of particles or compositions usable to selectively prevent or provide fluid communication through said pore spaces using flow orientation of said circulatable fluid column, said pore space sizing, and said particles or compositions.

40. The system according to claim 36, further comprising a straddle member comprising said conduit component bridging across at least two perforations in said wall, wherein the straddle member segregates flow between said at least two perforations and another passageway of said plurality of passageways to fluidly connect an annulus above and below a blockage in said annulus and fluidly communicate around said annular blockage to, in use, fluidly displace said movable fluids or another well barrier member within said annulus around said annular blockage.

41. The system according to claim 40, wherein a slideable piston displaces or impacts said movable fluids, another fluid member, or combinations thereof.

42. The system according to claim 41, wherein said slideable piston is usable to form a valve to open and close at least one penetration in said wall of said conduit to selectively and fluidly bypass a portion of said circulatable fluid column in one circulation orientation through said penetration or to fluidly communicate through a portion of said circulatable fluid column in the opposite circulation orientation.

43. The system according to claim 26, wherein a pressure bearing seal is formed when a packer with a bag or a packer bag and pressure relief valve component are filled with non-chemically reactive particles, chemically reactive particles, or combinations thereof and engaged with said wall.

44. The system according to claim 43, further comprising an axial piston component usable for axially displacing at least a portion of said wall, said movable fluids, or combinations thereof, by axially compressing axially adjacent components within an axially adjacent space to form or enlarge said operable space.

45. The system according to claim 43, further comprising a lateral piston component for laterally compressing well components within radially adjacent operable spaces with said packer to form said operable space for said placing of said well barrier member to fluidly isolate said at least one portion of said subterranean well without removing said plurality of installed conduits and associated debris from below one or more subterranean depths (218) to provide or enable said restoration of said cap rock above said producible zone.

46. The system according to claim 26, further comprising a packer with rheological fluid composition and packable gradated particle packer components fluidly placeable within said operable space in segmented portions to form a pressure bearing bridge between said portion and another portion of said wall of said conduit, wherein said packable gradated particle intermediate pore spaces are fillable by said rheological fluid composition comprising a chemical reagent mix or a gunk.

47. The system according to claim 46, wherein a chemical reagent composition of the chemical reagent mix or gunk comprises:

a first fluid mix of organophilic clay comprising from 5% to 60% by weight of a composition mixed with a hydratable gelling agent sufficient to suspend said clay with weighting material and alkaline source components placed within water comprising from 15% to 60% by weight of the composition, wherein said first fluid is mixable and chemically reactable with:

at least a second fluid comprising water comprising from 15% to 60% by weight of a composition mixed with a hydraulic cement comprising from 15% to 75% by weight of the composition or an oil based mud comprising from 15% to 60% by weight of the composition mixed with weighting materials comprising from 15% to 75% by weight of the composition.

48. The system according to claim 26, further comprising a jarring member comprising a latchable and releasable piston, wherein the jarring member is sealable within said innermost passageway and fireable with energy released from compressing said circulatable fluid column, to travel along a dance pole or a re-latching rod and to deliver an explosive hydraulic jarring pulse, a mechanical impact, or combinations thereof, to another member, said movable fluids, or combinations thereof.

* * * * *